United States Patent [19]

Batchelor et al.

[11] 4,153,241

[45] May 8, 1979

[54] DOUBLE DOCUMENT FEED DETECTION FOR A DOCUMENT HANDLER IN A REPRODUCTION MACHINE

[75] Inventors: Philip J. Batchelor; Ernest L. Legg, both of Fairport, N.Y.

[73] Assignee: Xerox Corporation, Stamford, Conn.

[21] Appl. No.: 829,024

[22] Filed: Aug. 30, 1977

[51] Int. Cl.[2] ..... B65H 7/02

[52] U.S. Cl. ..... 271/4; 271/259; 271/265

[58] Field of Search ..... 271/4, 258, 259, 265

[56] References Cited

U.S. PATENT DOCUMENTS

| | | | |
|---|---|---|---|
| 3,709,485 | 1/1973 | Acquaviva | 271/259 |
| 4,026,543 | 5/1977 | Leclere | 271/259 |

*Primary Examiner*—Richard A. Schacher

[57] ABSTRACT

A control system for a document handler in a reproduction machine. As the document handler transports a set of originals to an exposure platen, a counter is incremented and stores the total number of documents placed on the platen for the set. If it is desired to recycle the set to the platen again, the machine compares the document totals for each set cycle to insure that they are the same thereby checking for erroneous double document feeds.

2 Claims, 50 Drawing Figures

FROM CLOCK 552
Ø1
Ø2
542
507
510
TO: MEMORY 545,546
ADDRESS
A0
A15
(HOLD A)
(HOLD)
(DBIN)
EN
TO: MEMORY
508
TO: MEMORY 545,546
DATA
D0
D7
511
TO: MEMORY READY 548
(MEMR)
(OUT)
(WO)
(INP)
(MI)
(HALTA)
(STACK)
(INTA)
LATCH REGISTER
FROM: 552
Ø1-1
(SYNC)
(READY)
FROM: MEMORY READY 548
(INT)
(RESET)
(WAIT)
FROM: 550
(INTE)
(WR)
TO: MEMORY 546,545

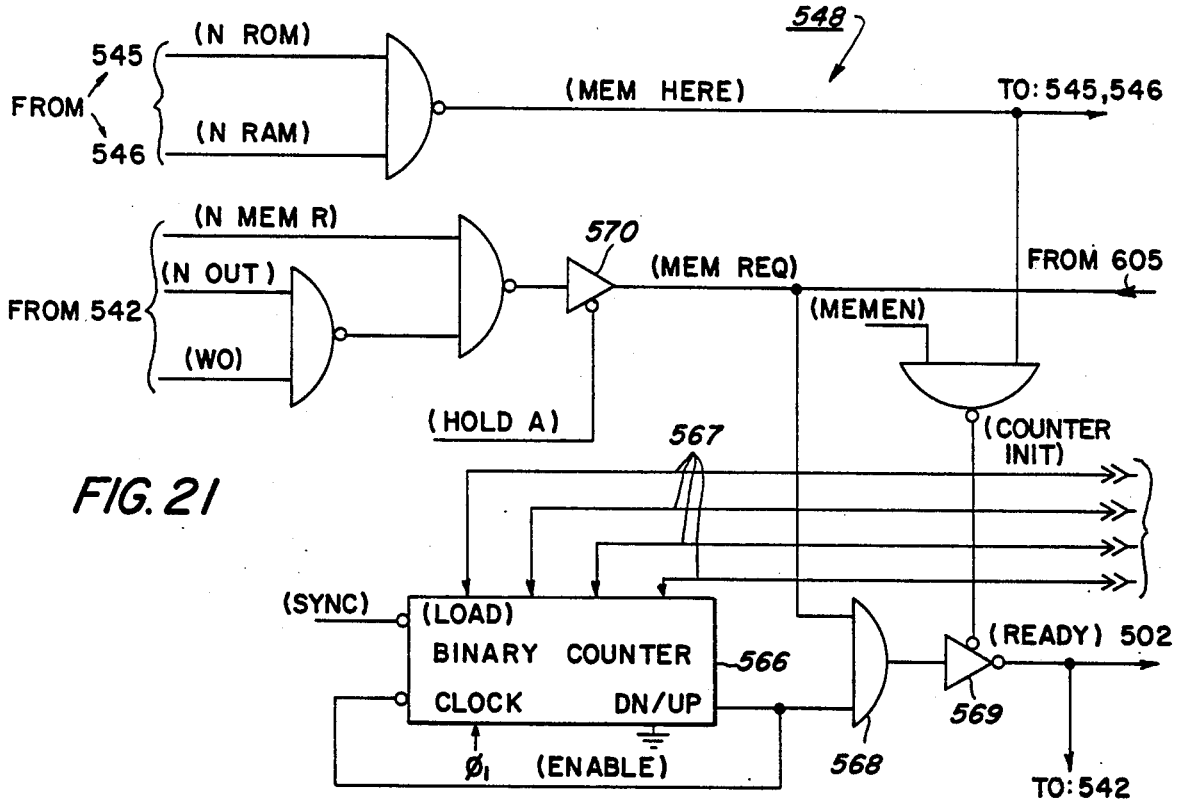
FIG. 21
MEMORY READY
FIG. 24
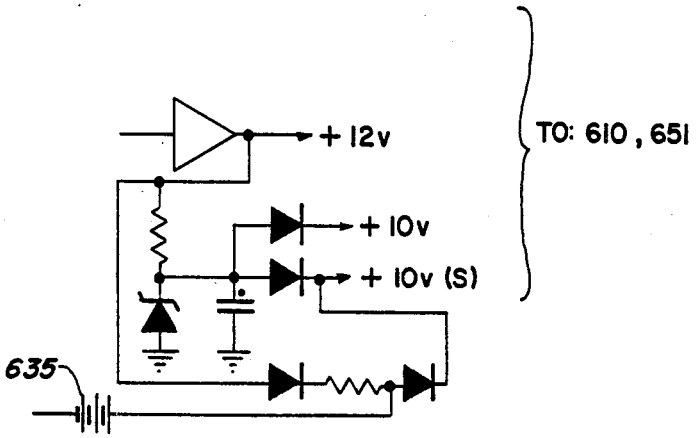

MACHINE INTERRUPT ROUTINE

LEGEND:

PNTR- POINTER
INCRM- INCREMENT
REL- RELATIVE
ADDR- ADDRESS
SR - SHIFT REGISTER
REG - REGISTER
SUBR- SUBROUTINE

REAL TIME INTERRUPT

LEGEND:

PNTR - POINTER
RTC - REAL TIME COUNTER
CNTR - COUNTER
REG - REGISTER

DOUBLE DOCUMENT FEED DETECTION FOR A DOCUMENT HANDLER IN A REPRODUCTION MACHINE

BACKGROUND OF THE INVENTION

This invention relates to reproduction machines. More particularly, it involves a control system for a document handler in a reproduction machine.

Present day reproduction machines often include document handlers for automatically placing original documents on an exposure platen so that copies can be produced from them. It is usually desirable to make collated books from a plurality of documents, referred to as a document set. Depending upon the particular machine and number of books desired, it may be necessary to recycle the set of originals to the platen several times. Unfortunately, some of the documents may misfeed while being transported between an input tray and the platen. For example, two of the documents may stick together during one set cycle, but may be properly fed during the remaining cycles. This results in a nonuniform number of pages for each book.

OBJECTS AND SUMMARY OF THE INVENTION

Therefore, it is the primary object to provide an improved reproduction machine with a control system for insuring that the total number of documents for each set cycle through the document handler is the same thereby maintaining a uniform number of pages for books made therefrom.

This and other objects of this invention are accomplished by providing a document handler for transporting documents from an input tray to an exposure platen at which copies therefrom are produced. The document handler is capable of recycling a set of originals to the platen to produce books from the set. To insure that the number of pages in each book is uniform, this invention provides a counter for counting and storing the number of documents placed on the platen for each set cycle. A comparison is made for each successive set cycle to determine if the totals are the same. If not, the machine indicates that there has been a fault in feeding the documents.

BRIEF DESCRIPTION OF THE DRAWINGS

Other objects and advantages will be apparent from the ensuing description and drawings in which:

FIG. 21 is a logic schematic of the CPU memory ready;

FIG. 24 is a logic schematic of the nonvolatile memory power supply;

DETAILED DESCRIPTION OF THE PREFERRED EMBODIMENT OF THE INVENTION

Figure 1:
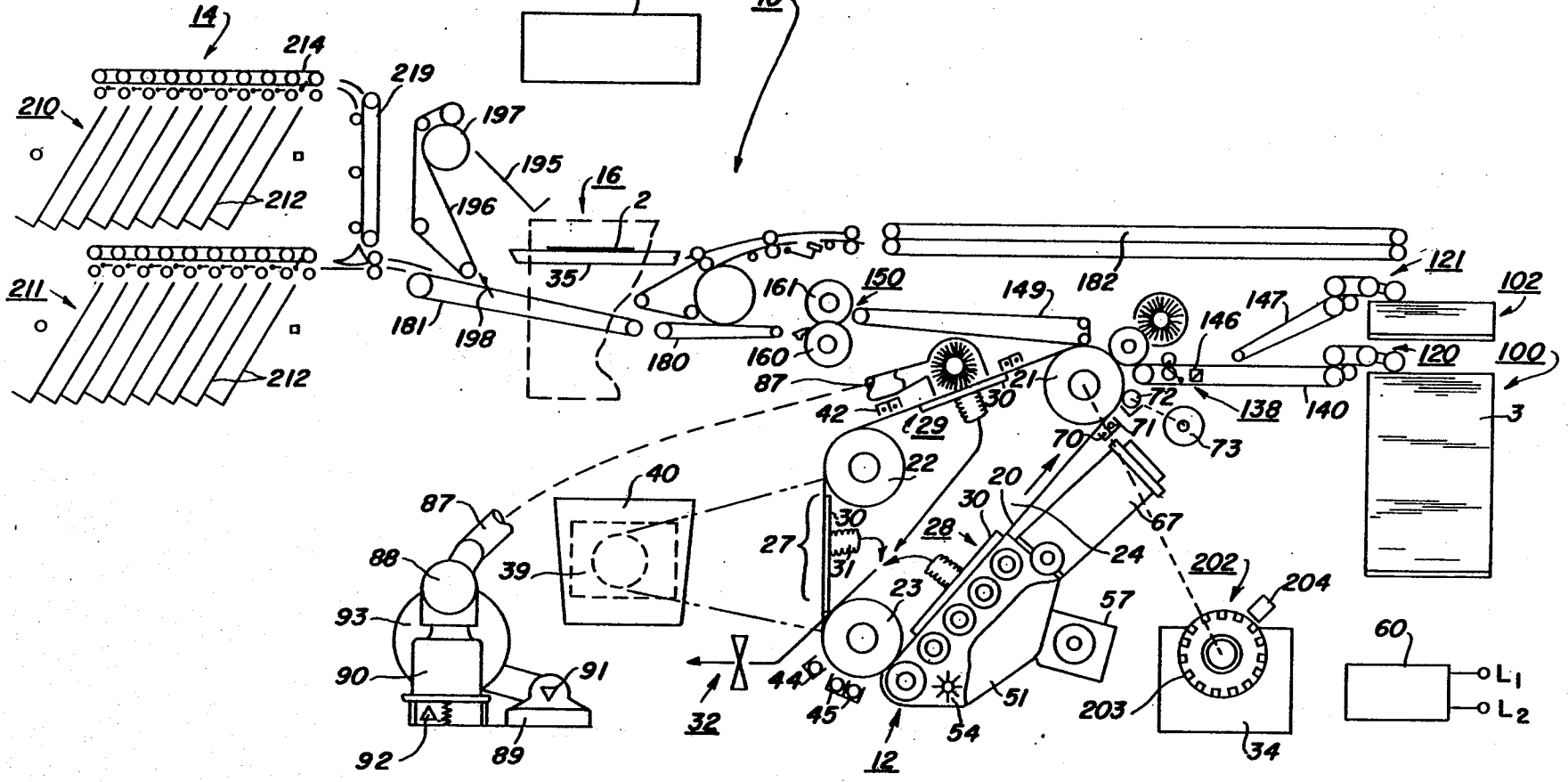
FIG. 1 is a schematic representation of an exemplary reproduction apparatus incorporating the control system of the present invention.
Figure 2:
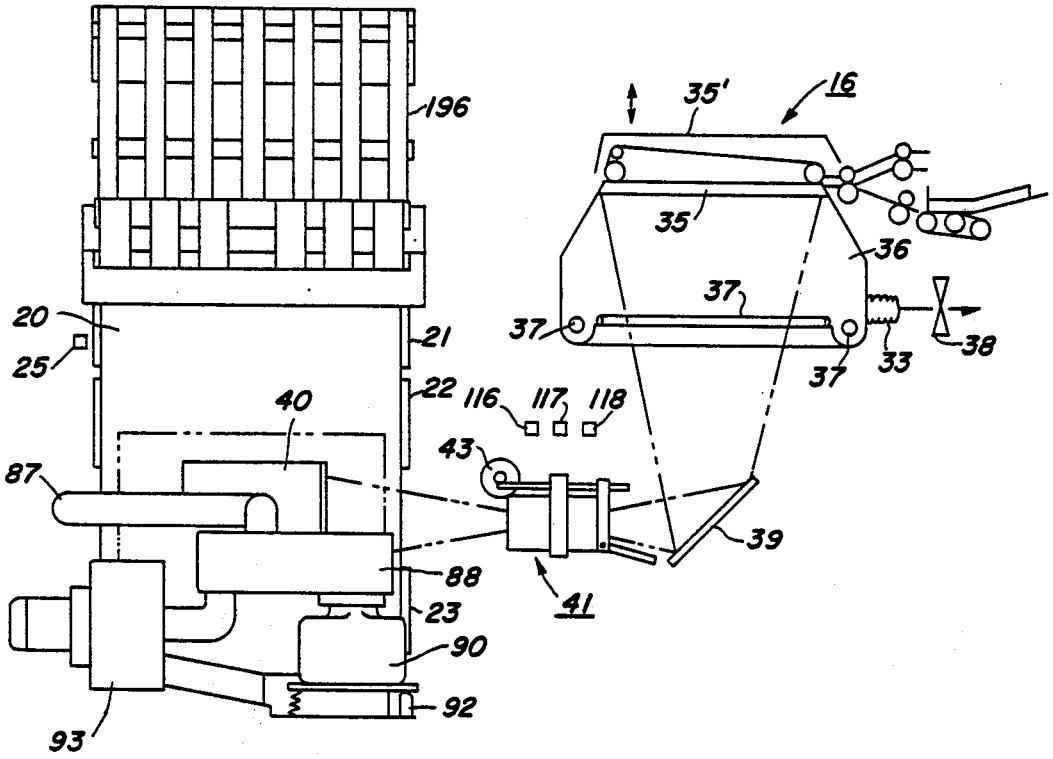
FIG. 2 is a vertical sectional view of the apparatus shown in FIG. 1 along the image plane.
Figure 3:
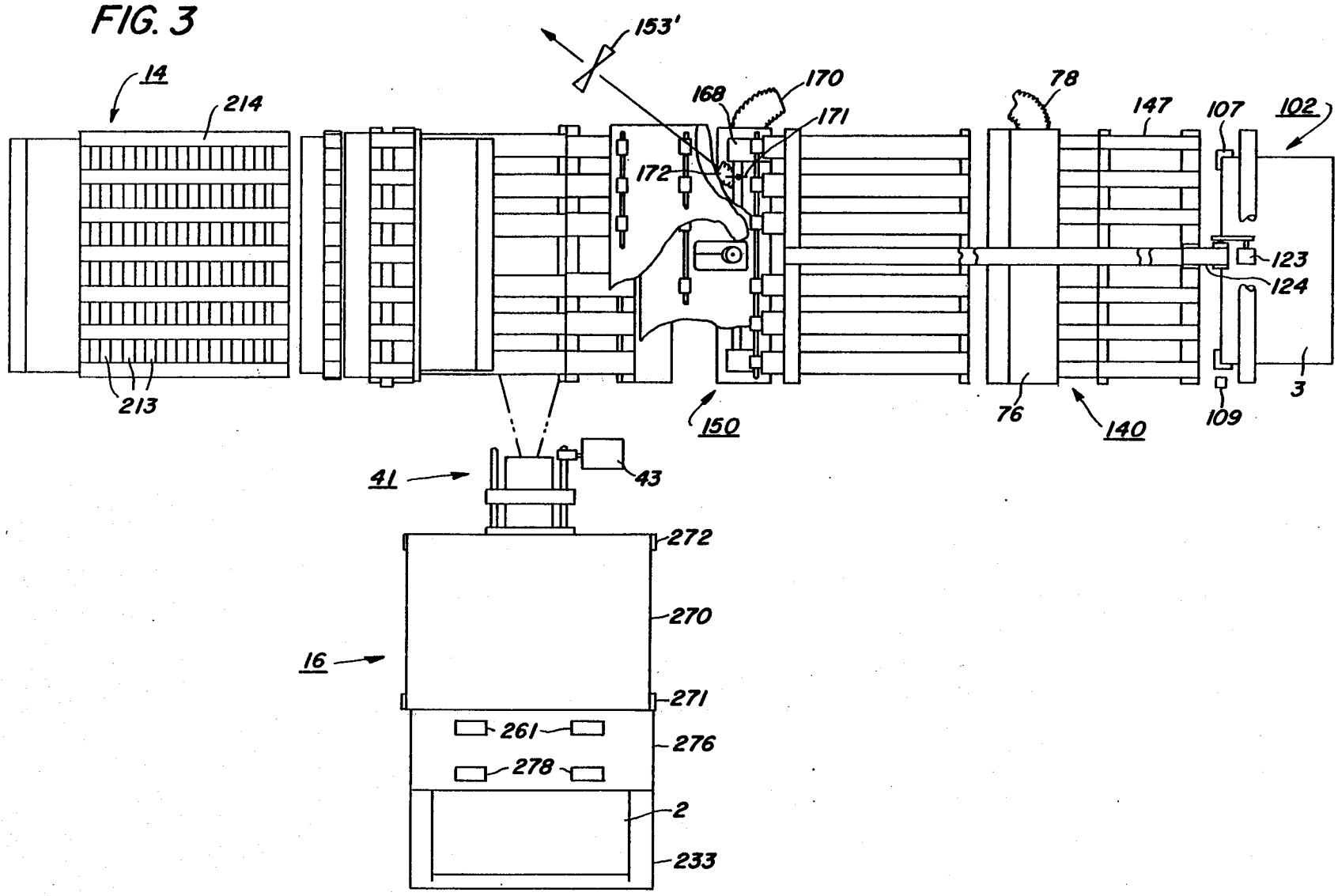
FIG. 3 is a top plane view of the apparatus shown in FIG. 1.

Referring particularly to FIGS. 1–3 of the drawings, there is shown, in schematic outline, an electrostatic reproduction system or host machine, identified by numeral 10, incorporating the control arrangement of the present invention. To facilitate description, the reproduction system 10 is divided into a main electrostatic xerographic processor 12, sorter 14, document handler 16, and controller 18. Other processor, sorter and/or document handler types and constructions, and different combinations thereof may instead by envisioned. For example, document handler 16 may be of the recirculating type which provides precollated copies.

PROCESSOR

Processor 12 utilizes a photoreceptor in the form of an endless photoconductive belt 20 supported in generally triangular configuration by rolls 21, 22, 23. Belt supporting rolls 21, 22, 23 are in turn rotatably journaled on subframe 24.

In the exemplary processor illustrated, belt 20 comprises a photoconductive layer of selenium, which is the light receiving surface and imaging medium, on a conductive substrate. Other photoreceptor types and forms, such as comprising organic materials or of multilayers or a drum may instead be envisioned. Still other forms may comprise scroll type arrangements wherein webs of photoconductive material may be played in and out of the interior of supporting cylinders.

Figure 4:
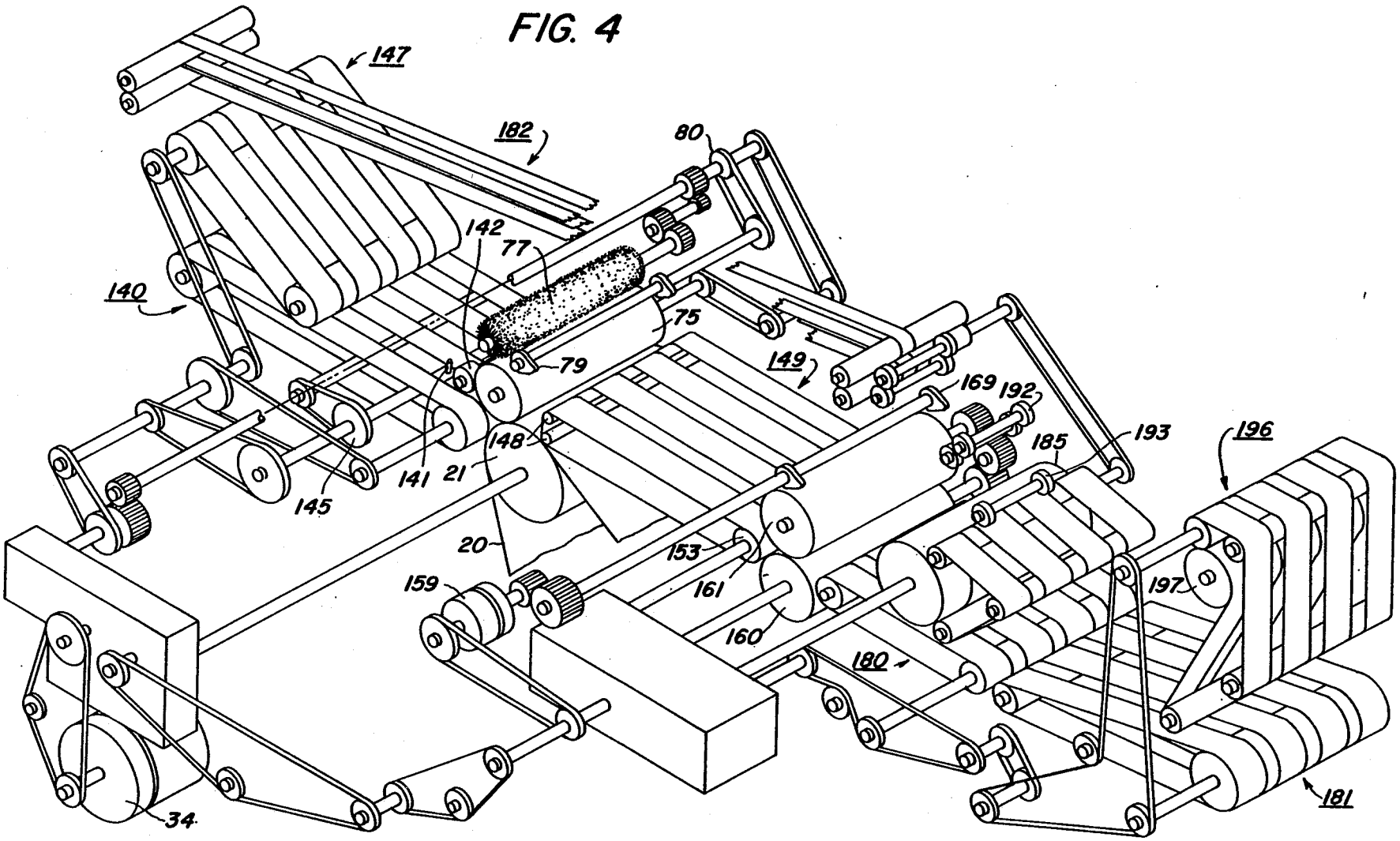
FIG. 4 is an isometric view showing the drive train for the apparatus shown in FIG. 1.

Suitable biasing means (not shown) are provided on subframe 24 to tension the photoreceptor belt 20 and insure movement of belt 20 along a prescribed operating path. Belt tracking switch 25 (shown in FIG. 2) monitors movement of belt 20 from side to side. Belt 20 is supported so as to provide a trio of substantially flat belt runs opposite exposure, developing, and cleaning stations 27, 28, 29 respectfully. To enhance belt flatness at these stations, vacuum platens 30 are provided under belt 20 at each belt run. Conduits 31 communicate vacuum platens 30 with a vacuum pump 32. Photoconductive belt 20 moves in the direction indicated by the solid line arrow, drive thereto being effected through roll 21, which in turn is driven by main drive motor 34, as seen in FIG. 4.

Processor 12 includes a generally rectangular, horizontal transparent platen 35 on which each original 2 to be copied is disposed. A two or four sided illumination assembly, consisting of internal reflectors 36 and flash lamps 37 (shown in FIG. 2) disposed below and along at least two sides of platen 35, is provided for illuminating the original 2 on platen 35. To control temperatures within the illumination space, the assembly is coupled through conduit 33 with a vacuum pump 38 which is adapted to withdraw overly heated air from the space. To retain the original 2 in place on platen 35 and prevent escape of extraneous light from the illumination assembly, a platen cover 35' may be provided.

The light image generated by the illumination system is projected via mirrors 39, 40 and a variable magnification lens assembly 41 onto the photoreceptive belt 20 at the exposure station 27. Reversible motor 43 is provided to move the main lens and add on lens elements that comprise the lens assembly 41 to different predetermined positions and combinations to provide the preselected image sizes corresponding to push button selectors 818, 819, 820 on operator module 800. (See FIG. 32) Sensors 116, 117, 118 signal the present disposition of lens assembly 41. Exposure of the previously charged belt 20 selectively discharges the photoconductive belt to produce on belt 20 an electrostatic latent image of the original 2. To prepare belt 20 for imaging, belt 20 is uniformly charged to a preselected level by charge corotron 42 upstream of the exposure station 27.

Figure 5:
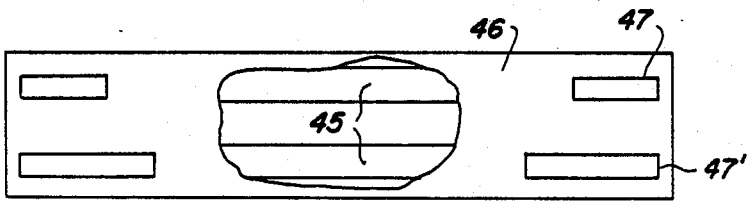
FIG. 5 is an enlarged view showing details of the photoreceptor edge fade-out mechanism for the apparatus shown in FIG. 1.

To prevent development of charged but unwanted image areas, erase lamps 44, 45 are provided. Lamp 44, which is referred to herein as the pitch fadeout lamp, is supported in transverse relationship to belt 20, lamp 44 extending across substantially the entire width of belt 20 to erase (i.e. discharge) areas of belt 20 before the first image, between successive images, and after the last image. Lamps 45, which are referred to herein as edge fadeout lamps, serve to erase areas bordering each side of the images. Referring particularly to FIG. 5, edge fadeout lamps 45, which extend transversely to belt 20, are disposed within a housing 46 having a pair of transversely extending openings 47, 47' of differing length adjacent each edge of belt 20. By selectively actuating one or the other of the lamps 45, the width of the area bordering the sides of the image that is erased can be controlled.

Figure 6:
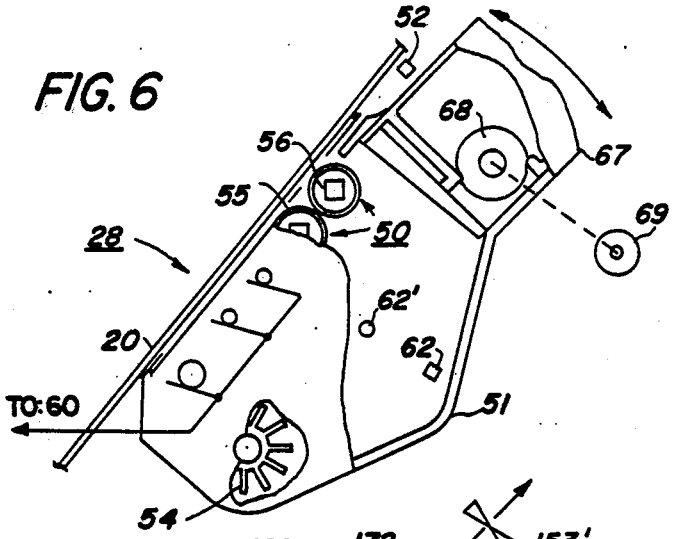
FIG. 6 is an enlarged view showing details of the developing mechanism for the apparatus shown in FIG. 1.
Figure 7:
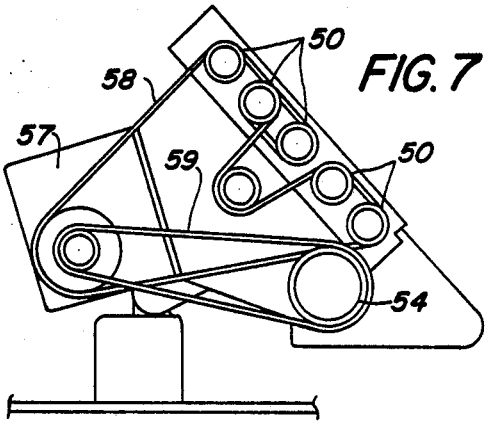
FIG. 7 is an enlarged view showing details of the developing mechanism drive.

Referring to FIGS. 1, 6 and 7, magnetic brush rolls 50 are provided in a developer housing 51 at developing station 28. Housing 51 is pivotally supported adjacent the lower end thereof with interlock switch 52 to sense disposition of housing 51 in operative position adjacent belt 20. The bottom of housing 51 forms a sump within which a supply of developing material is contained. A rotatable auger 54 in the sump area serves to mix the developing material and bring the material into operative relationship with the lowermost of the magnetic brush rolls 50.

As will be understood by those skilled in the art, the electrostatically attractable developing material commonly used in magnetic brush developing apparatus of the type shown comprises a pigmented resinous powder, referred to as toner, and larger granular beads referred to as carrier. To provide the necessary magnetic properties, the carrier is comprised of a magnetizable material such as steel. By virtue of the magnetic fields established by developing rolls 50 and the interrelationship therebetween, a blanket of developing material is formed along the surfaces of developing rolls 50 adjacent the belt 20 and extending from one roll to another. Toner is attracted to the electrostatic latent image from the carrier bristles to produce a visible powder image on the surface of belt 20.

Magnetic brush rolls 50 each comprise a rotatable exterior sleeve 55 with relatively stationary magnet 56 inside. Sleeves 55 are rotated in unison and at substantially the same speed as belt 20 by a developer drive motor 57 through a belt and pulley arrangement 58. A second belt and pulley arrangement 59 drives auger 54.

To regulate development of the latent electrostatic images on belt 20, magnetic brush sleeves 55 are electrically biased. A suitable power supply 60 is provided for this purpose with the amount of bias being regulated by controller 18.

Figure 8:
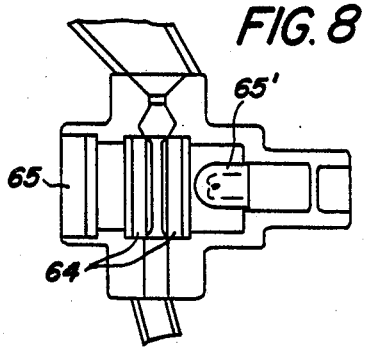
FIG. 8 is an enlarged view showing details of the developability control for the apparatus shown in FIG. 1.
Figure 11:
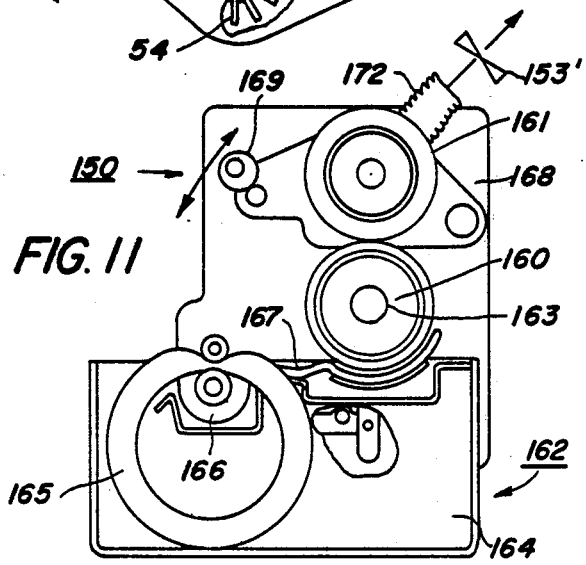
FIG. 11 is an enlarged view showing details of the fuser for the apparatus shown in FIG. 1.

Developing material is returned to the upper portion of developer housing 51 for reuse. A photocell 62 monitors the level of developing material in housing 51 with lamp 62' thereof spaced opposite to the photocell 62. The disclosed machine is also provided with automatic developability control which maintains an optimum proportion of toner-to-carrier material by sensing toner concentration and replenishing toner, as needed. As shown in FIG. 8, the automatic developability control comprises a pair of transparent plates 64 mounted in spaced, parrallel arrangement in developer housing 51 such that a portion of the returning developing material passes therebetween. A suitable circuit, not shown, alternately places a charge on the plates 64 to attract toner thereto. Photocell 65 on one side of the plate pair senses the developer material as the material passes therebetween. Lamp 65' on the opposite side of plate pair 64 provides reference illumination. In this arrangement, the returning developing material is alternately attracted and repelled to and from plates 64. The accumulation of toner, i.e. density determines the amount of light transmitted from lamp 65' to photocell 65. Photocell 65 monitors the density of the returning developing material with the signal output therefrom being used by controller 18 to control the amount of fresh or make-up toner to be added to developer housing 51 from toner supply container 67.

To discharge toner from container 67, rotatable dispensing roll 68 is provided in the inlet to developer housing 51. Motor 69 drives roll 68. When fresh toner is required, as determined by the signal from photocell 65, controller 18 actuates motor 69 to turn roll 68 for a timed interval. The rotating roll 68, which is comprised of a relatively porous sponge-like material, carries toner particles thereon into developer housing 51 where it is discharged. Pre-transfer corotron 70 and lamp 71 are provided downstream of magnetic brush rolls 50 to regulate developed image charges before transfer.

A magnetic pick-off roll 72 is rotatably supported opposite belt 20 downstream of pre-transfer lamp 71, roll 72 serving to scavenge leftover carrier from belt 20 preparatory to transfer of the developed image to the copy sheet 3. Motor 73 turns roll 72 in the same direction and at substantially the same speed as belt 20 to prevent scoring or scratching of belt 20. One type of magnetic pick-off roll is shown in U.S. Pat. No. 3,834,804, issued Oct. 10, 1974 to Bhagat et al.

Figure 9:
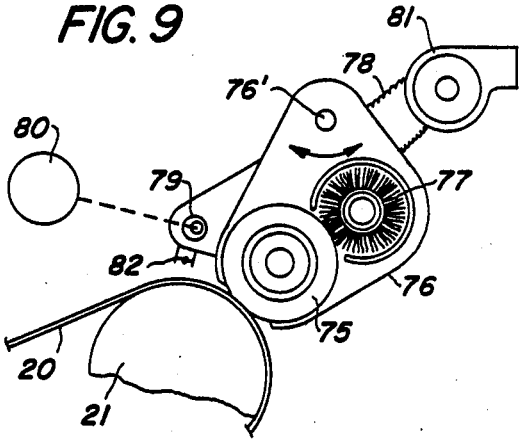
FIG. 9 is an enlarged view showing details of the transfer roll support mechanism for the apparatus shown in FIG. 1.
Figure 12:
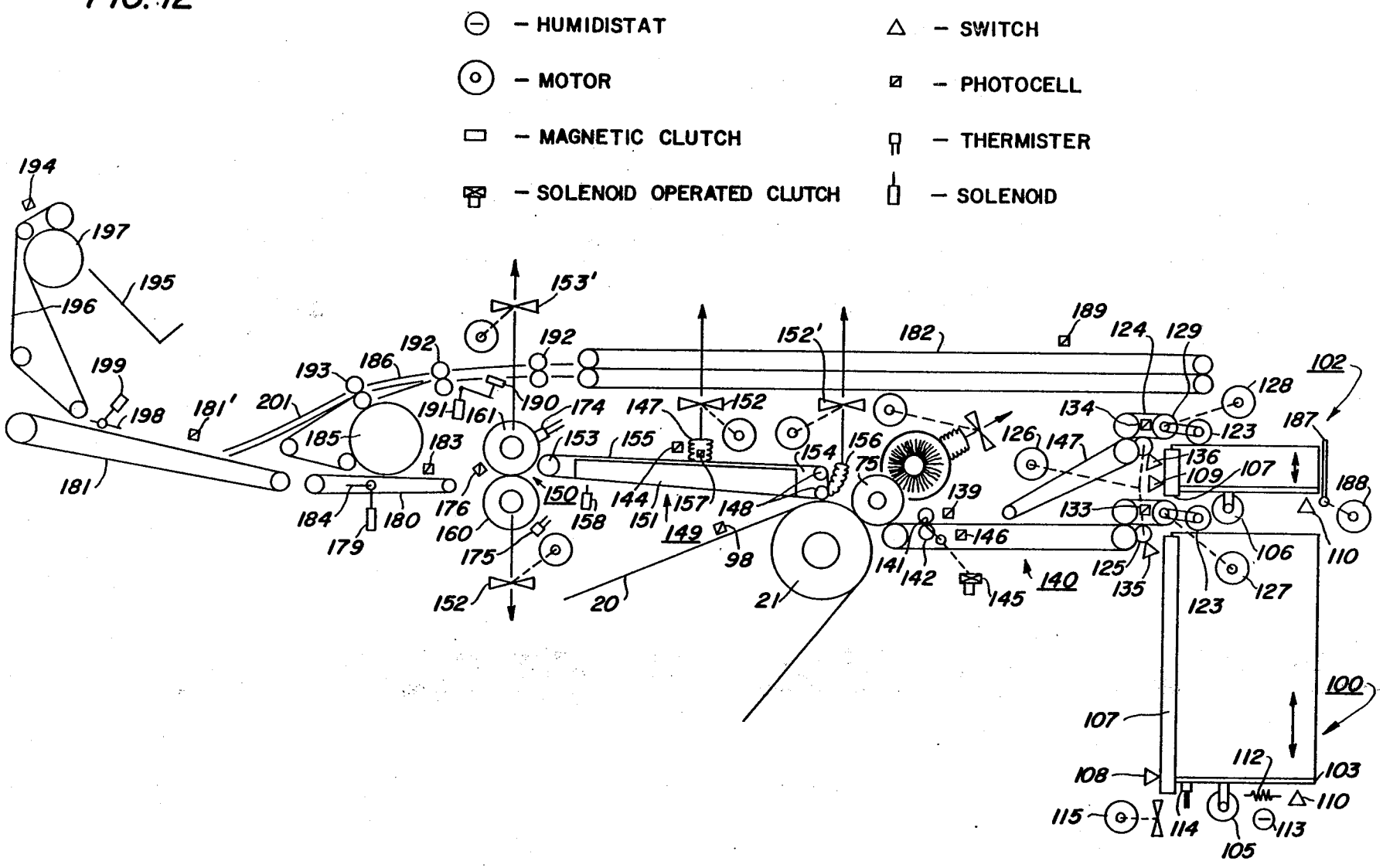
FIG. 12 is a schematic view showing the paper path and sensors of the apparatus shown in FIG. 1.

Referring to FIGS. 4, 9 and 12, to transfer developed images from belt 20 to the copy sheets 3, a transfer roll 75 is provided. Transfer roll 75, which forms part of the copy sheet feed path, is rotatably supported within a transfer roll housing 76 opposite belt support roll 21. Housing 76 is pivotally mounted at 76' to permit the transfer roll assembly to be moved into and out of operative relationship with belt 20. A transfer roll cleaning brush 77 is rotatably journalled in transfer roll housing 76 with the brush periphery in contact with transfer roll 75. Transfer roll 75 is driven through contact with belt 20 while cleaning brush 77 is coupled to main drive motor 34. To remove toner, housing 76 is connected through conduit 78 with vacuum pump 81. To facilitate and control transfer of the developed images from belt 20 to the copy sheets 3, a suitable electrical bias is applied to transfer roll 75.

To permit transfer roll 75 to be moved into and out of operative relationship with belt 20, cam 79 is provided in driving contact with transfer roll housing 76. Cam 79 is driven from motor 34 through an electromagnetically operated one revolution clutch 80. Spring means (not shown) serves to maintain housing 76 in driving engagement with cam 79.

To facilitate separation of the copy sheets 3 from belt 20 following transfer of developed images, a detack corotron 82 is provided. Corotron 82 generates a charge designed to neutralize or reduce the charges tending to retain the copy sheet on belt 20. Corotron 82 is supported on transfer roll housing 76 opposite belt 20 and downstream of transfer roll 75.

Figure 10:
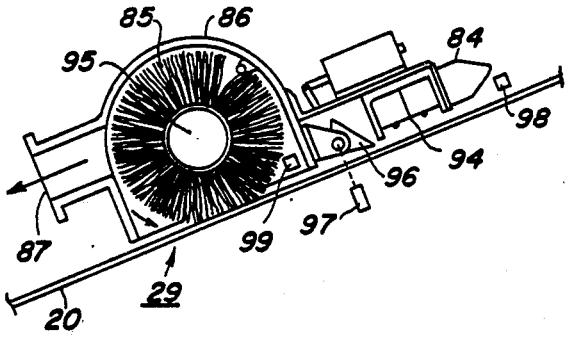
FIG. 10 is an enlarged view showing details of the photoreceptor cleaning mechanism for the apparatus shown in FIG. 1.

Referring to FIGS. 1, 2 and 10, to prepare belt 20 for cleaning, residual charges on belt 20 are removed by discharge lamp 84 and preclean corotron 94. A cleaning brush 85, rotatably supported within an evacuated semicircular shaped brush housing 86 at cleaning station 29, serves to remove residual developer from belt 20. Motor 95 drives brush 85, brush 85 turning in a direction opposite that of belt 20.

Vacuum conduit 87 couples brush housing 86 through a centrifugal type separator 88 with the suction side of vacuum pump 93. A final filter 89 on the outlet of pump 93 traps particles that pass through separator 88. The heavier toner particles separated by separator 88 drop into and are collected in one or more collecting bottles 90. Pressure sensor 91 monitors the condition of final filter 89 while a sensor 92 monitors the level of toner particles in collecting bottles 90.

To obviate the danger of copy sheets remaining on belt 20 and becoming entangled with the belt cleaning mechanism, a deflector 96 is provided upstream of cleaning brush 85. Deflector 96, which is pivotally supported on the brush housing 86, is operated by solenoid 97. In the normal or off position, deflector 96 is spaced from belt 20 (the solid line position shown in the drawings). Energization of solenoid 97 pivots deflector 96 downwardly to bring the deflector leading edge into close proximity to belt 20.

Sensors 98, 99 are provided on each side of deflector 96 for sensing the presence of copy material on belt 20. A signal output from upstream sensor 98 triggers solenoid 97 to pivot deflector 96 into position to intercept the copy sheet on belt 20. The signal from sensor 98 also initiates a system shutdown cycle (mis-strip jam) wherein the various operating components are, within a prescribed interval, brought to a stop. The interval permits any copy sheet present in fuser 150 to be removed, sheet trap solenoid 158 (FIG. 12) having been actuated to prevent the next copy sheet from entering fuser 150 and becoming trapped therein. The signal from sensor 99, indicating failure of deflector 96 to intercept or remove the copy sheet from belt 20, triggers an immediate or hard stop (sheet on selenium jam) of the processor. In such instances the power to drive motor 34 is interrupted to bring belt 20 and the other components driven therefrom to an immediate stop.

Referring particularly to FIGS. 1 and 12, copy sheets 3 comprise precut paper sheets supplied from either main or auxiliary paper trays 100, 102. Each paper tray has a platform or base 103 for supporting in stack-like fashion a quantity of sheets. The tray platforms 103 are supported for vertical up and down movement by motors 105, 106. Side guide pairs 107, in each tray 100, 102 delimit the tray side boundaries, the guide pairs being adjustable toward and away from one another in accommodation of different size sheets. Sensors 108, 109 respond to the position of each side guide pair 107, the output of sensors 108, 109 serving to regulate operation of edge fadeout lamps 45 and fuser cooling valve 171 (FIG. 3). Lower limit switches 110 on each tray prevent overtravel of the tray platform in a downward direction.

A heater 112 is provided below the platform 103 of main tray 100 to warm the tray area and enhance feeding of sheets therefrom. Humidstat 113 and thermostat 114 control operation of heater 112 in response to the temperature/humidity conditions of main tray 100. Fan 115 is provided to circulate air within tray 100.

To advance the sheets 3 from either main or auxiliary tray 100, 102, main and auxiliary sheet feeders 120, 121 are provided. Feeders 120, 121 each include a nudger roll 123 to engage and advance the topmost sheet in the paper tray forward into the nip formed by a feed belt 124 and retard roll 125. Retard rolls 125, which are driven at an extremely low speed by motor 126, cooperate with feed belts 124 to restrict feeding of sheets from trays 100,102 to one sheet at a time.

Feed belts 124 are driven by main and auxiliary sheet feed motors 127, 128 respectively. Nudger rolls 123 are supported for pivotal movement about the axis of feed belt drive shaft 129 with drive to the nudger rolls taken from drive shaft 129. Stack height sensors 133, 134 are provided for the main and auxiliary trays, the pivoting nudger rolls 123 serving to operate sensors 133, 134 in response to the sheet stack height. Main and auxiliary tray misfeed sensors 135, 136 are provided at the tray outlets.

Main transport 140 extends from main paper tray 100 to a point slightly upstream of the nip formed by photoconductive belt 20 and transfer roll 75. Transport 140 is driven from main motor 34. To register sheets 3 with the images developed on belt 20, sheet register fingers 141 are provided, fingers 141 being arranged to move into and out of the path of the sheets on transport 140 once each revolution (see also FIG. 4). Registration fingers 141 are driven from main motor 34 through electromagnetic clutch 145 (see in FIG. 4). A timing or reset switch 146 is set once on each revolution of sheet register fingers 141. Sensor 139 monitors transport 140 for jams. Further amplification of sheet register system may be found in U.S. Pat. No. 3,781,004, issued Dec. 25, 1973 to Buddendeck et al.

Pinch roll pair 142 is interspaced between transport belts that comprise main transport 140 on the downstream side of register fingers 141. Pinch roll pair 142 are driven from main motor 34.

Auxiliary transport 147 extends from auxiliary tray 102 to main transport 140 at a point upstream of sheet register fingers 141. Transport 147 is driven from motor 34.

To maintain the sheets in driving contact with the belts of transports 140, 147, suitable guides or retainers (not shown) may be provided along the belt runs.

The image bearing sheets leaving the nip formed by photoconductive belt 20 and transfer roll 75 are picked off by belts 155 of the leading edge of vacuum transport 149. Belts 155, which are perforated for the admission of vacuum therethrough, ride on forward roller pair 148 and rear roll 153. A pair of internal vacuum plenums 151, 154 are provided, the leading plenum 154 cooperating with belts 155 to pick up the sheets leaving the belt/transfer roll nip. Transport 149 conveys the image bearing sheets to fuser 150. Vacuum conduits 147, 156 communicate plenums 151, 154 with vacuum pumps 152, 152'. A pressure sensor 157 monitors operation of vacuum pump 152. Sensor 144 monitors transport 149 for jams.

To prevent the sheet on transport 149 from being carried into fuser 150 in the event of a jam or malfunction, a trap solenoid 158 is provided below transport 149. Energization of solenoid 158 raises the armature thereof into contact with the lower face of plenum 154 to intercept and stop the sheet moving therepast.

Referring particularly to FIGS. 3, 4, 11 and 12, fuser 150 comprises a lower heated fusing roll 160 and upper pressure roll 161. Rolls 160, 161 are supported for rotation in fuser housing 162. The core of fusing roll 160 is hollow for receipt of heating rod 163 therewithin.

Housing 162 includes a sump 164 for holding a quantity of liquid release agent, herein termed oil. Dispensing belt 165, moves through sump 164 to pick up the oil, belt 165 being driven by motor 166. A blanket-like wick 167 carries the oil from belt 165 to the surface of fusing roll 160.

Pressure roll 161 is supported within an upper pivotal section 168 of housing 162. This enables pressure roll 161 to be moved into and out of operative contact fusing roll 160. Cam shaft 169 in fuser housing 162 serves to move housing section 168 and pressure roll 161 into operative relationship with fusing roll 160 against a suitable bias (not shown). Cam shaft 169 is coupled to main motor 34 through an electromagnetically operated one revolution clutch 159.

Fuser housing section 168 is evacuated. For this purpose, a conduit 170 couple housing section 168 with vacuum pump 153. The ends of housing section 168 are separated into vacuum compartments opposite the ends of pressure roll 161 thereunder to cool the roll ends where smaller size copy sheets 3 are being processed. Vacuum valve 171 (FIG. 3) in conduit 172 regulates communication of the vacuum compartments with vacuum pump 153' in response to the size sheets as sensed by side guide sensors 108, 109 in paper trays 100, 102.

Fuser roll 160 is driven from main motor 34. Pressure roll 161 is drivingly coupled to fuser roll 160 for rotation therewith.

Thermostat 174 (FIG. 12) in fuser housing 162 controls operation of heating rod 163 in response to temperature. Sensor 175 protects against fuser over-temperature. To protect against trapping of a sheet in fuser 150 in the event of a jam, sensor 176 is provided.

Following fuser 150, the sheet is carried by post fuser transport 180 to either discharge transport 181 or, where duplex or two sided copies are desired, to return transport 182. Sheet sensor 183 monitors passage of the sheets from fuser 150. Transports 180, 181 are driven from main motor 34. Sensor 181' monitors transport 181 for jams. Suitable retaining means may be provided to retain the sheets on transports 180, 181.

A deflector 184, when extended, directs sheets on transport 180 onto conveyor roll 185 and into chute 186 leading to return transport 182. Solenoid 179, when energized raises deflector 184 into the sheet path. Return transport 182 carries the sheets back to auxiliary tray 102. Sensor 189 monitors transport 182 for jams. Paper stops 187 of tray 102 is supported for oscillating movement. Motor 188 drives stops 187 back and forth tap sheets returned to auxiliary tray 102 into alignment for refeeding.

To invert duplex copy sheets following fusing of the second or duplex image, a displaceable sheet stop 190 is provided adjacent the discharge end of chute 186. Stop 190 is pivotally supported for swinging movement into and out of chute 186. Solenoid 191 is provided to move stop 190 selectively into or out of chute 186. Pinch roll pairs 192, 193 serve to draw the sheet trapped in chute 186 by stop 190 and carry the sheet forward onto discharge transport 181. Further description of the inverter mechanism may be found in U.S. Pat. No. 3,856,295, issued Dec. 24, 1974, to John H. Looney.

Output tray 195 receives unsorted copies. Transport 196 a portion of which is wrapped around a turn around roll 197, serves to carry the finished copies to tray 195. Sensor 194 monitors transport 196 for jams. To route copies into output tray 195, a deflector 198 is provided. Deflector solenoid 199, when energized, turns deflector 198 to intercept sheets on conveyor 181 and route the sheets onto conveyor 196.

When output tray 195 is not used, the sheets are carried by conveyor 181 to sorter 14.

SORTER

Figure 13:
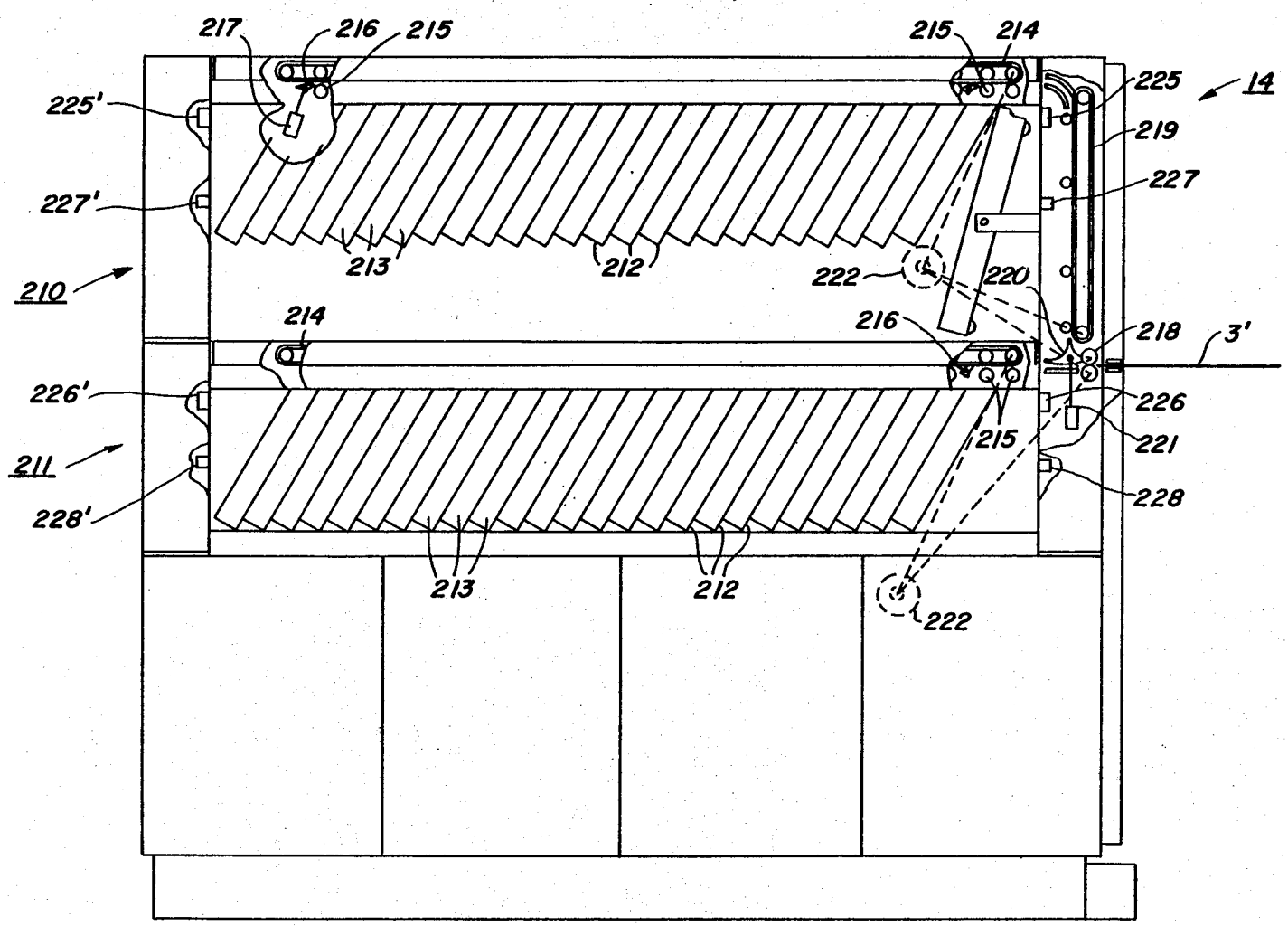
FIG. 13 is an enlarged view showing details of the copy sorter for the apparatus shown in FIG. 1.

Referring particularly to FIG. 13, sorter 14 comprises upper and lower bin arrays 210, 211. Each bin array 210, 211 consists of series of spaced downwardly inclined trays 212, forming a series of individual bins 213 for receipt of finished copies 3'. Conveyors 214 along the top of each bin array, cooperate with idler rolls 215 adjacent the inlet to each bin to transport the copies into juxtaposition with the bins. Individual defelctors 216 at each bin cooperate, when depressed, with the adjoining idler roll 215 to turn the copies into the bin associated therewith. An operating solenoid 217 is provided for each deflector.

A driven roll pair 218 is provided at the inlet to sorter 14. A generally vertical conveyor 219 serves to bring copies 3' to the upper bin array 210. Entrance deflector 220 routes the copies selectively to either the upper or lower bin array 210, 211 respectively. Solenoid 221 operates deflector 220.

Motor 222 is provided to drive the conveyors 214 and 219 of upper bin array 210 and conveyor 214 of lower bin array 211. Roll pair 218 is drivingly coupled to motor 222.

To detect entry of copies 3' in the individual bins 213, a photoelectric type sensor 225, 226 is provided at one end of each bin array 210, 211 respectively. Sensor lamps 225', 226' are disposed adjacent the other end of the bin array. To detect the presence of copies in the bins 213, a second set of photoelectric type sensors 227, 228 is provided for each bin array, on a level with a tray cutout (not shown). Sensor lamps 227', 228' are disposed opposite sensors 227, 228.

DOCUMENT HANDLER

Figure 14:
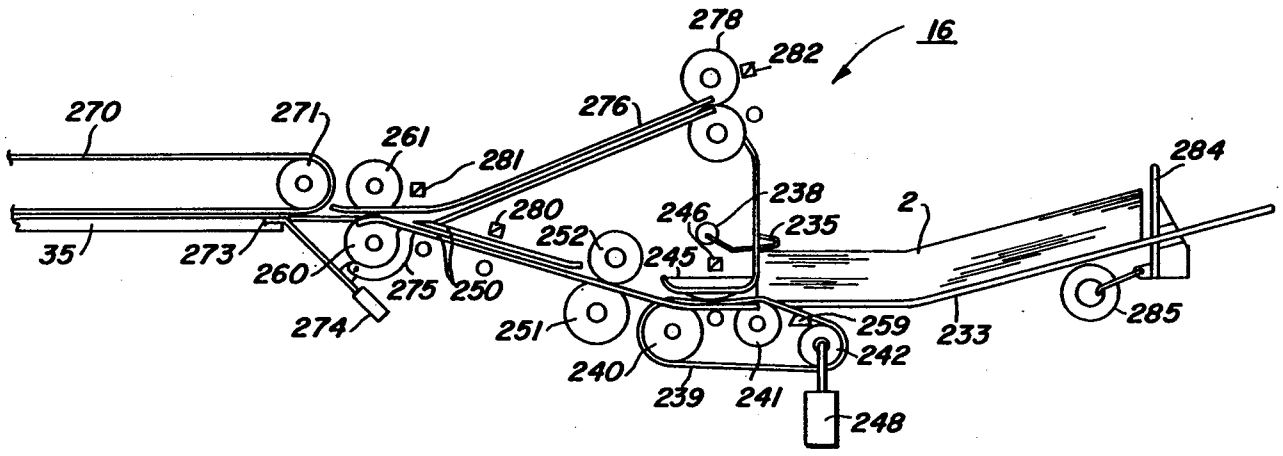
FIG. 14 is a schematic view showing details of the document handler for the apparatus shown in FIG. 1.
Figure 15:
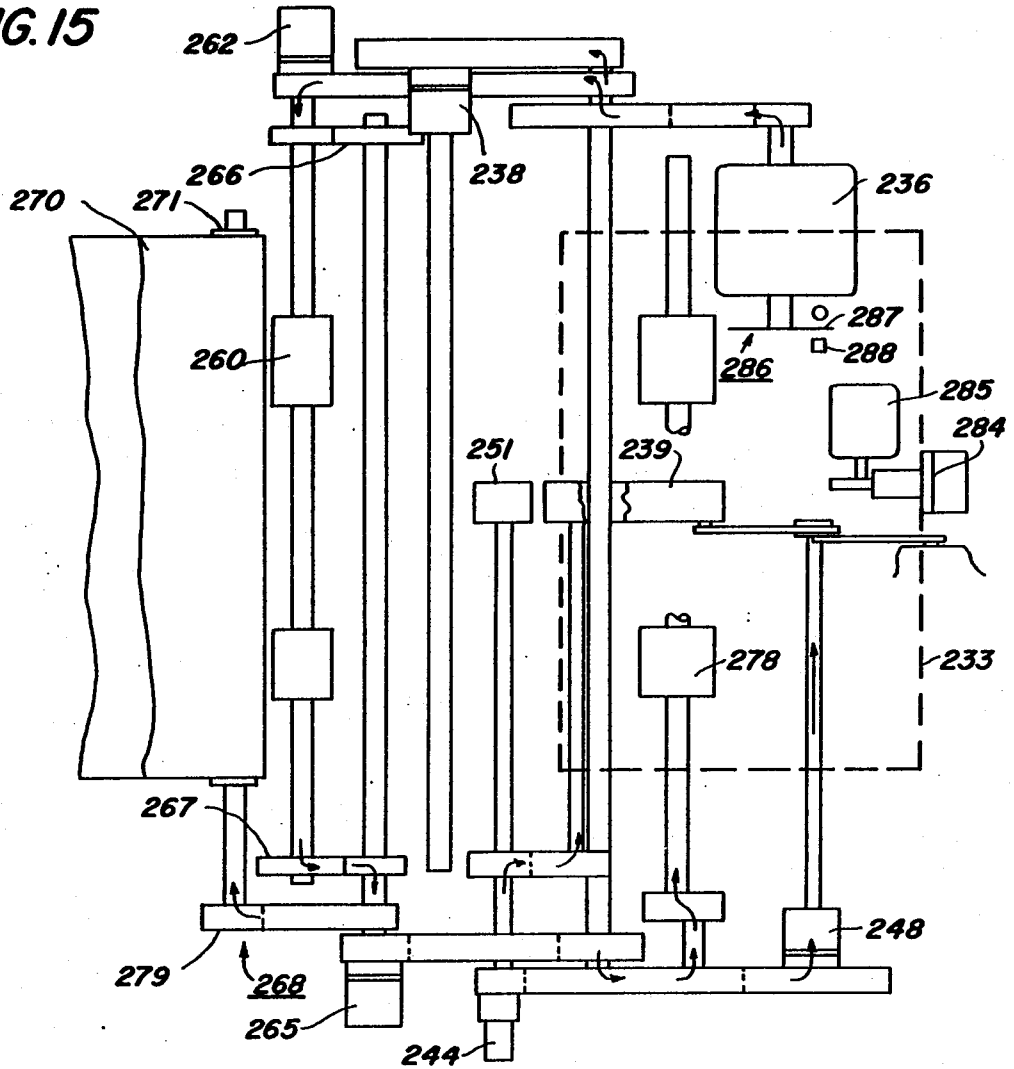
FIG. 15 is a view showing details of the drive mechanism for the document handler shown in FIG. 14.

Referring particularly to FIGS. 14 and 15, document handler 16 includes a tray 233 into which originals or documents 2 to be copied are placed by the operator following which a cover (not shown) is closed. A movable bail or separator 235, driven in an oscillatory path from motor 236 through a solenoid operated one revolution clutch 238, is provided to maintain document set separation.

A document feed belt 239 is supported on drive and idler rolls 240, 241 and kicker roll 242 under tray 233, tray 233 being suitably apertured to permit the belt surface to project therewithin. Feedbelt 239 is driven by motor 236 through electromagnetic clutch 244. Guide 245, disposed near the discharge end of feed belt 239, cooperates with belt 239 to form a nip between which the documents pass.

A photoelectric type sensor 246 is disposed adjacent the discharge end of belt 239. Sensor 246 responds on failure of a document to feed within a predetermined interval to actuate solenoid 248 to raise kicker roll 242 and increases the surface area of feed belt 239 in contact with the documents. Another sensor 259 located underneath tray 233 provides an output signal when the last document 2 of each set has left the tray 233.

Document guides 250 route the document fed from tray 233 via roll pair 251, 252 to platen 35. Roll 251 is drivingly coupled to motor 236 through electromagnetic clutch 244. Contact of roll 251 with roll 252 turns roll 252.

Roll pair 260, 261 at the entrance to platen 35 transport the document onto platen 35, roll 260 being driven through electromagnetic clutch 262 in the forward direction. Contact of roll 260 with roll 261 turns roll 261 in the document feeding direction. Roll 260 is selectively coupled through gearset 268 with motor 236 through electromagnetic clutch 265 so that on engagement of clutch 265 and disengagement of clutch 262, roll 260 and roll 261 therewith turn in the reverse direction to carry the document back to tray 233 via return chute 276. One way clutches 266, 267 permit free wheeling of the roll drive shafts.

The document leaving roll pair 260, 261 is carried by platen feed belt 270 onto platen 35, belt 270 being comprised of a suitable flexible material having an exterior surface of xerographic white. Belt 270 is carried about drive and idler rolls 271, 272. Roll 271 is drivingly coupled to motor 236 for rotation in either a forward or reverse direction through clutches 262, 265. Engagement of clutch 262 operates through belt and pulley drive 279 to drive belt in the forward direction, engagement of clutch 265 operates through drive 279 to drive belt 270 in the reverse direction.

To locate the document in predetermined position on platen 35, a register 273 is provided at the platen inlet for engagement with the document trailing edge. For this purpose, control of platen belt 270 is such that following transporting of the document onto platen 35 and beyond register 273, belt 270 is reversed to carry the document backwards against register 273.

To remove the document from platen 35 following copying, register 273 is retracted to an inoperative position. Solenoid 274 is provided for moving register 273.

A document deflector 275, is provided to route the document leaving platen 35 into return chute 276. For this purpose, platen belt 270 and pinch roll pair 260, 261 are reversed through engagement of clutch 265. Discharge roll pair 278, driven by motor 236, carry the returning document into tray 233.

To monitor movement of the documents in document handler 16 and detect jams and other malfunctions, photoelectric type sensors 246 and 280, 281 and 282 are disposed along the document routes.

To align documents 2 returned to tray 233, a document patter 284 is provided adjacent one end of tray 233. Patter 284 is oscillated by motor 285.

TIMING

To provide the requisite operational synchronization between host machine 10 and controller 18 as will appear, processor or machine clock 202 is provided. Referring particularly to FIG. 1, clock 202 comprises a toothed disc 203 drivingly supported on the output shaft of main drive motor 34. A photoelectric type signal generator 204 is disposed astride the path followed by the toothed rim of disc 203, generator 204 producing, whenever drive motor 34 is energized, a pulse like signal output at a frequency correlated with the speed of motor 34, and the machine components driven therefrom.

As described, a second machine clock, termed a pitch reset clock 138 herein, and comprising timing switch 146 is provided. Switch 146 cooperates with sheet register fingers 141 to generate an output pulse once each revolution of fingers 141. As will appear, the pulse like output of the pitch reset clock is used to reset or resynchronize controller 18 with host machine 10.

Figure 17:
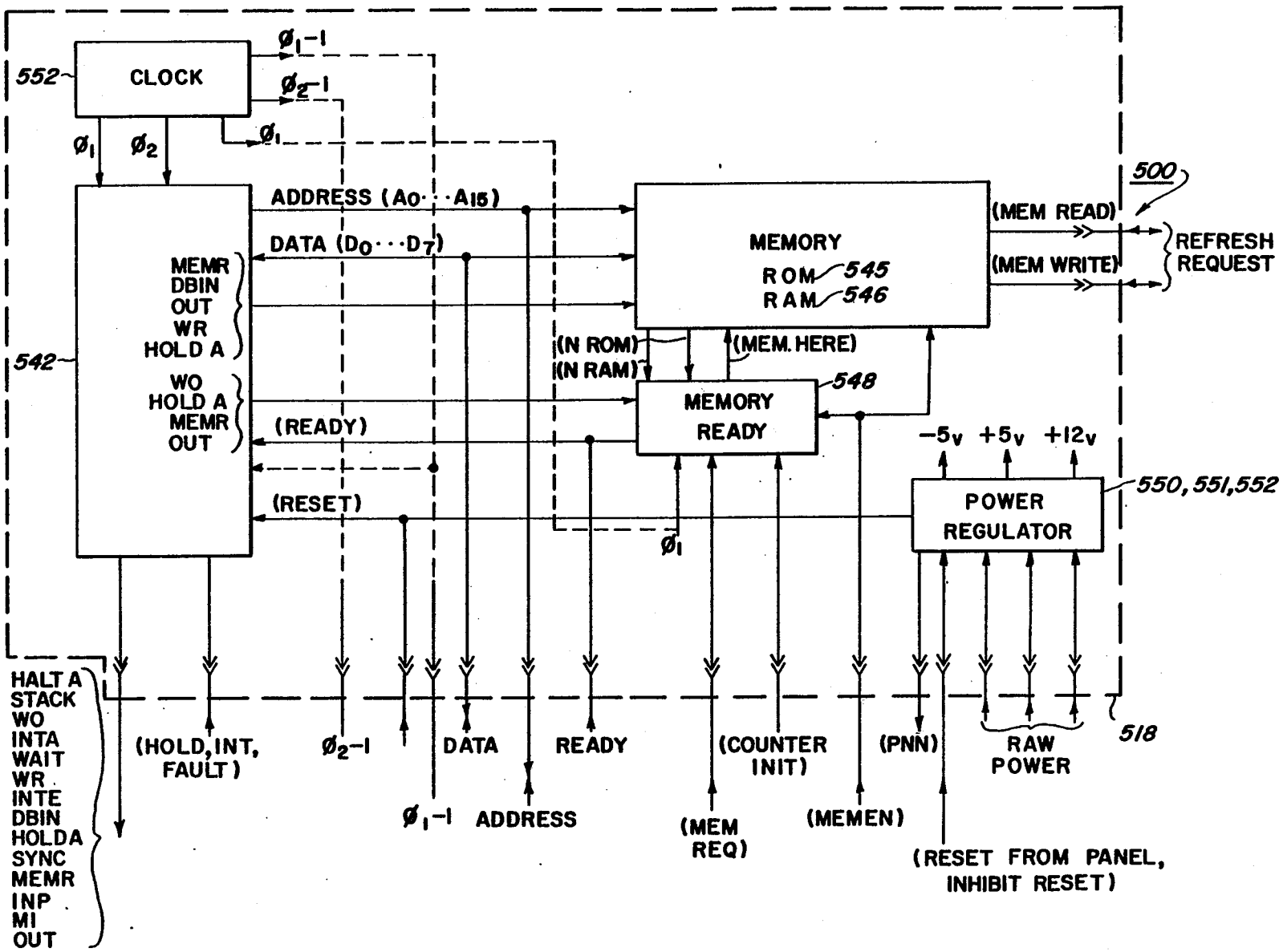
FIG. 17 is a block diagram of the controller CPU.

Referring to FIG. 15, a document handler clock 286 consisting of apertured disc 287 on the output shaft of document handler drive motor 236 and cooperating photoelectric type signal generator 288 is provided. As in the case of machine clock 202, document handler clock 286 produces an output pulse train from which components of the document handler may be synchronized. A real time clock such as clock 552 of FIG. 17, is utilized to control internal operations of the controller 18 as is known in the art.

CONTROLLER

Figure 16:
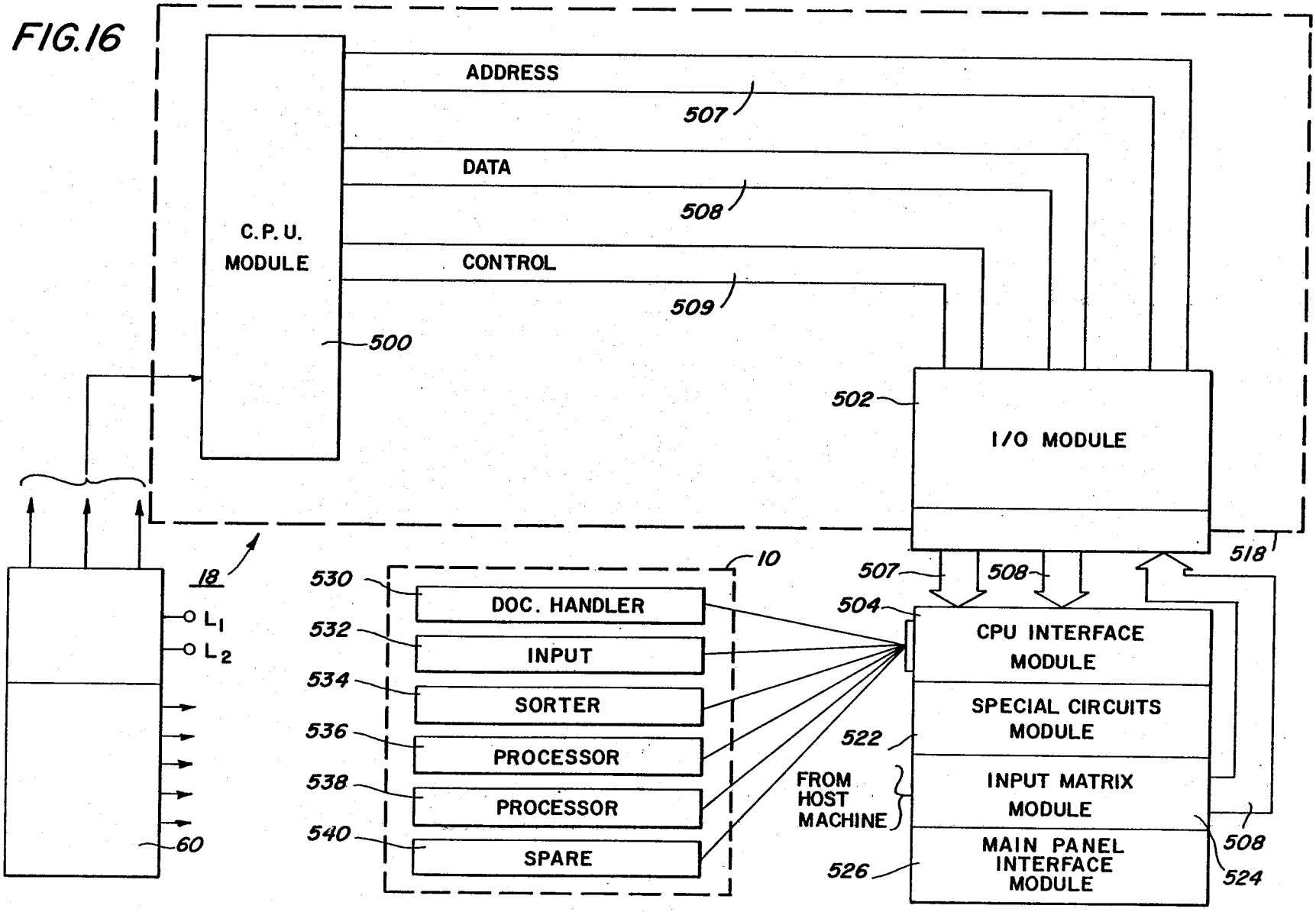
FIG. 16 is a block diagram of the controller for the apparatus shown in FIG. 1.

Referring to FIG. 16, controller 18 includes a Central Processor Unit (CPU) Module 500, Input/Output (I/O) Module 502, and Interface 504. Address, Data and Control Buses 507, 508, 509 respectively operatively couple CPU Module 500 and I/O Module 502. CPU Module 500 I/O Module 502 are disposed within a shield 518 to prevent noise interference.

Interface 504 couples I/O Module 502 with special circuits module 522, input matrix module 524, and main panel interface module 526. Module 504 also couples I/O Module 502 to the operating sections of the machine, namely, document handler section 530, input section 532, sorter section 534 and processor sections 536, 538. A spare section 540, which may be used for monitoring operation of the host machine, or which may be later utilized to control other devices, is provided.

Figure 18A:
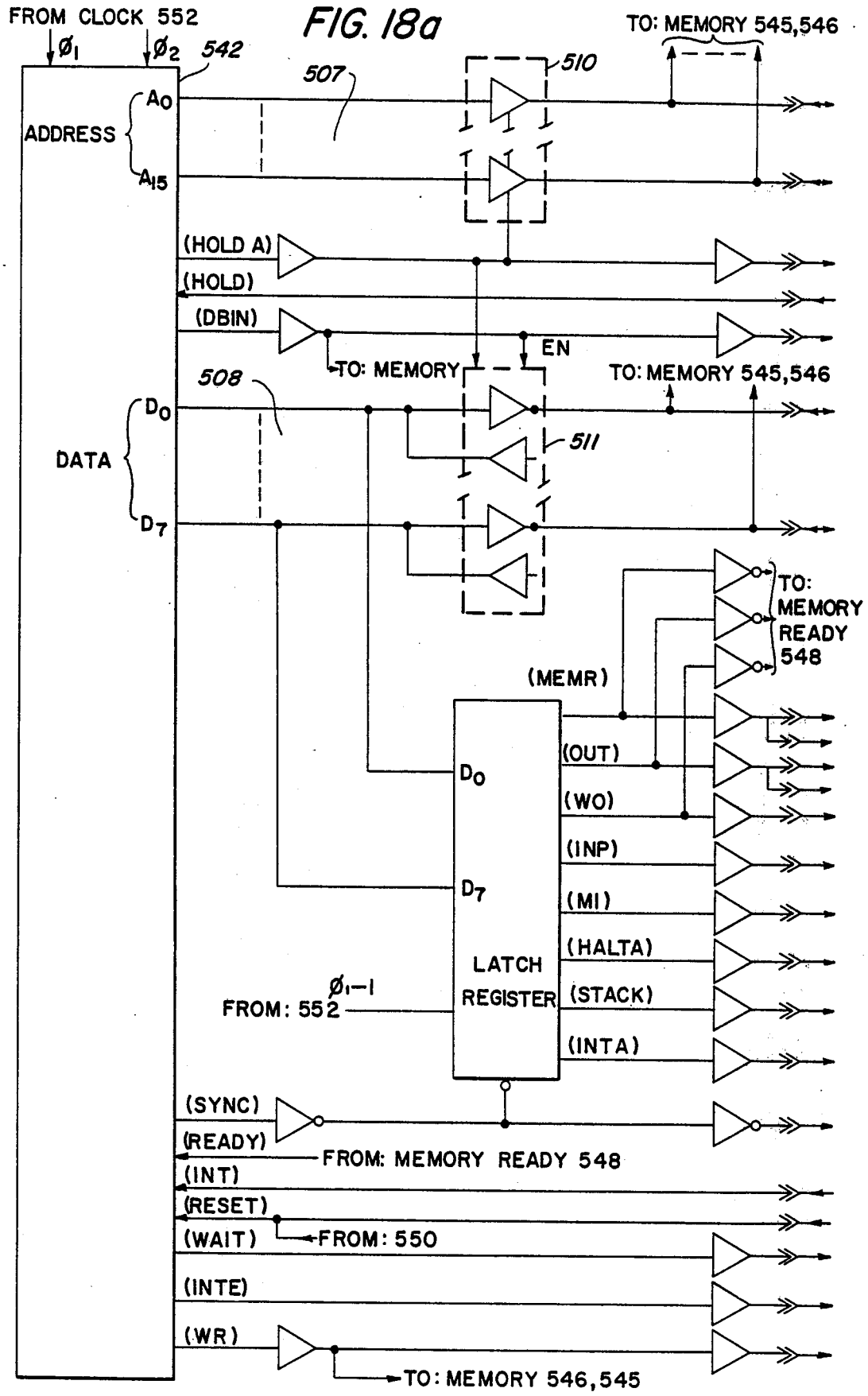
FIG. 18*a* is a block diagram showing the CPU microprocessor input/output connections.

Referring to FIGS. 17, 18(a), CPU module 500 comprises a processor 542 such as an Intel 8080 microprocessor manufactured by Intel Corporation, Santa Clara, California, 16K Read Only Memory (herein ROM) and 2K Random Access Memory (herein RAM) sections 545, 546, Memory Ready section 548, power regulator section 550, and onboard clock 552. Bipolar tri-state buffers 510, 511 in Address and Data buses 507, 508 disable the bus on a Direct Memory access (DMA) signal (HOLDA) as will appear. While the capacity of memory sections 545, 546 are indicated throughout as being 16K and 2K respectively, other memory sizes may be readily contemplated.

Figure 19A:
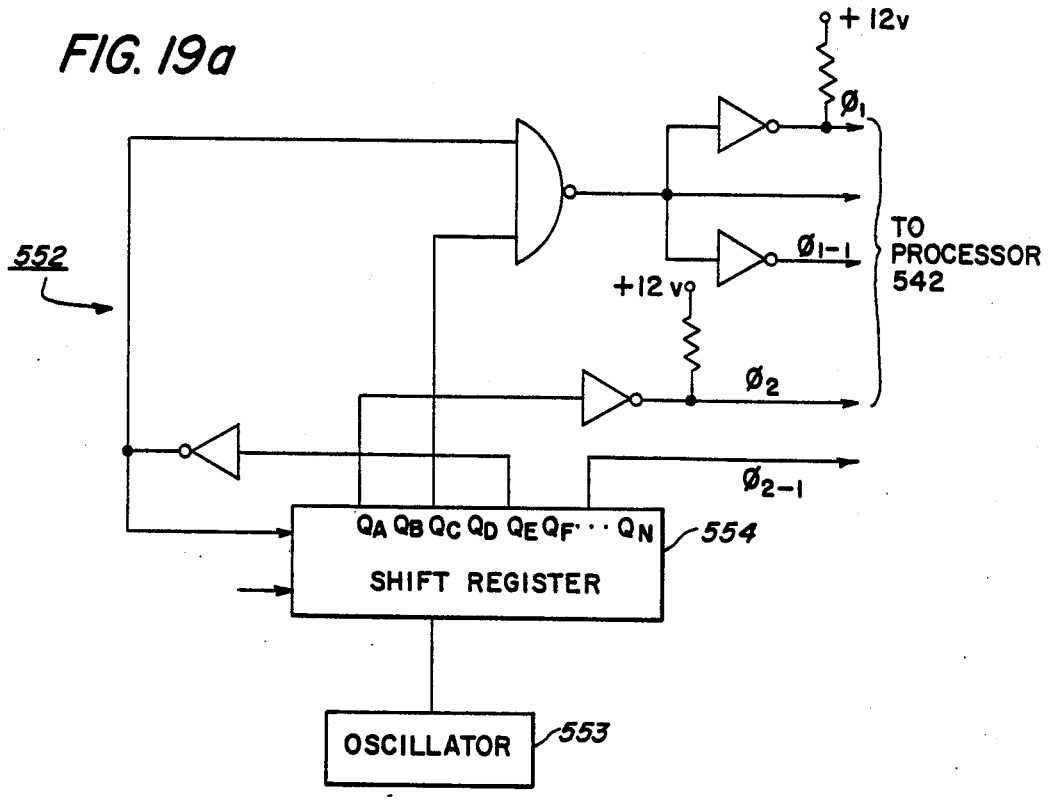
FIG. 19*a* is a logic schematic of the CPU clock.
Figure 19B:
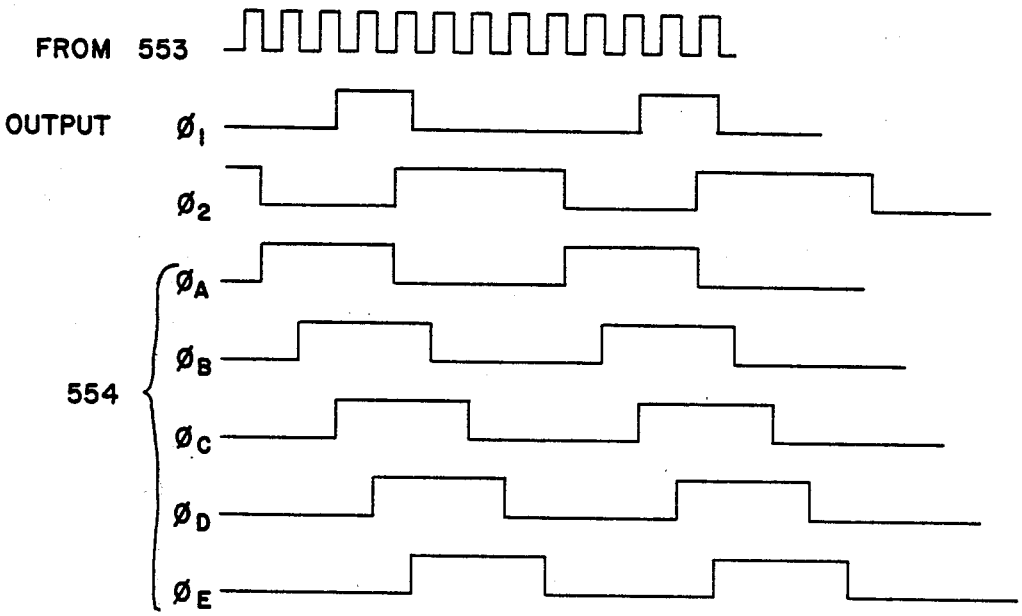
FIG. 19*b* is a chart illustrating the output wave form of the clock shown in FIG. 19*a;*

Referring particularly to FIG. 19(*a,b*) clock 552 comprises a suitable clock oscillator 553 feeding a multi-bite (Qa–Qn) shift register 554. Register 554 includes an internal feedback path from one bit to the serial input of register 554. Output signal waveforms $\phi_1$, $\phi_2$, $\phi_{1\text{-}1}$ and $\phi_{2\text{-}1}$ are produced for use by the system.

Figure 20:
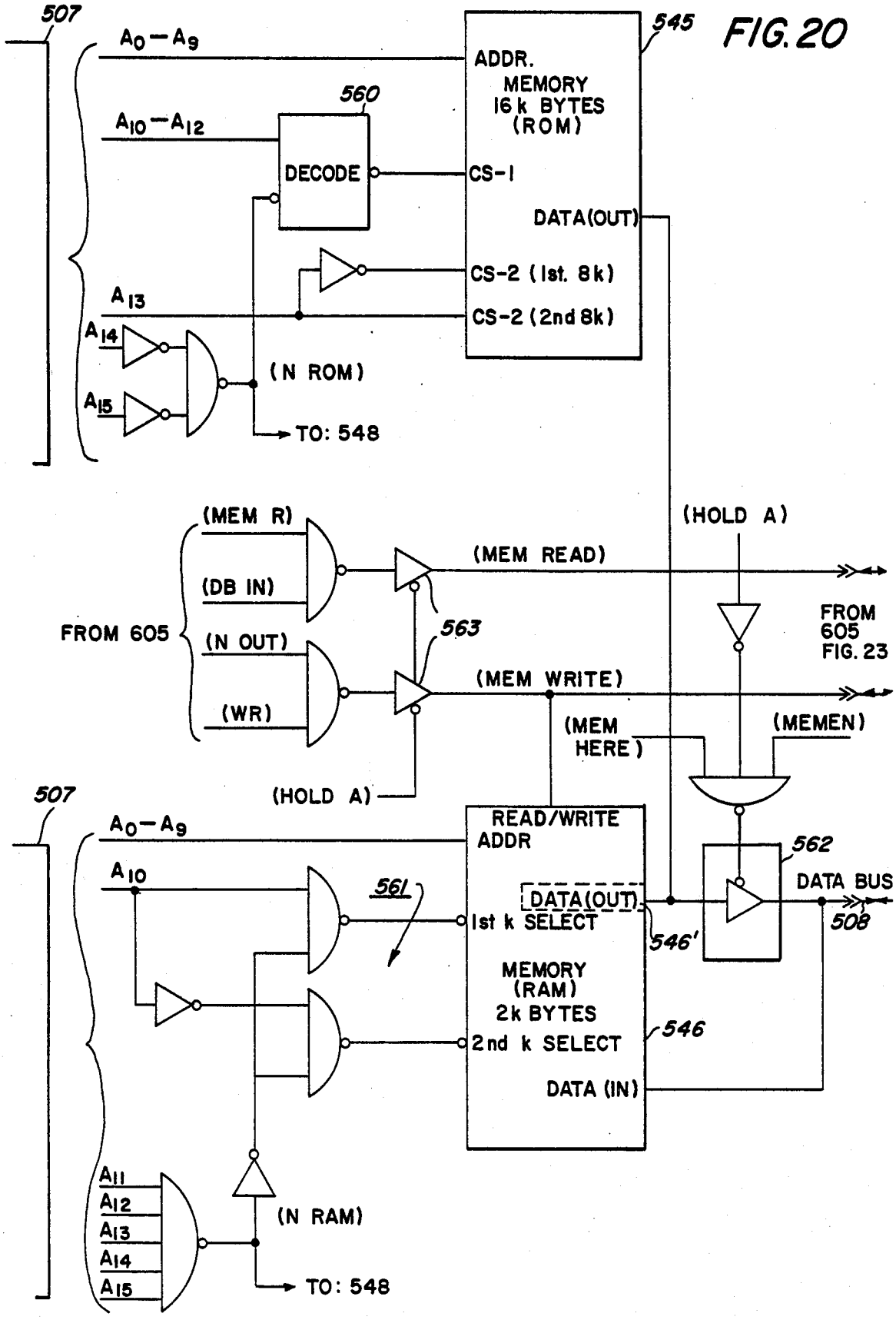
FIG. 20 is a logic schematic of the CPU memory.

Referring to FIG. 20, the memory bytes in ROM section 545 are implemented by address signals (Ao–A 15) from processor 542, selection being effected by 3 to 8 decode chip 560 controlling chip select 1 (CS-1) and a 1 bit selection (A 13) controlling chip select 2 (CS-2). The most significant address bits (A 14, A 15) select the first 16K of the total 64 bytes of the addressing space. The memory bytes in RAM section 546 are implemented by Address signals (Ao–A 15) through selector circuit 561. Address bit A 10 serves to select the memory bank while the remaining five most significant bits (A 11–A 15) select the last 2K bytes out of the 64K bytes of addressing space. RAM memory section 546 includes a 40 bit output buffer (DATA OUT) the output of which is tied together with the output from ROM memory section 545 and goes to tri-state buffer 562 to drive Data bus 508. Buffer 562 is enabled when either memory section 545 or 546 is being addressed and either a (MEM READ) or DMA (HOLD A) memory request exists. An enabling signal (MEMEN) is provided from the machine control or service panel (not shown) which is used to permit disabling of buffer 562 during servicing of CPU Module 500. Write control comes from either processor 542 (MEM WRITE) or from DMA (HOLD A) control. Tri-state buffers 563 permit Refresh Control 605 of I/O Module 502 to access MEM READ and MEM WRITE control channels directly on a DMA signal (HOLD A) from processor 542 as will appear.

Referring to FIG. 21, memory ready section 548 provides a READY signal to processor 542. A binary counter 566, which is initialized by a SYNC signal ($\phi$,) to a prewired count as determined by input circuitry 567, counts up at a predetermined rate. At the maximum count, the output at gate 568 comes true stopping the counter 566. If the cycle is a memory request (MEM REQ) and the memory location is on board as determined by the signal (MEM HERE) to tri-state buffer 569, a READY signal is sent to processor 542. Tri-state buffer 570 in MEM REQ line permits Refresh Control 605 of I/O Module 502 to access the MEM REQ channel directly on a DMA signal (HOLD A) from processor 542 as will appear.

Figure 22A:
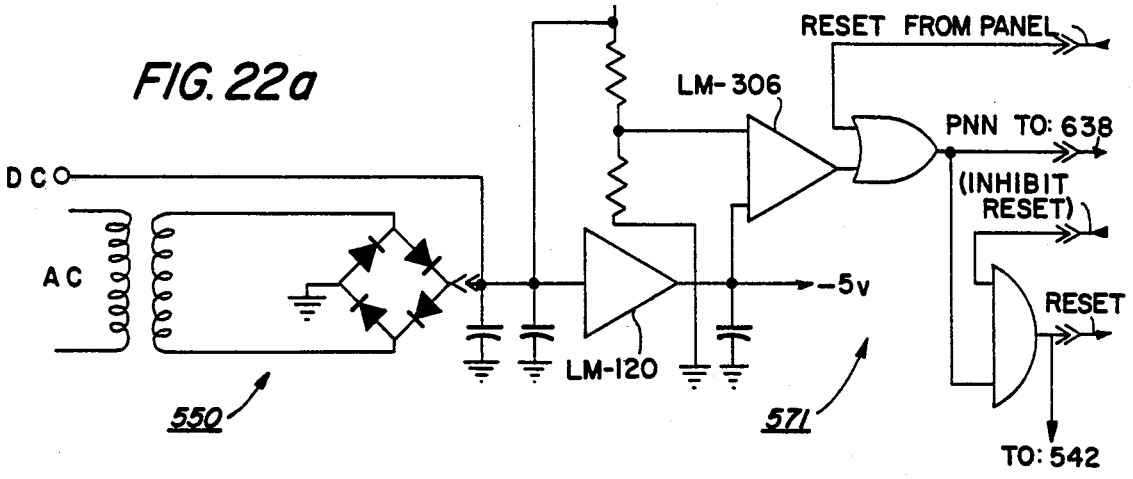
FIGS. 22*a*, 22*b*, 22*c* are logic schematics of the CPU power supply stages.
Figure 22B:
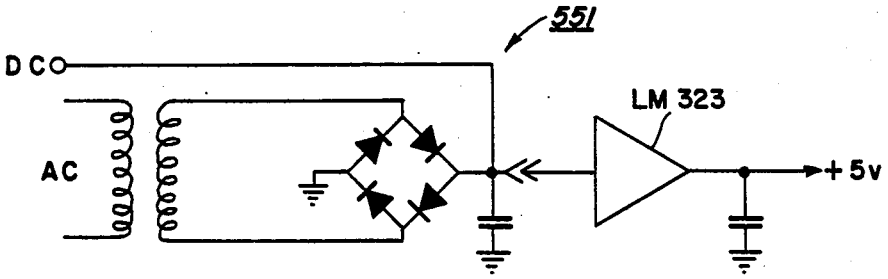
Figure 22C:
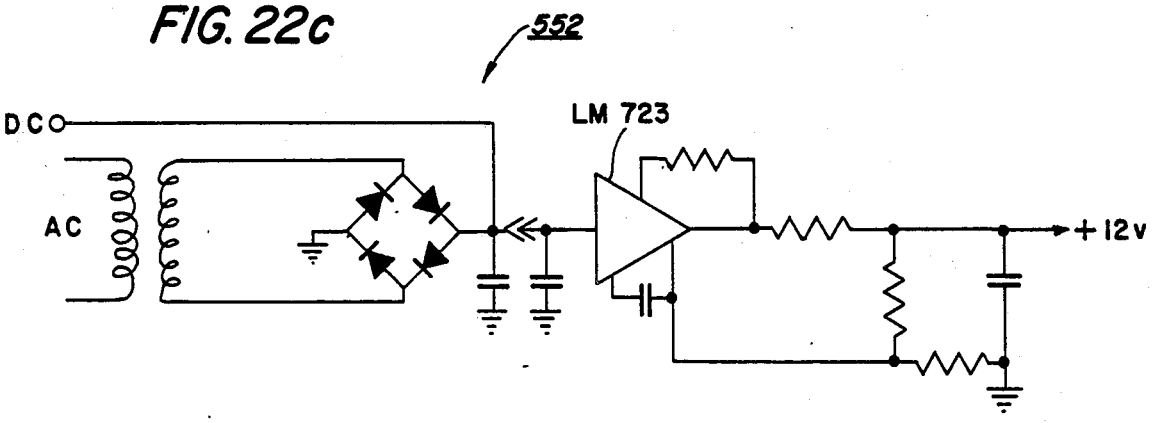

Referring to FIGS. 22(*a,b,c*) and 23*b*, power regulators 550, 551, 552 provide the various voltage levels, i.e. +5 v, +12 v, and −5 v D.C. required by the module 500. Each of the three on board regulators 550, 551, 552 employ filtered D.C. inputs. Power Not Normal (PNN) detection circuitry 571 is provided to reset processor 542 during the power up time. Reset control from the machine service panel (not shown) is also provided via PNN. An enabling signal (INHIBIT RESET) from Memory Control 638 allows completion of a write cycle in Non Volatile (N.V.) Memory 610 of I/O Module 502.

Figure 18B:
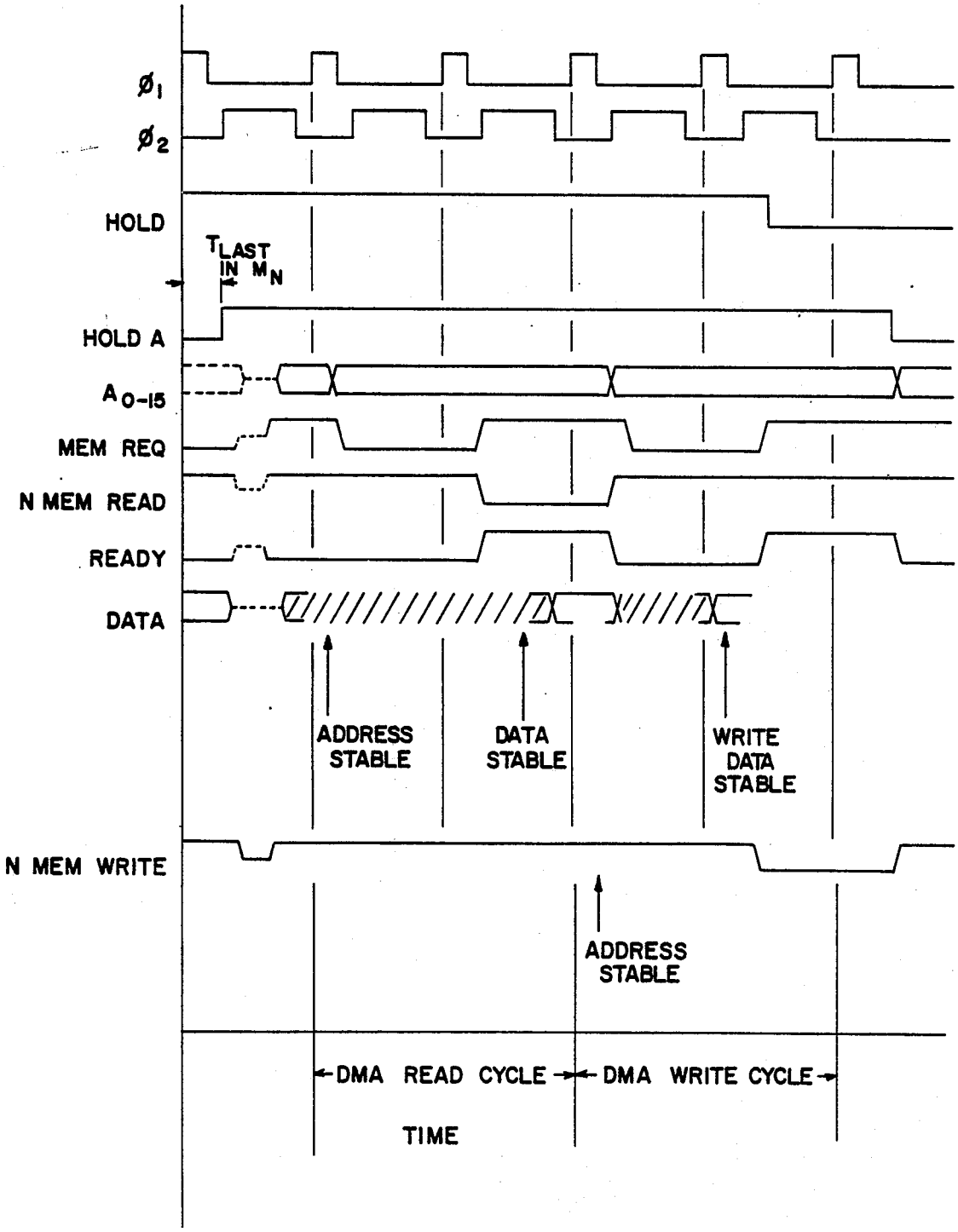
FIG. 18*b* is a timing chart of Direct Memory access (DMA) Read and Write cycles.
Figure 23A:
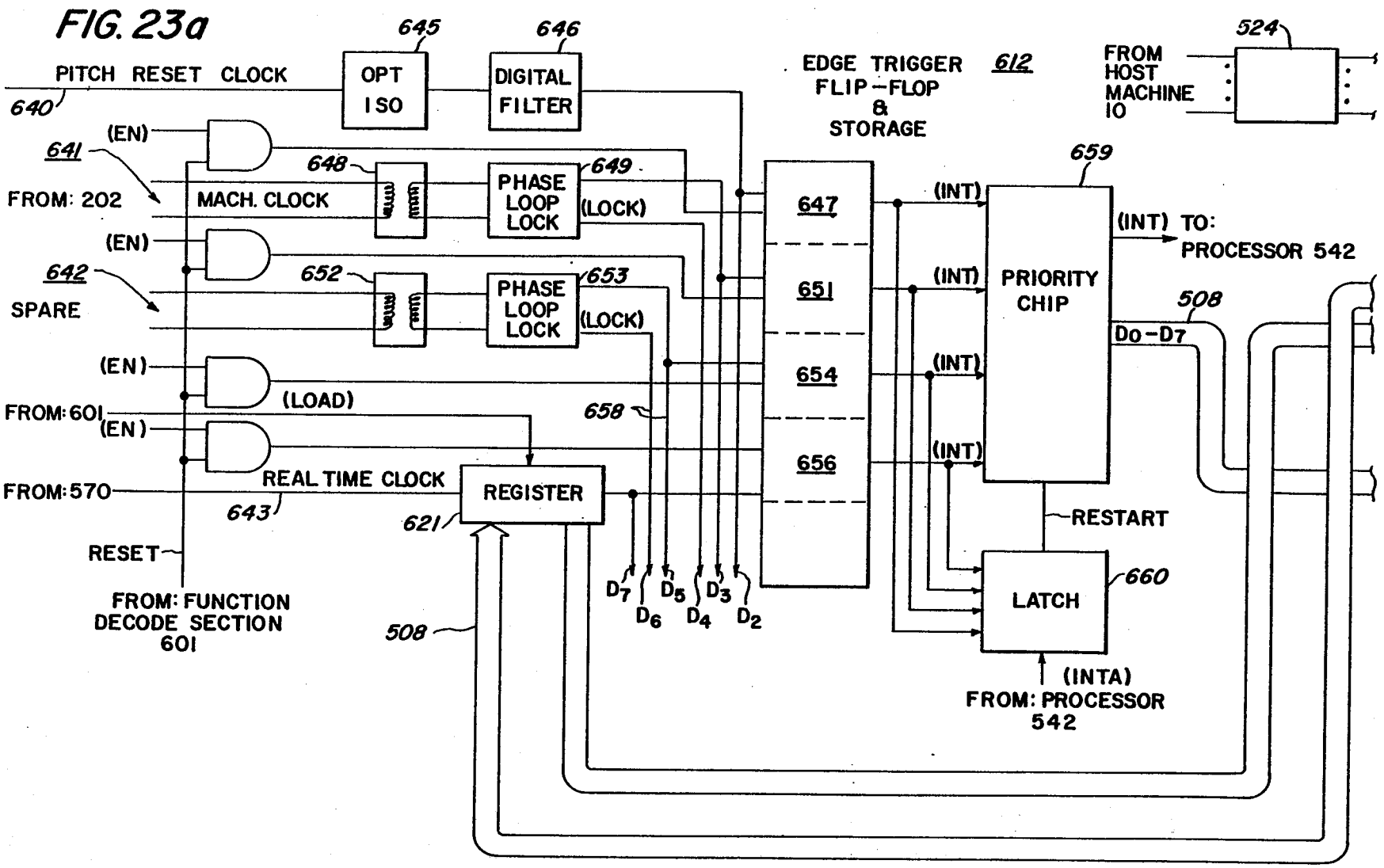
FIGS. 23*a* and 23*b* comprise a block diagram of the controller I/O module.
Figure 23B:
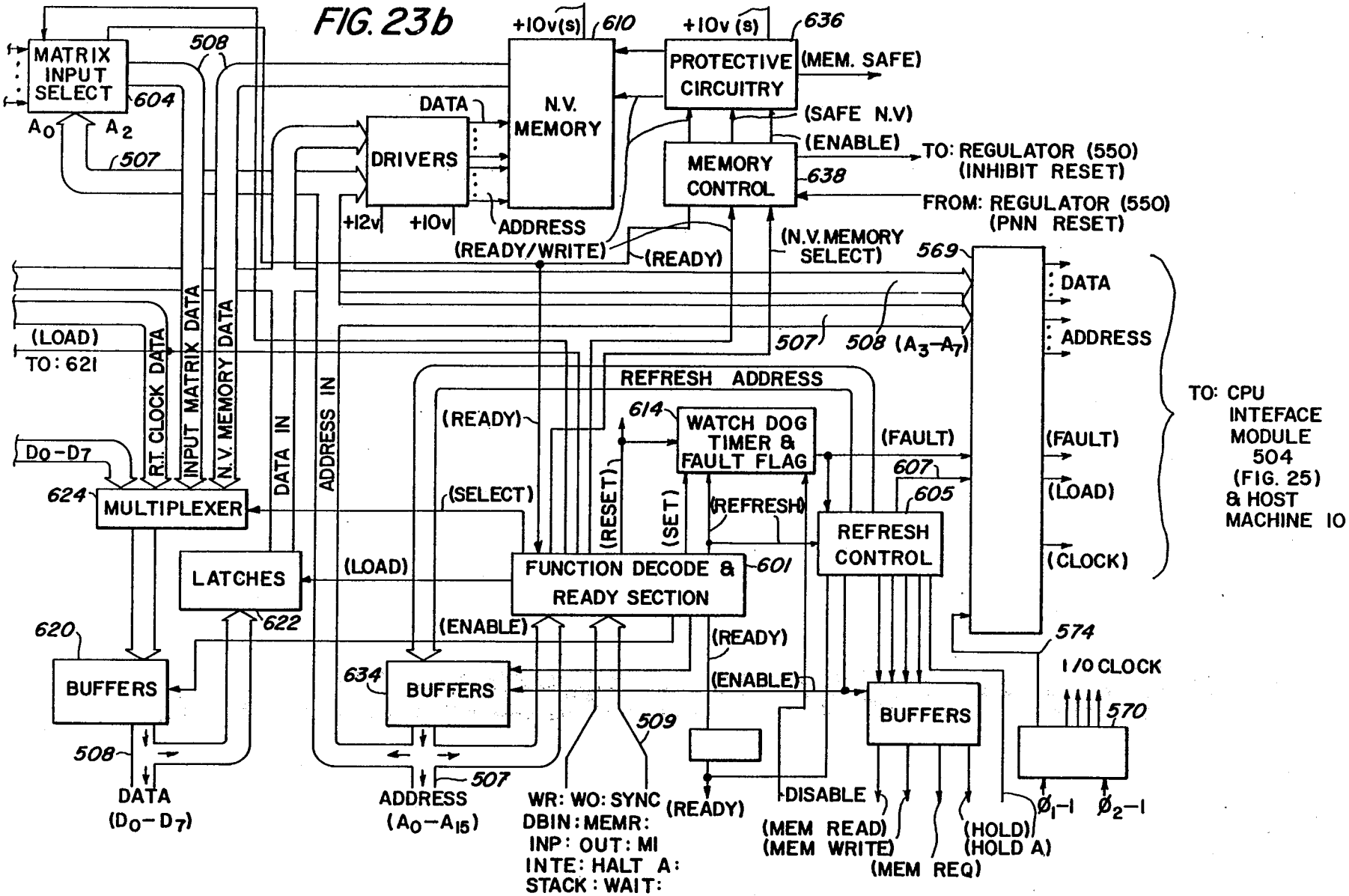

Referring to FIGS. 18*a*, 20, 21, and the DMA timing chart (FIG. 18*b*) data transfer from RAM section 546 to host machine 10 is effected through Direct Memory Access (DMA), as will appear. To initiate DMA, a signal (HOLD) is generated by Refresh Control 605 (FIG. 23*b*). On acceptance, processor 542 generates a signal HOLD ACKNOWLEDGE (HOLD A) which works through tri-state buffers 510, 511 and through buffers 563 and 570 to release Address bus 507, Data bus 508 and MEM READ, MEM WRITE, and MEM REQ channels (FIGS. 20, 21) to Refresh Control 605 of I/O Module 502.

Referring to FIG. 23(*a,b*), I/O Module 502 interfaces with CPU module 500 through bi-directional Address and, Data buses 507, 508 respectively, and control bus 509. I/O Module 502 appears to CPU module 500 as a memory portion. Data transfers between CPU and I/O modules 500, 502, and commands to I/O module 502 except for output refresh are controlled by memory reference instructions executed by CPU module 500. Output refresh which is initiated by one of several uniquely decoded memory reference commands, enables Direct Memory access (DMA) by I/O module 502 of RAM section 546.

I/O module 502 includes Matrix Input select 604 (through which inputs from the host machine 10, are received), Refresh Control 605, Nonvolatile (NV) memory 610, Interrupt Control 612 (FIG. 23*a*), Watch dog Timer and failure Flag 614 and clock 570.

A Function Decode Section 601 receives and interprets commands from CPU section 500 by decoding information on address bus 507 along with control signals from processor 542 on control bus 509. On command, decode section 601 generates control signals to perform the function indicated. These functions include (a) controlling tri-state buffers 620 to establish the direction of data flow in Data bus 508; (b) strobing data from Data bus 508 into buffer latches 622; (c) controlling multiplexer 624 to put data from Interrupt Control 612, Real Time clock register 621, Matrix Input Select 604 or N.V. memory 610 onto data bus 508; (d) actuating refresh control 605 to initiate a DMA operation; (e) actuating buffers 634 to enable address bits Ao–A 7 to be sent to the host machine 10 for input matrix read operations; (f) commanding operation of Matrix Input Select 604; (g) initiating read or write operation of N.V. memory 610 through Memory Control 638; (h) loading Real Time clock register 621 (FIG. 23*a*) from data bus 508; or (i) resetting the Watch Dog timer or setting the Fault Failure flag 614. In addition, section 601 includes logic to control and synchronize the READY control line to CPU module 500, the READY line being used to advise module 500 when data placed on the Data bus by I/O module 502 is valid.

Watch dog timer and failure flag 614, which serves to detect certain hardwired and software malfunctions, comprises a free running counter which under normal circumstances is periodically reset by an output refresh command (REFRESH) from Function Decode Section 601. If an output refresh command is not received within a preset time interval, (i.e. 25m sec) a fault flip flop is set and a signal (FAULT) sent to the host machine 10. The signal (FAULT) also raises the HOLD line (via Refresh Control 605) to disable CPU Module 500. Clearing of the fault flip flop may be by cycling power or generating a signal (RESET). A selector (not shown) may be provided to disable (DISABLE) the watch dog timer when desired. The fault flip flop may also be set by a command from the CPU Module to indicate that the operating program detected a fault.

Matrix Input select 604 which controls receipt of data from host machine 10 has capacity to read up to 32 groups of 8 discrete inputs from host machine 10. Lines $A_3$ through $A_7$ of Address bus 507 are routed to host machine 10 via optical isolator 569 and CPU Interface Module 504 to select the desired group of 8 inputs. The selected inputs from machine 10 are received by matrix 604 via Input Matrix Module 524 (FIG. 28) and are placed by matrix 604 onto data bus 508 and sent to CPU Module 500 via multiplexer 624. Bit selection is effected by lines $A_0$ through $A_2$ of Address bus 507.

Output refresh control 605, when initiated, transfers either 16 or 32 sequential words from the memory output buffer (DATA OUT) of RAM memory section 546 to host machine 10 to host machine 10 at the predetermined clock rate in line 574. Direct Memory access (DMA) is used to facilitate transfer of the data at a relatively high rate. On a Refresh signal from Function Decode Section 601, Refresh Control 605 generates a HOLD signal to processor 542. On acknowledgement (HOLD A) processor 542 enters a hold condition. In this mode, CPU Module 500 releases address and data buses 507, 508 (through actuation of tri-state buffers 510, 511 as described) to the high impedance state giving I/O module 502 control thereover. I/O module 502 then sequentially accesses the 32 memory words from output buffer (DATA OUT) of RAM section 546 (REFRESH ADDRESS) and transfers the contents to the host machine 10 via data bus 508 and optical isolator 569. CPU Module 500 is dormant during this period.

On capture of the address and data buses 507, 508, a control signal (LOAD) from Refresh Control 605 together with a clock signal (CLOCK) in line 574 are utilized to generate eight 32 bit serial words which are transmitted serially via CPU Interface Module 504 to the host machine remote locations where serial to parallel transformation is performed. Alternatively, the data may be stored in addressable latches and distributed in parallel directly to the required destinations.

N.V. memory 610 comprises a predetermined number of bits of nonvolatile memory stored in I/O module 502 under Memory Control 638. N.V. memory 610 appears to CPU module 500 as part of the CPU module memory complement and therefore may be accessed by the standard CPU memory reference instruction set. Referring particularly to FIG. 24, to sustain the contents of N.V. memory 610 should system power be interrupted, one or more rechargeable batteries 635 are provided exterior to I/O module 502. CMOS protective circuitry 636 couples batteries 635 to memory 610 to preserve memory 610 on a failure of the system power. A logic signal (INHIBIT RESET) prevents the CPU Module 500 from being reset during the N.V. memory write cycle interval so that any write operation in progress will be completed before the system is shut down.

For tasks that require frequent servicing, high speed response to external events, or synchronization with the operation of host machine 10, a multiple interrupt system is provided. These comprise machine based interrupts, herein referred to as Pitch Reset interrupt and the Machine interrupt, as well as a third clock driven interrupt, the Real Time interrupt.

Referring particularly to FIG. 23(*a*) the highest priority interrupt signal, Pitch reset signal 640, is generated by the signal output of pitch reset clock 138. The clock signal is fed via optical isolator 645 and digital filter 646 to edge trigger flip flop 647.

The second highest priority interrupt signal, machine clock signal 641, is sent directly from machine clock 202 through isolation transformer 648 to a phase locked loop 649. Loop 649, which serves as bandpath filter and signal conditioner, sends a square wave signal to edge trigger flip flop 651. The second signal output (LOCK) serves to indicate whether loop 649 is locked onto a valid signal input or not.

The lowest priority interrupt signal, Real Time Clock signal 643, is generated by register 621. Register 621 which is loaded and stored by memory reference instructions from CPU module 500 is decremented by clock signal in line 643 which may be derived from I/O Module clock 570. On the register count reaching zero, register 621 sends an interrupt signal to edge trigger flip flop 656. A spare interrupt 642 is also provided.

Setting of one or more of the edge trigger flip flops 647, 651, 654, 656 by the interrupt signals 640, 641, 642, 643 generates a signal (INT) via priority chip 659 to processor 542 of CPU Module 500 (FIG. 18*a*). On acknowledgement, processor 542, issues a signal (INTA)

transferring the status of the edge trigger flip flops 647, 651, 654, 656 to a four bit latch 660 to generate an interrupt instruction code (RESTART) onto the data bus 508.

Each interrupt is assigned a unique RESTART instruction code. Should an interrupt of higher priority be triggered, a new interrupt signal (INT) and RESTART instruction code are generated resulting in a nesting of interrupt software routines whenever the interrupt recognition circuitry is enabled within the CPU 500.

Priority chip 659 serves to establish a handling priority in the event of simultaneous interrupt signals in accordance with the priority schedule described.

Once triggered, the edge trigger flip flop 647, 651, 654 or 656 must be reset in order to capture the next occurrence of the interrupt associated therewith. Each interrupt subroutine serves, in addition to performing the functions programmed, to reset the flip flops (through the writing of a coded byte in a uniquely selected address) and to re-enable the interrupt (through execution of a re-enabling instruction). Until re-enabled, initiation of a second interrupt is precluded while the first interrupt is in progress.

Lines 658 permit interrupt status to be interrogated by CPU module 500 on a memory reference instruction.

I/O Module 502 includes a suitable pulse generator or clock 570 for generating the various timing signals required by module 502. Clock 570 is driven by the pulse-like output $\phi_{1-1}$, $\phi_{2-1}$ of processor clock 552 (FIG. 19*a*). As described, clock 570 provides a reference clock pulse (in line 574) for synchronizing the output refresh data and is the source of clock pulses (in line 643) for driving Real Time register 621.

Figure 25:
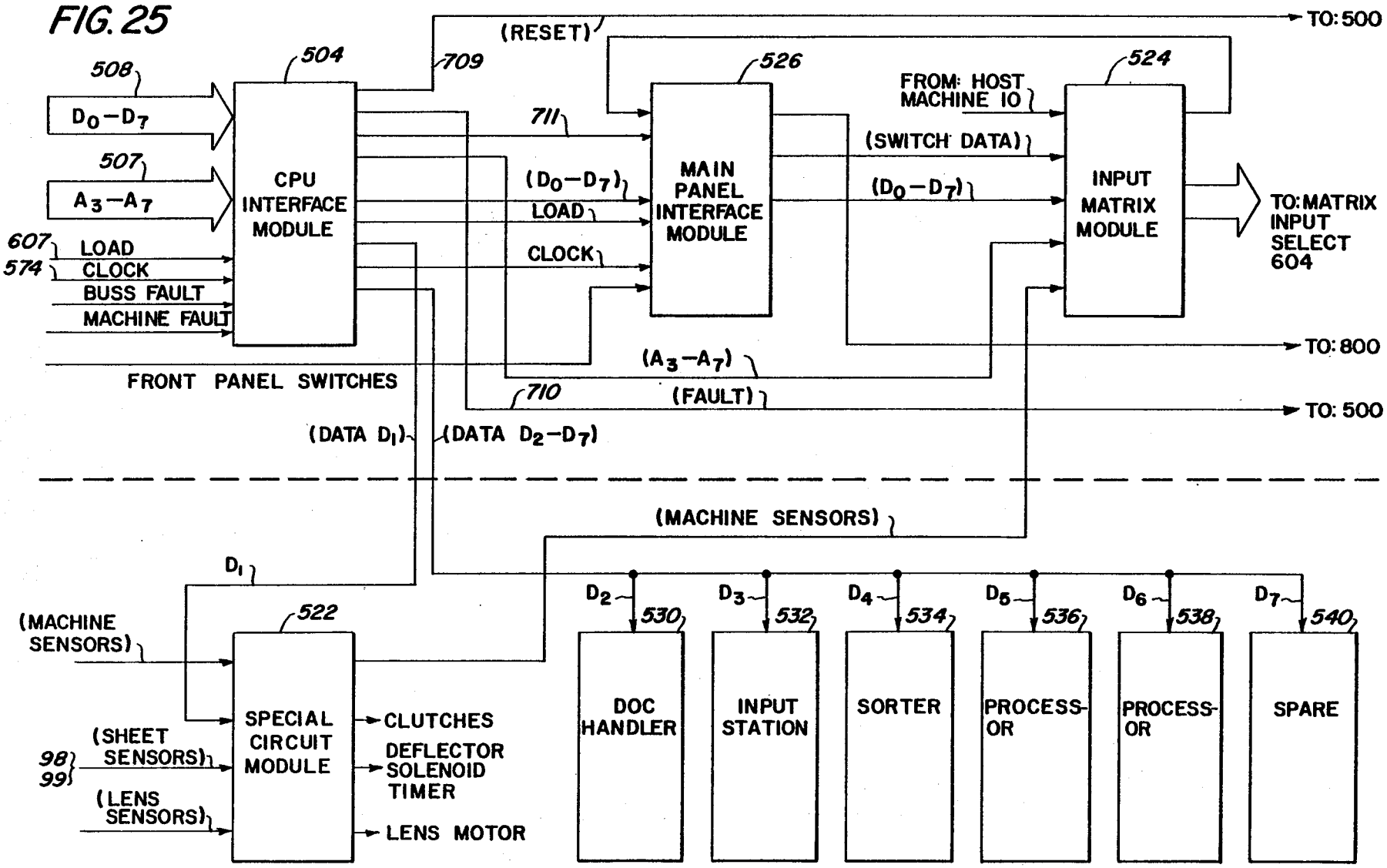
FIG. 25 is a block diagram of the apparatus interface and remote output connections.
Figure 26:
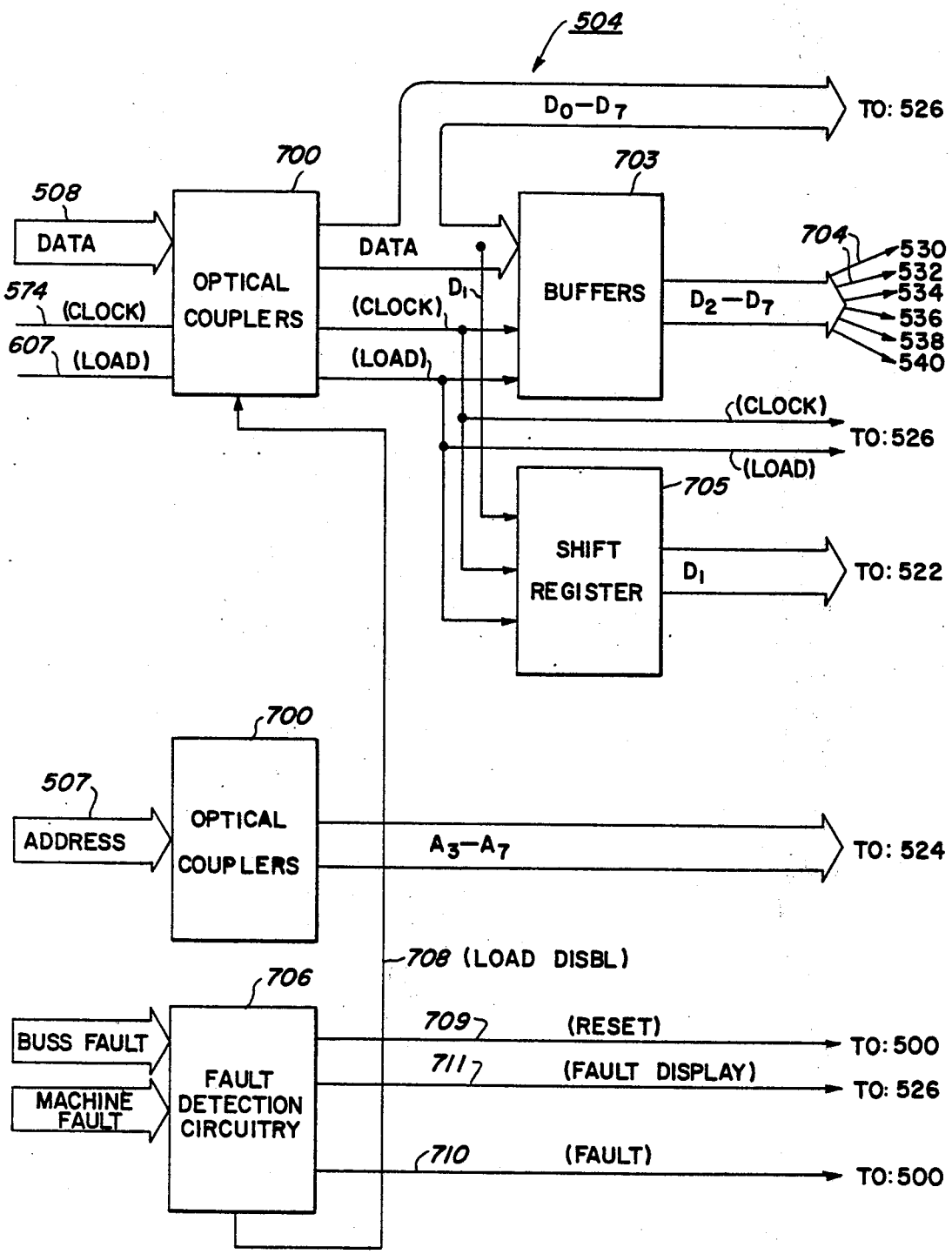
FIG. 26 is a block diagram of the CPU interface module.

CPU interface module 504 interfaces I/O module 502 with the host machine 10 and transmits operating data stored in RAM section 546 to the machine. Referring particularly to FIG. 25 and 26, data and address information are inputted to module 504 through suitable means such as optical type couplers 700 which convert the information to single ended logic levels. Data in bus 508 on a signal from Refresh Control 605 in line 607 (LOAD), is clocked into module 546 at the reference clock rate in line 574 parallel by bit, serial by byte for a preset byte length, with each data bit of each successive byte being clocked into a separate data channel D0–D7. As best seen in FIG. 25, each data channel D0–D7 has an assigned output function with data channel D0 being used for operating the front panel lamps 830 in the digital display, (see FIG. 32), data channel D1 for special circuits module 522, and remaining data channels D2–D7 allocated to the host machine operating sections 530, 532, 534, 536, 538 and 540. Portions of data channels D1–D7 have bits reserved for front panel lamps and digital display.

Since the bit capacity of the data channels D2–D7 is limited, a bit buffer 703 (FIG. 26) is preferably provided to catch any bit overflow in data channels D2–D7.

Inasmuch as the machine output sections 530, 532, 534, 536, 538 and 540 are electrically a long distance away, i.e. remote, from CPU interface module 504, and the environment is electrically "noisy", the data stream in channels D2–D7 is transmitted to remote sections 530, 532, 534, 536, 538 and 540 via a shielded twisted pair 704. By this arrangement, induced noise appears as a differential input to both lines and is rejected. The associated clock signal for the data is also transmitted over line 704 with the line shielded carrying the return signal currents for both data and clock signals.

Data in channel $D_1$ destined for special circuits module 522 is inputted to shift register type storage circuitry 705 for transmittal to module 522. Display data ($D_0$-$D_7$) is also inputted to main panel interface module 526. Address information in bus 507 is converted to single ended output by couplers 700 and transmitted to Input Matrix Module 524 to address host machine inputs.

CPU interface module 504 includes fault detector circuitry 706 for monitoring both faults occurring in host machine 10 and faults or failures along the buses, the latter normally comprising a low voltage level or failure in one of the system power lines. Machine faults may comprise a fault in CPU module 500, a belt mistrack signal from sensor 27 (see FIG. 2), opening one of the machine doors or covers as responded to by conventional cover interlock sensors (not shown), a fuser over temperture as detected by sensor 175, etc. In the event of a bus fault, a reset signal (RESET) is generated automatically in line 709 to CPU module 500 (see FIGS. 17 and 18*a*) until the fault is removed. In the event of a machine fault, a signal is generated in line 710 to actuate a suitable relay (not shown) controlling power to all or a portion of host machine 10. A load disabling signal (LOAD DISBL) is inputted to DATA receiving optical couplers 700 via line 708 in the event of a fault in CPU module 500 to terminate input of data to host machine 10. Other fault conditions are monitored by the software background program. In the event of a fault, a signal is generated in line 711 to the digital display on control console 800 (via main panel interface module 526) signifying a fault.

Figure 27:
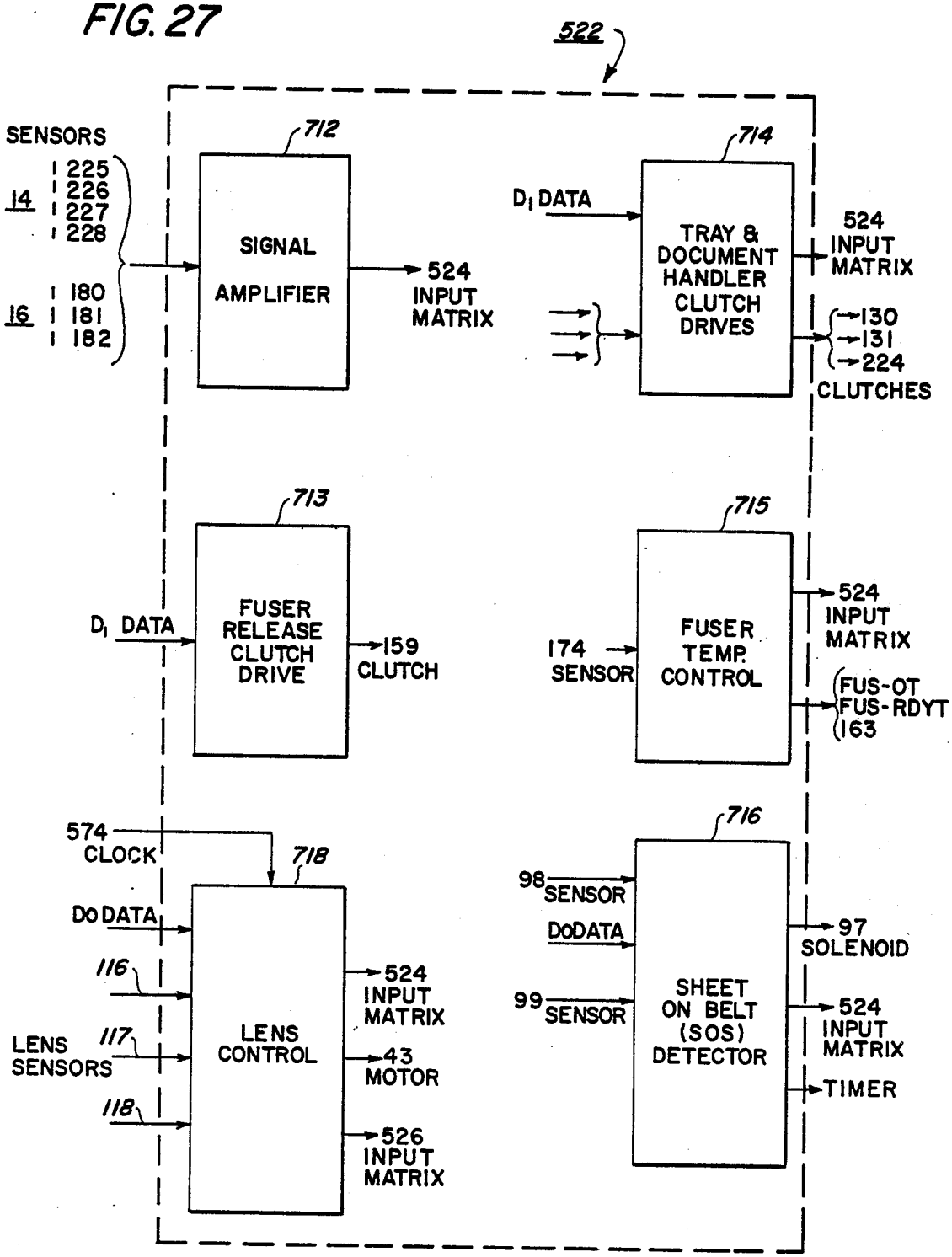
FIG. 27 is a block diagram of the apparatus special circuits module.

Referring particularly to FIGS. 25 and 27, special circuits module 522 comprises a collection of relatively independent circuits for either monitoring operation of and/or driving elements of host machine 10. Module 522 incorporates suitable circuitry 712 for amplifying the output of sensors 225, 226, 227, 228 and 280, 281, 282 of sorter 14 and document handler 16 respectively; circuitry 713 for operating fuser release clutch 159; and circuitry 714 for operating main and auxiliary paper tray feed roll clutches 130, 131 and document handler feed clutch 244.

Additionally, fuser detection circuitry 715 monitors temperature conditions of fuser 150 as responded to by sensor 174. On overheating of fuser 150, a signal (FUS-OT) is generated to turn heater 163 off, actuate clutch 159 to separate fusing and pressure rolls 160, 161; trigger trap solenoid 158 to prevent entrance of the next copy sheet into fuser 150, and initiate a shutdown of host machine 10. Circuitry 715 also cycles fuser heater 163 to maintain fuser 150 at proper operating temperatures and signals (FUS-RDYT) host machine 10 when fuser 150 is ready for operation.

Circuitry 716 provides closed loop control over sensor 98 which responds to the presence of a copy sheet 3 on belt 20. On a signal from sensor 98, solenoid 97 is triggered to bring deflector 96 into intercepting position adjacent belt 20. At the same time, a backup timer (not shown) is actuated. If the sheet is lifted from the belt 20 by deflector 96 within the time allotted, a signal from sensor 99 disables the timer and a misstrip type jam condition of host machine 10 is declared and the machine is stopped. If the signal from sensor 99 is not received within the allotted time, a sheet on selenium (SOS) type jam is declared and an immediate machine stop is effected.

Circuitry 718 controls the position (and hence the image reduction effected) by the various optical elements that comprise main lens 41 in response to the reduction mode selected by the operator and the signal inputs from lens position responsive sensor 116, 117, 118. The signal output of circuitry 718 serves to operate lens drive motor 43 as required to place the optical elements of lens 41 in proper position to effect the image reduction programmed by the operator.

Figure 28:
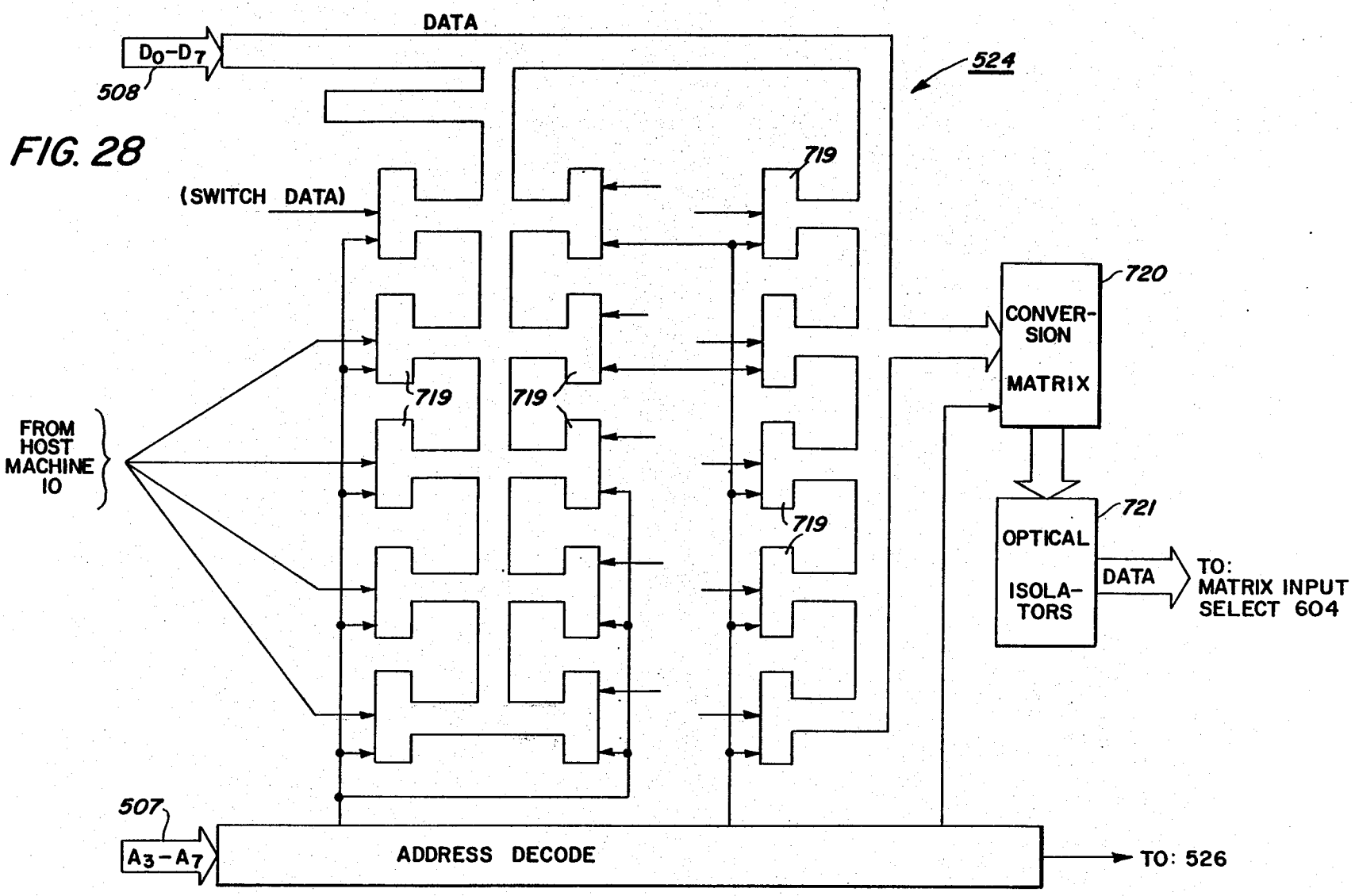
FIG. 28 is a block diagram of the main panel interface module.

Referring to FIG. 28, input matrix module 524 provides analog gates 719 for receiving data from the various host machine sensors and inputs (i.e. sheet sensors 135, 136; pressure sensor 157; etc) and data (SWITCH DATA) from the various switches on console 800 (FRONT PANEL SWITCHES—FIG. 25), module 524 serving to convert the signal input to a byte oriented output for transmittal to I/O module 502 under control of Input Matrix Select 604 (FIG. 23*b*). The byte output to module 524 is selected by address information inputted on bus 507 and decoded on module 524. Conversion matrix 720, which may comprise a diode array, converts the input logic signals of "0" to logic "1" true. Data from input matrix module 524 is transmitted via optical isolators 721 to Input Matrix Select 604 of I/O module 502 (FIG. 23*b*). From there, the data is transmitted through Multiplexer 624 and buffers 620 to CPU Module 500.

Figure 29:
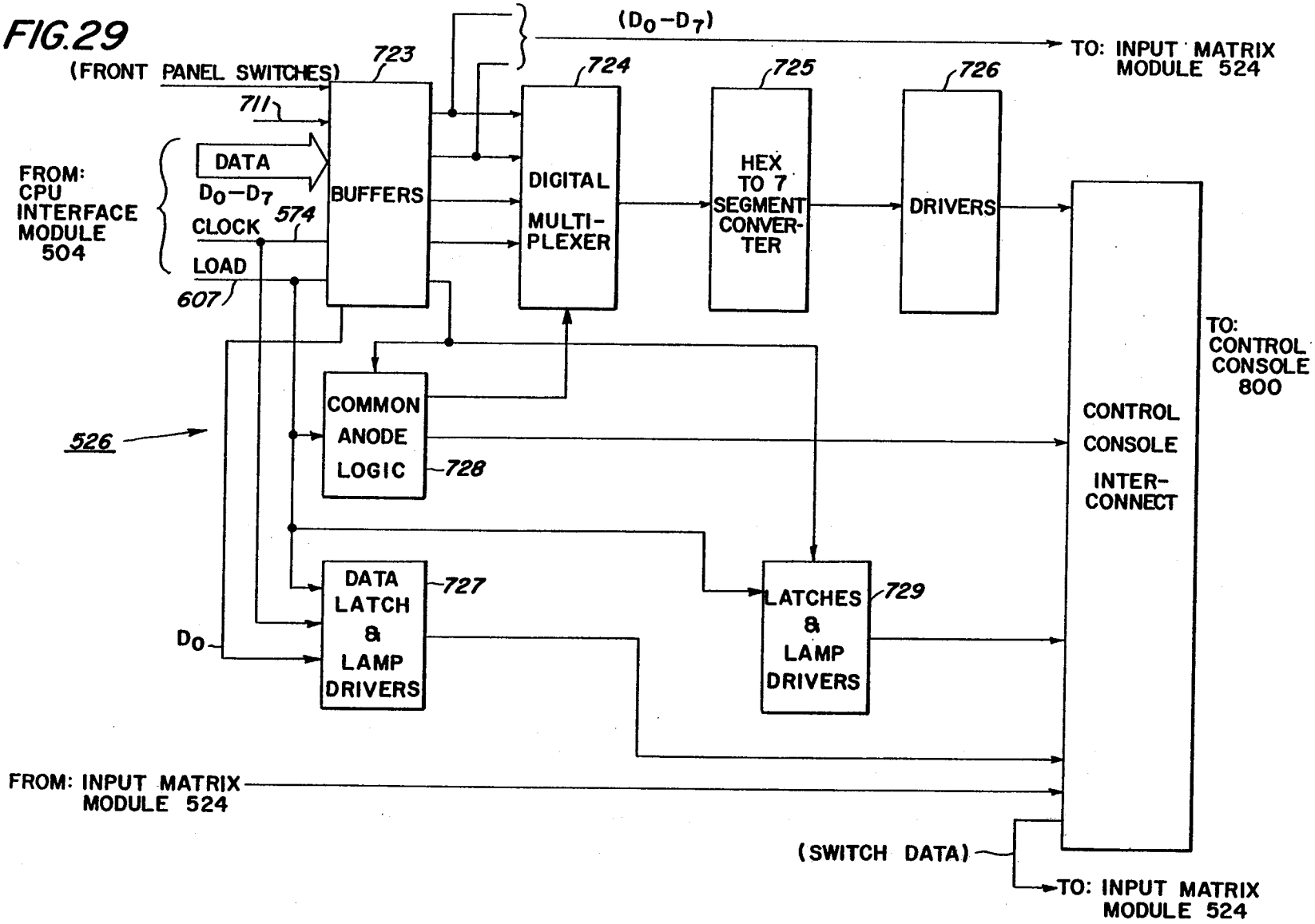
FIG. 29 is a block diagram of the input matrix module.

Referring particularly to FIG. 29, main panel interface module 526 serves as interface between CPU interface module 504 and operator control console 800 for display purposes and as interface between input matrix module 524 and the console switches. As described, data channels D0–D7 have data bits in each channel associated with the control console digital display or lamps. This data is clocked into buffer circuitry 723 and from there, for digital display, data in channels D1–D7 is inputted to multiplexer 724. Multiplexer 724 selectively multiplexes the data to HEX to 7 segment converter 725. Software controlled output drivers 726 are provided for each digit which enable the proper display digit in response to the data output of converter 725. This also provides blanking control for leading zero suppression or inter digit suppression.

Buffer circuitry 723 also enables through anode logic 728 the common digit anode drive. The signal (LOAD) to latch and lamp driver control circuit 729 regulates the length of the display cycle.

For console lamps 830, data in channel D0 is clocked to shift register 727 whose output is connected by drivers to the console lamps. Access by input matrix module 524 to the console switches and keyboard (FRONT PANEL SWITCHES) is through main panel interface module 526.

The machine output sections 530, 532, 534, 536, 538, 540 are interfaced with I/O module 502 by CPU interface module 504. At each interrupt/refresh cycle, data is outputted to sections 530, 532, 534, 536, 538, 540 at the clock signal rate in line 574 over data channels D2, D3, D4, D5, D6, D7 respectively.

Figure 30:
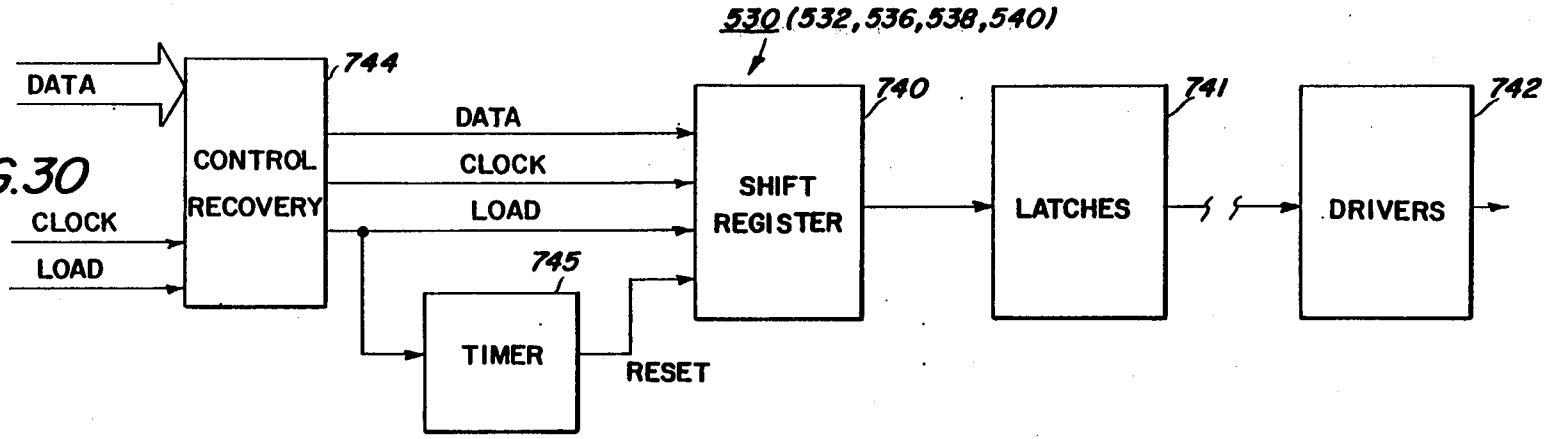
FIG. 30 is a block diagram of a typical remote.

Referring to FIG. 30, wherein a typical output section i.e. document handler section 530 is shown, data inputted to section 530 is stored in shift register/latch circuit combination 740, 741 pending output to the individual drivers 742 associated with each machine component. Preferably d.c. isolation between the output sections is maintained by the use of transformer coupled differential outputs and inputs for both data and clock signals and a shielded twisted conductor pair. Due to transformer coupling, the data must be restored to a d.c. waveform. For this purpose, control recovery circuit 744, which may comprise an inverting/non-inverting digital comparator pair and output latch is provided.

The LOAD signal serves to lockout input of data to latches 741 while new data is being clocked into shift register 740. Removal of the LOAD signal enables commutation of the fresh data to latches 741. The LOAD signal also serves to start timer 745 which imposes a maximum time limit within which a refresh period (initiated by Refresh Control 605) must occur. If refresh does not occur within the prescribed time limit, timer 745 generates a signal (RESET) which sets shift register 740 to zero.

With the exception of sorter section 534 discussed below, output sections 532, 536, 538 and 540 are substantially identical to document handler section 530.

Figure 31:
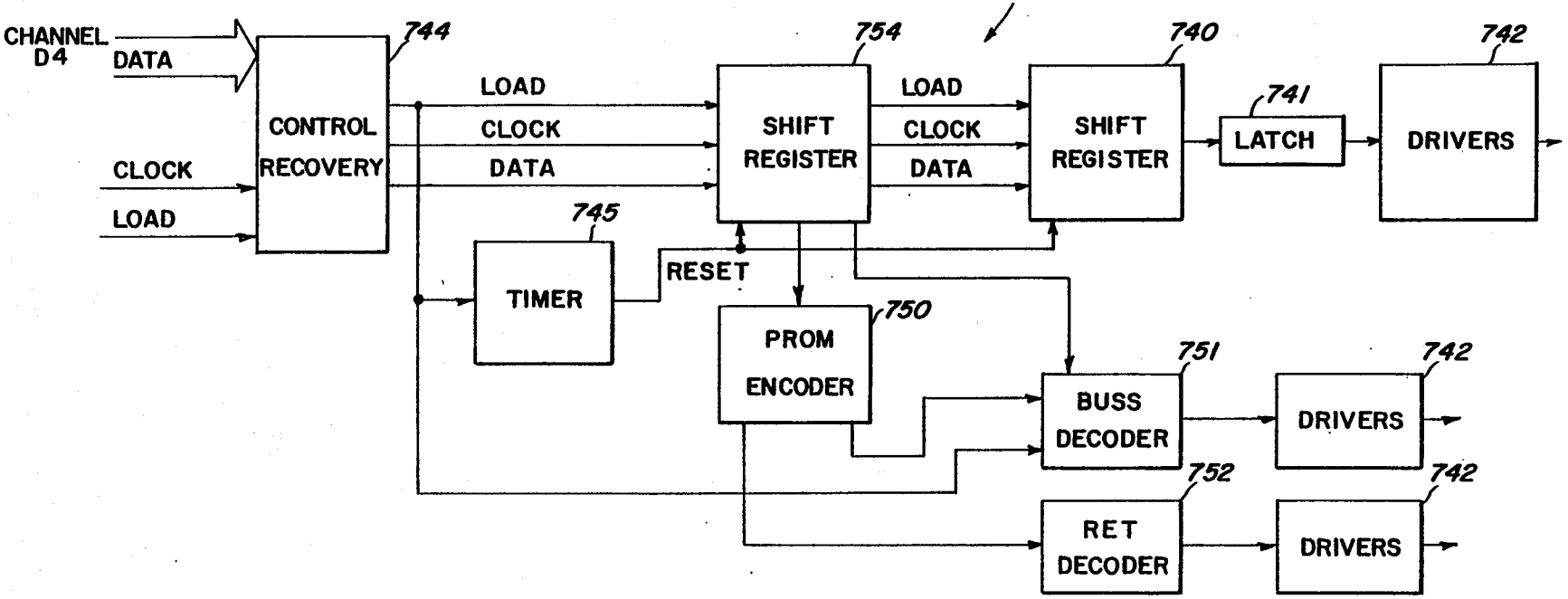
FIG. 31 is a block diagram of the sorter remote.

Referring to FIG. 31 wherein like numbers refer to like parts, to provide capacity for driving the sorter deflector solenoids 221, a decode matrix arrangement consisting of a Prom encoder 750 controlling bus decoder (BUS DECODER) 751 and return decoder 752 (RET DECODER) is provided. The output of decoders 751, 752 drive the sorter solenoids 221 of upper and lower bin arrays 210, 211 respectively. Data is inputted to encoder 750 by means of shift register 754.

Figure 32:
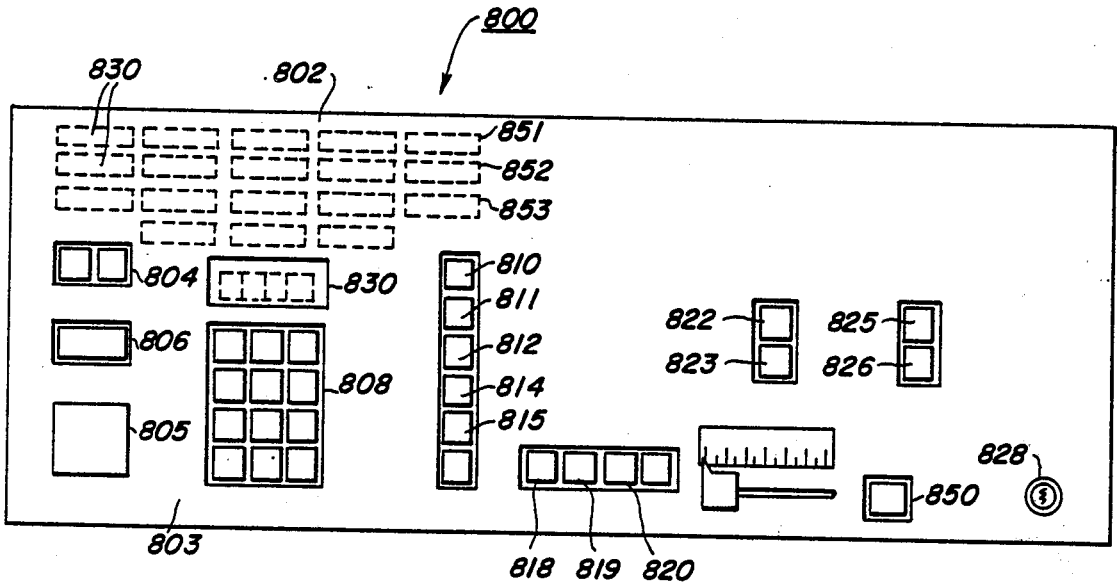
FIG. 32 is a view of the control console for inputting copy run instructions to the apparatus shown in FIG. 1.

Referring now to FIG. 32, control console 800 serves to enable the operator to program host machine 10 to perform the copy run or runs desired. At the same time, various indicators on console 800 reflect the operational condition of machine 10. Console 800 includes a bezel housing 802 suitably supported on host machine 10 at a convenient point with decorative front or face panel 803 on which the various machine programming buttons and indicators appear. Programming buttons include power on/off buttons 804, start print (PRINT) buttons 805, stop print (STOP) button 806 and keyboard copy quantity selector 808. A series of feature select buttons consisting of auxiliary paper tray button 810, two sided copy button 811, copy lighter button 814, and copy darker button 815, are provided.

Additionally, image size selector buttons 818, 819, 820; multiple or single document select buttons 822, 823 for operation of document handler 16; and sorter sets or stacks buttons 825, 826 are provided. An on/off service selector 828 is also provided for activation during machine servicing.

Indicators comprise program display lamps 830 and displays such as READY, WAIT, SIDE 1, SIDE 2, ADD PAPER, CHECK STATUS PANEL, PRESS FAULT CODE, QUANTITY COMPLETED, CHECK DOORS, UNLOAD AUX TRAY, CHECK DOCUMENT PATH, CHECK PAPER PATH, JOB INCOMPLETE and UNLOAD SORTER. Other display information may be envisioned.

MACHINE OPERATION

As will appear, host machine 10 is conveniently divided into a number of operational states. The machine control program is divided into background routines and Foreground routines with operational control normally residing in the Background routine or routines appropriate to the particular machine state then in effect. The output buffer (DATA OUT) of RAM memory section 546 is used to transfer/refresh control data to the various remote locations in host machine 10, control data from both Background and Foreground routines being inputted to RAM memory section 546 for subsequent transmittal to host machine 10. Transmittal/refresh of control data presently in the output buffer (DATA OUT) of section 546 is effected through Direct Memory access (DMA) under the aegis of a Machine clock interrupt routine.

Foreground routine control data which includes a Run Event Table built in response to the particular copy run or runs programmed, is transferred to output buffer (DATA OUT) of RAM section 546 by means of multiple prioritized interrupt system wherein the Background routine in process is temporarily interrupted while fresh Foreground routine control data is inputted to the RAM output buffer following which the interrupted Background routine is resumed.

The operating program for host machine 10 is divided into a collection of foreground tasks, some of which are driven by the several interrupt routines and background or non-interrupt routines. Foreground tasks are tasks that generally require frequent servicing, high speed response, or synchronization with the host machine 10. Background routines are related to the state of host machine 10, different background routines being performed with different machine states. A single background software control program (STCK) composed of specific sub-programs associated with the principal operating states of host machine 10 is provided. A byte called STATE contains a number indicative of the current operating state of host machine 10. The machine STATES are as follows:

| STATE NO. | MACHINE STATE | CONTROL SUBR. |
|---|---|---|
| 0 | Software Initialize | INIT |
| 1 | System Not Ready | NRDY |
| 2 | System Ready | RDY |
| 3 | Print | PRINT |
| 4 | System Running, Not Print | RUNNPRT |
| 5 | Service | TECHREP |

Figure 33:
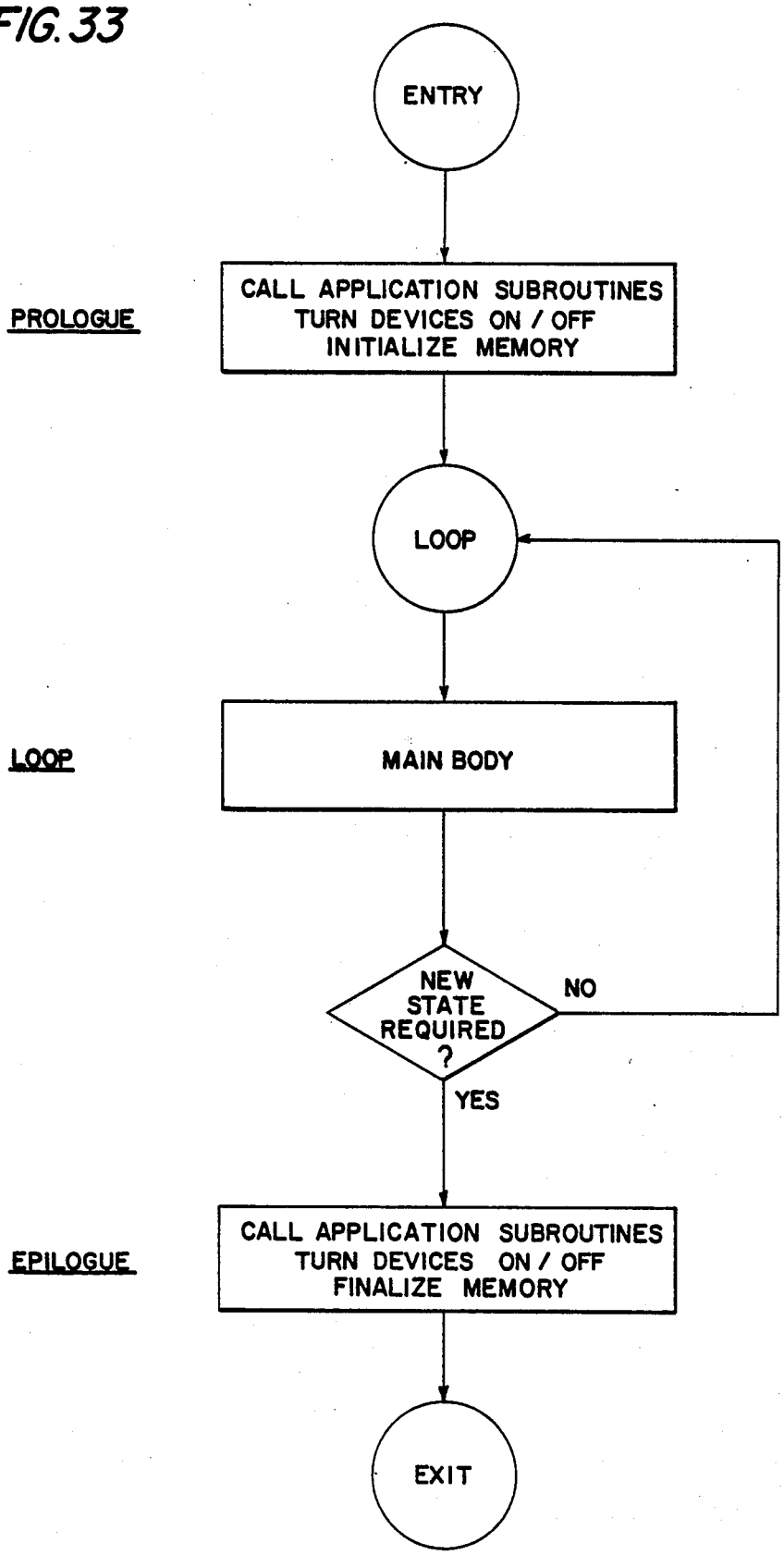
FIG. 33 is a flow chart illustrating a typical machine state.

Referring to FIG. 33, each STATE is normally divided into PROLOGUE, LOOP and EPILOGUE sections. As will be evident from the exemplary program STCK reproduced in Table I, entry into a given STATE (PROLOGUE) normally causes a group of operations to be performed, these consisting of operations that are performed once only at the entry into the STATE. For complex operations, a CALL is made to an applications subroutine therefor. Relatively simpler operations (i.e. turning devices on or off, clearing memory, presetting memory, etc.) are done directly.

Once the STATE PROLOGUE is completed, the main body (LOOP) is entered. The program (STCK) remains in this LOOP until a change of STATE request is received and honored. On a change of STATE request, the STATE EPILOGUE is entered wherein a group of operations are performed, following which the STATE moves into the PROLOGUE of the next STATE to be entered.

Figure 34:
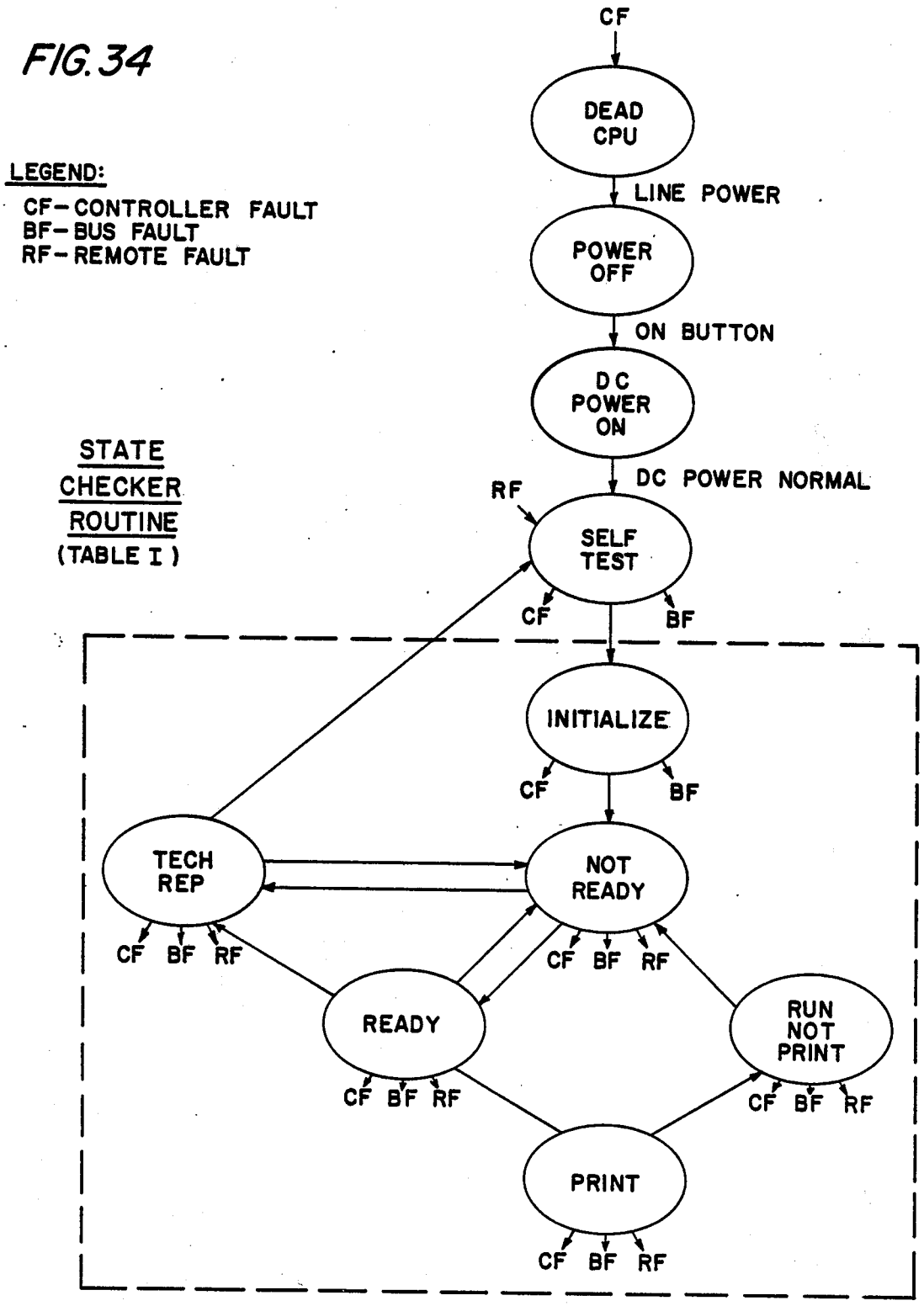
FIG. 34 is a flow chart of the machine state routine.

Referring to FIG. 34 and the exemplary program (STCK) in Table I. On actuation of the machine POWER-ON button 804 (FIG. 32), the software Initialize STATE (INIT) is entered. In this STATE, the controller is initialized and a software controlled self test subroutine is entered. If the self test of the controller is successfully passed, the System Not Ready STATE (NRDY) is entered. If not, a fault condition is signaled.

In the System Not Ready STATE (NRDY), background subroutines are entered. These include setting of Ready flags, control registers, timers, and the like; turning on power supplies, the fuser, etc., initializing the Fault Handler, checking for paper jams (left over from a previous run), door and cover interlocks, fuser temperatures, etc. During this period, the WAIT lamp on console 800 is lit and operation of host machine 10 precluded.

When all ready conditions have been checked and found acceptable, the controller moves to the system ready state (RDY). The READY lamp on console 800 is lit and final ready checks made. Host Machine 10 is now ready for operation upon completion of input of a copy run program, loading of one or more originals 2 into document handler 16 (if selected by the operator), and actuation of START PRINT button 805. As will appear hereinafter, the next state is PRINT wherein the particular copy run programmed is carried out.

While the machine is completing a copy run, the controller normally enters the Run Not Print state (RUNNPRT) where the controller calculates the number of copies delivered, resets various flags, stores certain machine event information in the memory, as well as generally conditioning the machine for another copy run, if desired. The controller then returns to the System Not Ready state (NRDY) to recheck for ready conditions prepatory for another copy run, with the same state sequence being repeated until the machine is turned off by actuation of POWER OFF button 804 or a malfunction inspired shutdown is triggered. The last state (TECH REP) is a machine servicing state wherein certain service routines are made available to the machine/repair personnel, i.e. Tech Reps.

Referring particularly to FIG. 32 and Tables II, III, IV, V, VI and VII, the machine operator uses control console 800 to program the machine for the copy run desired. Programming may be done during either the System Not Ready (NRDY) or System Ready (RDY) states, although the machine will not operate during the System Not ready state should START PRINT button 805 be pushed. The copy run includes selecting (using keyboard 808) the number of copies to be made, and such other ancillary program features as may be desired, i.e. use of auxiliary paper tray 102, (push button 810), image size selection (push buttons 818, 819, 820), document handler/sorter selection (push buttons 822, 823, 825, 826), copy density (push buttons 814, 815), duplex or two sided copy button 811, etc. On completion of the copy run program, START PRINT button 805 is actuated to start the copy run programmed (presuming the READY lamp is on and an original or originals 2 have been placed in tray 233 of document handler 16 if the document handler has been selected).

With programming of the copy run instructions, controller 18 enters a Digit Input routine in which the program information is transferred to RAM section 546. The copy run program data passes via Main Panel Interface Module 526 to Input Matrix Module 524 and from there is addressed through Matrix Input Select 604, Multiplexer 624, and Buffers 620 of I/O Module 502 to RAM section 546 of CPU Module 500.

On entering PRINT STATE, a Run Event Table (FIG. 35) comprised of Foreground tasks is built for operating in cooperation with the background tasks the various components of host machine 10 in an integrated manner to produce the copies programmed. The run Event Table is formed by controller 18 through merger of a Fixed Pitch Event Table (TABLE II) (stored in ROM 545 and Non Volatile Memory 610) and a Variable Pitch Event Table (TABLE III) in a fashion appropriate to the parameters of the job selected.

The Fixed Pitch Event Table (TABLE II) is comprised of machine events whose operational timing is fixed during each pitch cycle such as the timing of bias to transfer roll 75, (TRN 2 CURR), actuating toner concentration sensor 65 (ADC ACT), loading roll 161 of fuser 150 (FUS*LOAD), and so forth, irrespective of the particular copy run programmed. The Variable Pitch Table (TABLE III) is comprised of machine events whose operational timing varies with the individual copy run programmed, i.e. timing of pitch fade-out lamp 44 (FO*ONBSE) and timing of flash illumination lamps 37 (FLSH BSE). The variable Pitch Table is built by the Pitch Table Builder (TABLE IV) from the copy run information programmed in by controller 18 (using the machine control program stored in ROM section 545 and Non-Volatile Memory 610), coupled with event address information from ROM section 545, sorted by absolute clock count (via the routine shown in TABLE V), and stored in RAM section 546 (via the routine shown in TABLE VI). The Fixed Pitch Event Table and Variable Pitch Table are merged with the relative clock count differences between Pitch events calculated to form a Run Event Table (TABLE VII).

Figure 35:
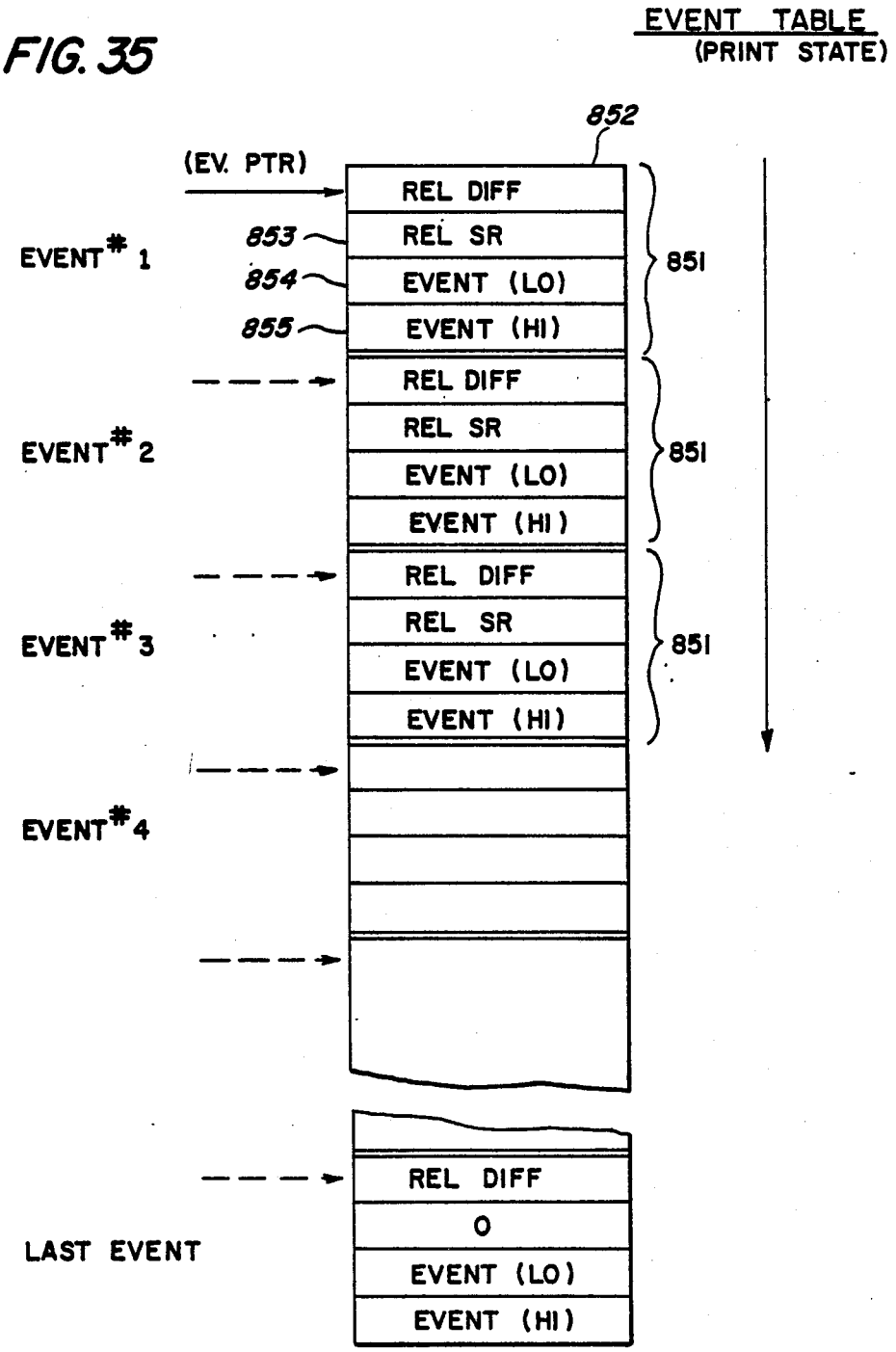
FIG. 35 is a view showing the event table layout.
Figure 36:
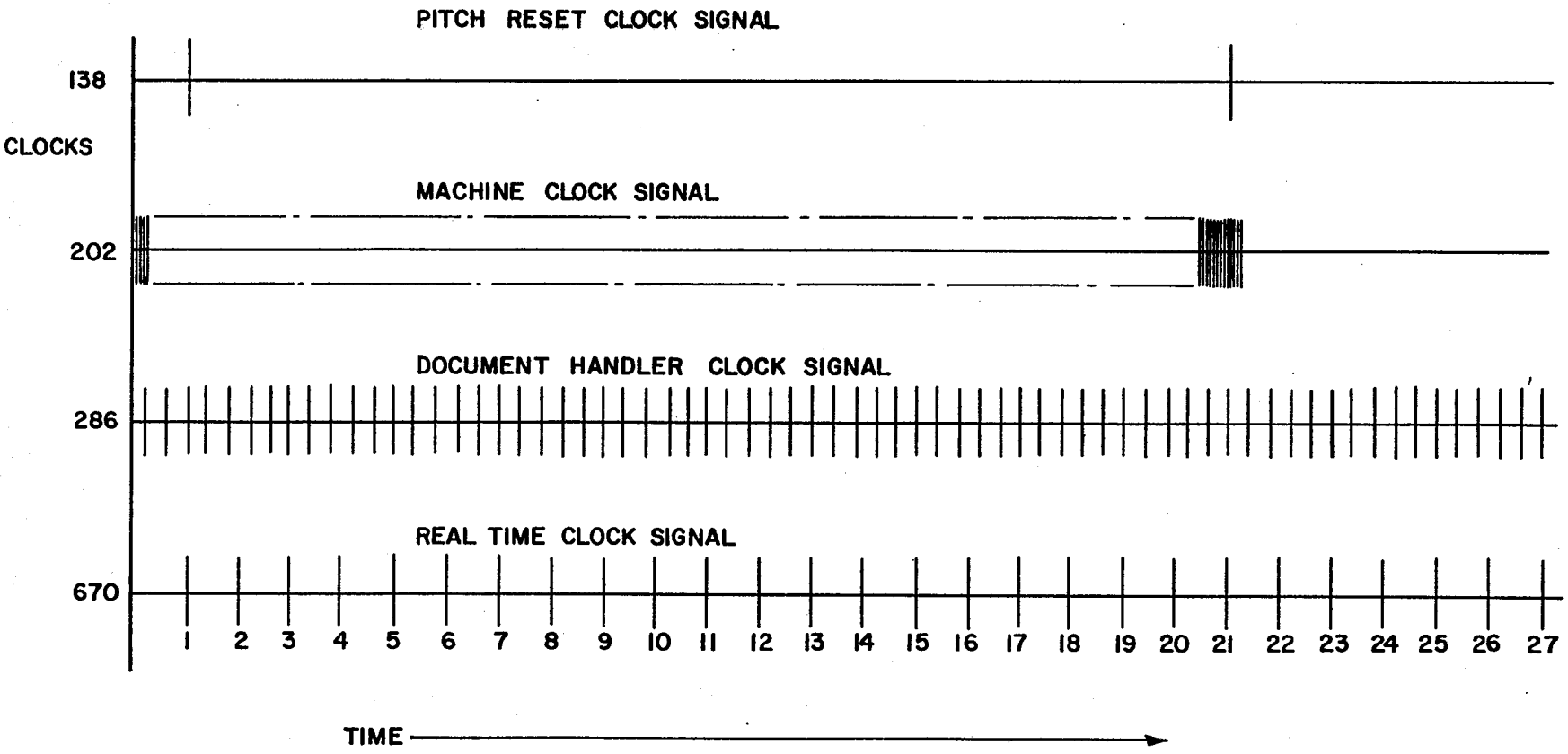
FIG. 36 is a chart illustrating the relative timing sequences of the clock interrupt pulses.
Figure 37:
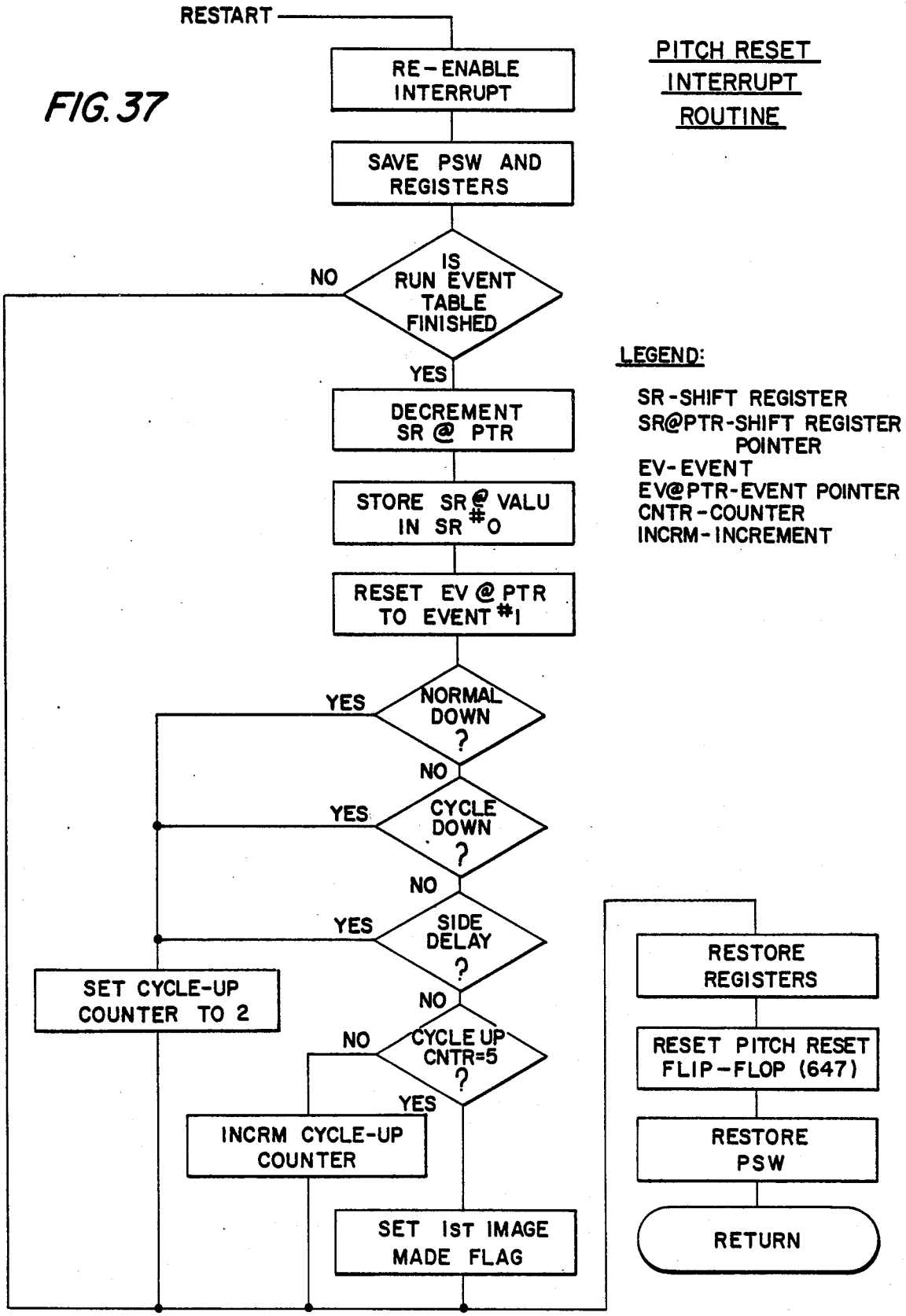
FIG. 37 is a flow charge of the pitch interrupt routine.

Referring particularly to FIG. 35, the Run Event Table consists of successive groups of individual events 851. Each event 851 is comprised of four data blocks, data block 852 containing the number of clock pulses (from machine clock 202) to the next scheduled pitch event (REL DIFF), data block 853 containing the shift register position associated with the event (REL SR), and data blocks 854, 855 (EVENT LO)(EVENT HI) containing the address of the event subroutine.

In machine states other than PRINT, data blocks 852, 853 (REL DIFF) (REL SR) are set to zero. Data blocks 854, 855 hold the address information for the Non-Print state event.

Control Data in the Run Event Table represents a portion of the foreground tasks and is transferred to the output buffer 546' of RAM memory section 546 by the Pitch Reset and Machine Clock interrupt routines. Other control data, representing foreground tasks not in the Run Event Table is transferred to RAM output buffer 546' by the Real Time Clock interrupt routine. Transfer of the remainder of the control data to output buffer 546' is by means of background (non-interrupt) routines.

Transfer of control data from output buffer 546' of RAM memory section 546 to the various locations in host machine 10 is through output Refresh via Direct Memory access (DMA) in response to machine clock interrupt signals as will appear. The interrupt routines are initiated by the respective interrupt signals.

Referring particularly to FIG. 23 and 35–37 and TABLES VII, VIII the interrupt having the highest priority, the Pitch Reset interrupt (signal 640), is operable only during the PRINT state, and occurs once each revolution of sheet register fingers 141 as responded to by sensor 146 of pitch reset clock 138. At each pitch reset interrupt signal, after a determination of priority of Priority Chip 659 in the event of multiple interrupt signals, an interrupt signal (INT) is generated. The acknowledgement signal (INTA) from processor 542 initiates the pitch reset interrupt routine.

On entering the pitch reset routine, the interrupt is re-enabled and the contents of the program working registers stored. A check is made to determine if building of the Run Event Table is finished. Also checks are made to insure that a new shift register schedules have been built and at least 910 clock counts since the last pitch reset have elapsed. If not, an immediate machine shutdown is initiated.

Presuming that the above checks are satisfactory, the shift register pointer (SR PTR), which is the byte variable containing the address of a pre-selected shift register position (SR O), is decremented by one and adjusted for overflow and the shift register contents are updated with a byte variable (SR+VALUV) containing the new shift register value to be shifted in following the pitch reset interrupt. The event pointer (EV*PTR), a two byte variable containing the full address of the next scheduled event, is reset to Event #1. The count in the C register equals the time to the first event.

Machine Cycle Down, Normal Down, and Side One Delay checks are made, and if negative, the count on a cycle up counter (CYC UP CT) is checked. If the count is less than a predetermined control count (i.e. 5), the counter (CYC UP CT) is incremented by one. With the count on the cycle up counter equals the control count, an Image Made Flag is set.

If a Normal Down, Cycle Down, or Side One Delay has been initiated, the cycle up counter (CYC UP CT) is reset to a preset starting count (i.e. 2). The pitch reset interrupt routine is exited with restoration of the working registers and resetting of pitch reset flip flop 647.

The Machine Clock Interrupt routine, which is second in priority, is operative in all operational states of host machine 10. Although nominally driven by machine clock 202, which is operative only during Print state when processor main drive motor 34 is energized, machine clock pulses are also provided by phase locked loop 649 when motor 34 is stopped.

Figure 38:
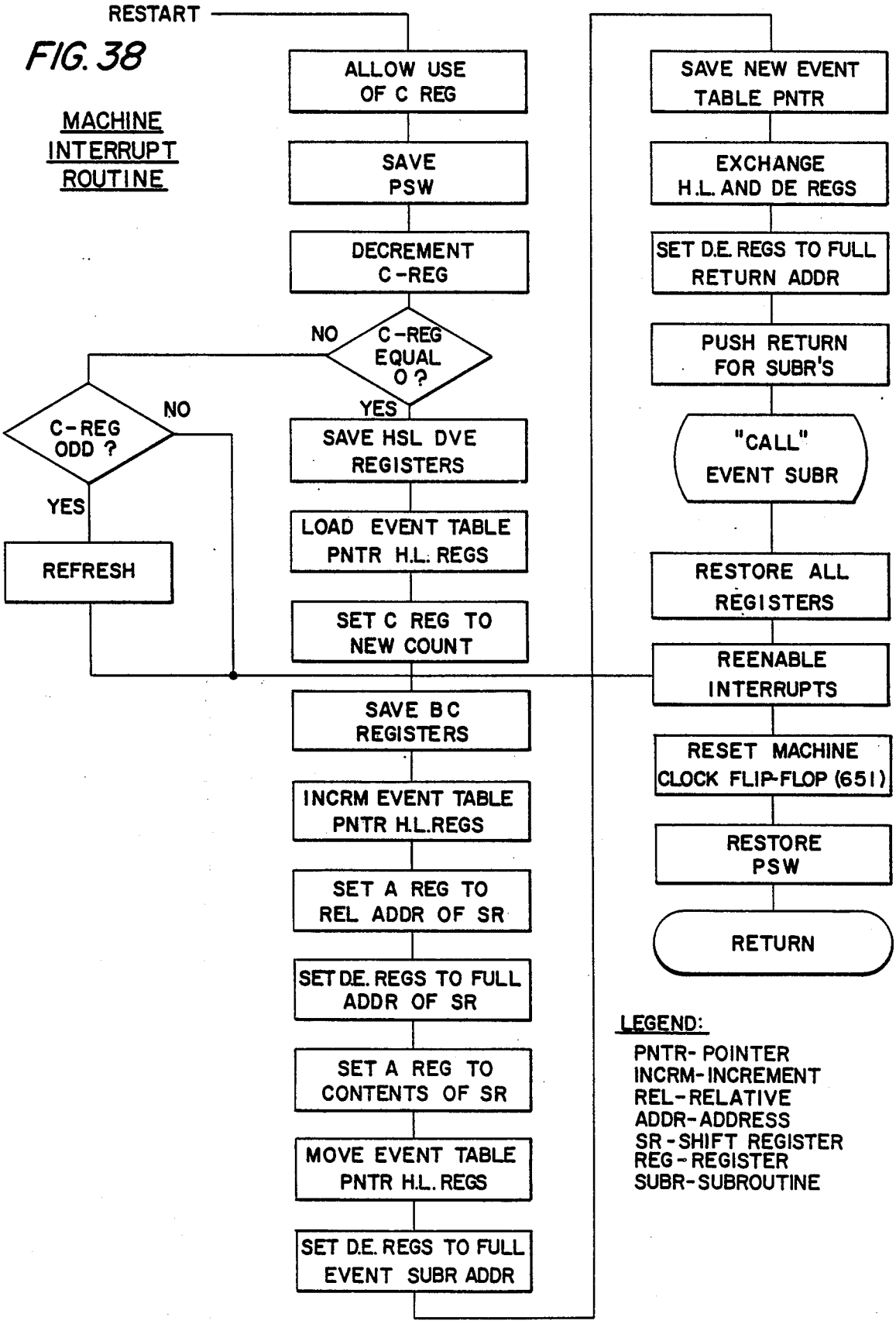
FIG. 38 is a flow chart of the machine clock interrupt routine.

Referring particularly to FIG. 38 and TABLE IX, entry to the Machine Clock interrupt routine there shown is by a signal (INTA) from processor 542 following a machine clock interrupt signal 642 as described earlier. On entry, the event control register (C REG) is obtained and the working register contents stored. The C REG is decremented by one, the register having been previously set to a count corresponding to the next event in the Event Run Table.

The control register (C REG) is checked for zero. If the count is not zero and is an odd number, an output refresh cycle is initiated to effect transfer/refresh of data in RAM output buffer 546' to host machine 10. If the number is even, or following an output refresh, the interrupt system is re-enabled, the machine clock interrupt flip flop 651 is reset and the working registers are restored. Return is then made to the interrupted routine.

If the control register (C REG) count is zero, the Event Pointer (EV*PTR), which identifies the clock count (in data block 852) for the next scheduled event (REL DIFF), is loaded and the control register (C REG) reset to a new count equal to the time to the next event. The Event Pointer (EV*PTR) is incremented to the relative shift register address for the event (REL SR, data block 853), and the shift register address information is set in appropriate shift registers (B, D, E, A registers).

The event Pointer (EV*PTR) is incremented successively to the event subroutine address information (EVENT LO) (EVENT HI) in the Event Run Table, and the address information therefrom loaded into a register pair (D & E registers). The Event Pointer (EV PTR) is incremented to the first data block (REL DIFF) of the next succeeding event in the Run Event Table, saved, and the register pair (H & L registers) that comprise the Event Pointer are loaded with the event subroutine address from the register pair (D & E registers) holding the information. The register pair (D & E registers) are set to the return address for the Event Subroutine. Using the address information, the Event Subroutine is called and the subroutine data transferred to RAM output buffer 546' for transfer to the host machine on the next Output Refresh.

Following this, the Machine Clock interrupt routine in exited as described earlier.

The Output Refresh cycle alluded to earlier functions, when entered, to transfer/refresh data from the output buffer of 546' RAM section 546 to host machine 10. Direct Memory Access (DMA) is used to insure a high data transfer rate.

On a refresh, Refresh Control 605 (see FIG. 23*b*) raises the HOLD line to processor 542, which on completion of the operation then in progress, acknowledges by a HOLD A signal. With processor 542 in a hold mode and Address and Data buses 507, 508 released to I/O Module 502 (through operation of tri-state buffers 510, 511, 563, 570), the I/O module then sequentially accesses the output buffer 546' of RAM section 546 and transfers the contents thereof to host machine 10. Data previously transferred is refreshed.

The Real Time Interrupt, which carries the lowest priority, is active in all machine states. Primarily, the interrupt acts as an interval timer by decrementing a series of timers which in turn serve to control initiation of specialized subroutines used for control and error checking purposes.

Figure 39A:
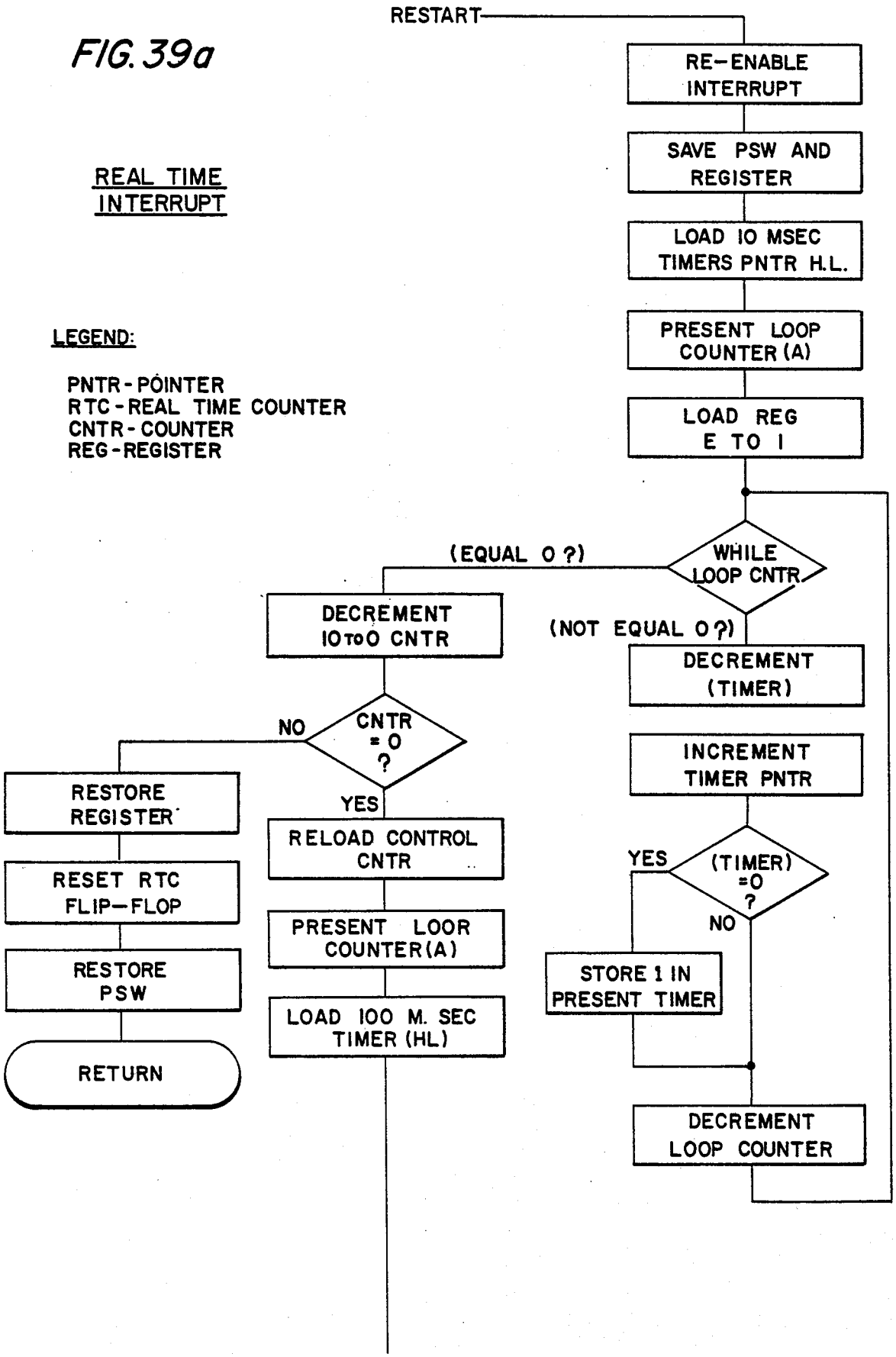
FIGS. 39*a* and 39*b* comprise a flow chart of the real time interrupt routines.
Figure 39B:
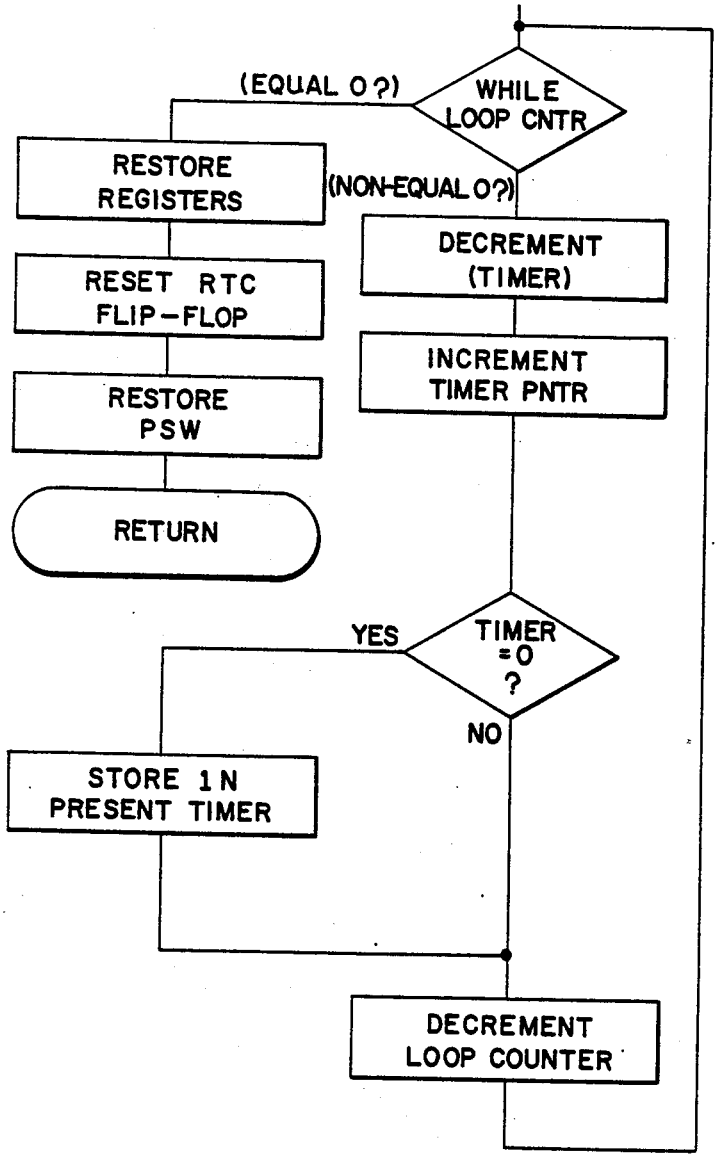

Referring particularly to FIG. 39(*a, b*) and TABLE X, the Real Time interrupt routine is entered in the same manner as the interrupt routines previously described, entry being in response to a specific RESTART instruction code assigned to the Real Time interrupt. On entry, the interrupt is re-enabled and the register contents stored. The timer pointer (PNTR) for the first class of timers (i.e. 10 msec TIMERS) is loaded, and a loop counter identifying the number of timers of this class (i.e. 10 msec TIMERS) preset. A control register (E REG) is loaded and a timer decrementing loop is entered for the first timer. The loop decrements the particular timer, increments the timer pointer (PNTR) to the location of the next timer in this class, checks the timer count, and decrements the loop counter. The decrementing loop routine is repeated for each timer in the class (i.e. 10 msec TIMERS) following which a control counter (CNTR) for the second group of timers (i.e. 100 msec TIMERS) is decremented by one and the count checked.

The control counter (CNTR) is initially set to a count equal to the number of times the first timer interval is divisible into the second timer interval. For example, if the first class of timers are 10 msec timers and the second timer class are 100 msec timers, the control counter (CNTR) is set at 10 initially and decremented on each Real Time interrupt by one down to zero.

If the count on the control counter (CNTR) is not zero, the registers are restored, Real Time interrupt flip flop 856 reset, and the routine exited. If the count on the control counter is zero, the counter is reloaded to the original maximum count (i.e. 10) and a loop is entered decrementing individually the second group of timers (i.e. 100 msec TIMERS). On completion, the routine is exited as described previously.

In the following TABLES:

"@"—is used to indicate flags, counters and subroutine names.

"#"—is used to indicate input signals.

"$"—is used to indicate output signals.

":"—is used to indicate macro instructions, system subroutines, system flags, and data, etc.

For further explanation of the mnemonics and particular instructions utilized by the following routines, the reader is directed to Intel Corporation's Programming Manual for the 8080 Microcomputer System.

TABLE 1

```
99                          *NAR
100                         *
101                         *     INITIALIZE STATE
102                         *
103                         *     INIT: SUBROUTINE
104                         *
105                         *     INITIALIZE STATE-Executed after each start or restart.  Sets
106                         *     all pointers, flags, and data to initial values required to
107                         *     start execution of any control algorithims.  Always exits to
108                         *     'not ready' state.

110                         *     EPILOG

112  05 00000 3E0A    A  INIT:  MVI   A,10
113  05 00002 3252FD  N         STA   DIVD:10          INITIALIZE TO 10
114  05 00005 32B5FC  N         STA   SLOWTOGL         INITIALIZE TO 10
115  05 0000B 211907  N         LXI   H,EV@STBY:       H&L=ADDR OF STBY EVENT TABLE
116  05 00008 2264FD  N         SHLD  EV@PTR:          SAVE FOR MACH CLK ROUTINE
117  05 0000E 21FFFF  A         LXI   H,X'FFFF'        INIT INSTRUMENTATION REMOTE
118  05 00011 2272FB  N         SHLD  INS@PTRB          ADDR PNTR TO END OF RAM
119  05 00014 21FFFF  N         LXI   H,ADH@R8MT-1     SET PNTR TO RAM CNTRL TABLE
120  05 00017 2278FB  N         SHLD  TAB@STRT         SAVE PNTR
121  05 0001A 3E7F    A         MVI   A,X'7F'          INIT TO UN-BYPASS
122  05 0001C 328DFC  N         STA   JAM@BYPS                          ALL JAM SWS
123                         *
124                         *     TIMER INITIALIZATION
125                         *     MUST BE DONE BEFORE ANY TIMERS CAN BE USED
126                         *
127  05 0001F 211FF9  A         LXI   H,AVAIL:**8+X'1F'  SET H&L TO END OF AVAIL: TABLE
128  05 00022 36FF    A         MVI   M,X'FF'          STORE X'FF' IN LAST TABLE ADDR
129  05 0024  3F1F    A         MVI   A,31             SET A-REG TO VALUE TO BE STORED
130                                REPEAT
131  05 00026 2D      A          DCR     L             STEP TO NEXT TABLE LOCATION
```

```
132  05 00027 77        A        MOV      M,A          STORE INITIALIZATION VALUE
133  05 00028 3D        A        DCR      A            STEP TO NEXT VALUE
134  05 00029 C22600    N       UNTIL: CC,Z,S           IS INITIALIZATION COMPLETE
135  05 0002C 2120FE    A       LXI    H,ADR(DATA,TIME:OUT)
                                                       TO INITIALIZE TIME:OUT TABLE
136  05 0002F 225FFD    N       SHLD   INPTR:          SET IN/OUT POINTERS TO
137  05 00032 2261FD    N       SHLD   OUTPTR:         BEGINNING OF TIME:OUT TABLE
138                        *
139                        *    INITIALIZE SPOOL
140                        *    POINTERS
141                        *
142  05 00035 2140FE    A       LXI    H,ADR(DATA,SPL:TBL)
                                                       SET PNTRS
143  05 00038 226AFD    N       SHLD   SPL:IN                 TO START
144  05 00038 226CFD    N       SHLD   SPL:OUT                        OF TABLE
145                        *
146                        *    CHECK IF PAPER WAS PRESENT WHEN POWER WENT DOWN
147                        *
148  05 0003E 3AC9E2    A       RNVNIB     NV@JAM@N    / =JAM INFO FROM POWER DOWN
149  05 00041 OF        A       RRC                    SET CARRY TO FDR JAM INFO
150  05 00042 D25A00    N       IF:    CC,C,S          WAS THERE PAPER IN FDR AREA
151  05 00045 47        A       MOV    B,A             YES, SAVE JAM INFO
152  05 00046 213CFD    A       SFBIT,P    FDR@AJAM,FDR@MJAM
                                                       SET FEEDER JAMS
     05 00049 3E0C      A
     05 0004B B6        A
     05 0004C 77        A
153  05 0004D 2121F9    A       SFBIT,P  ON@X@2,ON@X@3
                                                       SIGNAL TRANSPT CL'RANCE REQ'D
     05 00050 3E03      A
     05 00052 B6        A
     05 00053 77        A
154  05 00054 3E80      A        SFLG   CLR@REQD        TELL FLT HNDLR CL'RANCE REQD
     05 00056 3267F4    A
155  05 00059 78        A        MOV    A,B             RESTORE THE A-REG
156                             ENDIF
157  05 0005A 0F        A       RRC                    SET CARRY TO IMED@DN:
158  05 0005B D27100    N       IF:    CC,C,S          WAS THERE AN IMED@DN:
159                        *
160                              MVI    L,MSK(FBIT,L@PR@FLT,JAM2@FLT, JAM3@FLT,
                                        JAM4@FLT;
161  05 0005E 2EFF      A                JAM5@FLT, JAM6@FLT,RETI@FLT, RET2@FLT)
162                        *                           SETS ALL JAM FBITS IN REG-L
163  05 00060 2603      A        MVI          HM,SK(FBIT,SOS@JAM, MISSTRIP)
164                        *                           SETS ADDITIONAL FBITS IN H
165  05 00062 223BFD    A        SHLD   ADR(FBYT,PAPL:1)
                                                       MOVE FBITS INTO FBYTES
166  05 00065 3E80      A        SFLG   CLR@REQD        TELL FLT HNDLR CLEARANCE REQD
     05 00067 3267F4    A
167  05 0006A 2120F9    A        SFBIT,P      TS@FUS,TS@X@2
                                                       TURN ON UNDEDICATED MAP LAMPS
     05 0006D 3E21      A
     05 0006F B6        A
     05 00070 77        A
168                             ENDIF
169                             IF:    XBYT,A,AND,;    IS EITHER SRT JAM FLAG SET
170  05 00071 E60C      A                MSK(NVBIT,NV@LOW@J,NV@UP@J),NZ
                                                        IN NVNIB
     05 00073 CA8A0C    N
171                              IF:    XBYT,A,EQ,;     YES, ARE BOTH SET
172  05 00076 FE0C      A                NSK(NVBIT,NV@LOW@J,NV@UP@J)
     05 00078 C28300    N
173  05 00078 3E80      A            SFLG     TWO@ACT   TELL SRT THAT THERE WAS A JAM
     05 0007D 3261F4    A
174  05 00080 C38700    N        ELSE:
175  05 00083 0F        A            RRC                GET NW@LOW@J TO SIGN BIT &
176                                  ID:READ  NV@LOW@J
177  05 00084 3237F4    A            MODFLG  LOW@MOD    TELL SRT IF UP OR LOWJAM
178                              ENDIF
179  05 00087 CD0000    N        CALL   JAM@SET         LET SRT SET JAM FLAGS & LAMPS
180                              ENDIF
181  05 0008A 3E80      A        SFLG   SRT@RDY         SIGNAL SRT NOT IN USE (READY)
     05 0008C 328CF7    A
182  05 0008F 3287F7    A       MODFLG     PROG@RDY     SET PROG ROUTINE READY
183  05 00092 326BF4    A       MODFLG     2SD@ENAB     ALLOW SELECTION OF DUPLEX MODE
184  05 00095 3EF2      A       MVI    A,X'F2'          RE-ENABLE
185  05 00097 3200E6    A       STA    RSINTFF:                INTERRUPT
186  05 0009A FB        A       EI                                     SYSTEM
187  05 0009B CD0000    N       SOBIT,S      NPFO$ON,24V$SPL
                                                       PFO OFF (INVT'D) & 24V ON
     05 0009E 02        A
     05 0009F E480      A
     05 000A1 EE80      A
188  05 000A3 CD0000    N       STIMR  FLT@DLY,25000,FLT@CHK
```

```
                                                    START LENS FAULT TIMER
     05 000A6 12      A
     05 000A7 FA      A
     05 000A8 0000    N
189  05 000AA CD0000  N        CALL  D0C@CLR          INITIALIZE DOC@NUM TO 1 (1)
190  05 000AD 327AFC  N        STA   QF@DIGIT         ENABLE "0" IN QTY FLASHED (2)
191  05 000B0 3E08    A        MVI   A,MSK(FBIT,POP@RS)
                                                    TELL FLT ASSUME
192  05 000B2 32B6FC  N        STA   XP@PREV                BRUSH HOUSE OPN
193  05 000B5 3E02    A        MVI   A,:NRDY          INIT STCK
194  05 000B7 3254FD  N        STA   :STATE:          SYNCHRONIZED BACKGROUND
195  05 000BA 3253FD  N        STA   STATE!                 CONTROL LOOP
196  05 000BD CD3702  N        CALL  NRDY:PRL         INIT CONTROL TO NOT-READY STATE
198                        *
199                        *
200                        *   SYCRONIZED BACKGROUND CONTROL LOOPS
201                        *
202                        *

204                        *   PRIORTIES:
205                        *         FIRST            10MS TIME OUT REQUESTS
206                        *         SECOND           10MS CALLS
207                        *         THIRD            SPOOLED CALLS
208                        *         FOURTH           20 MS CALLS
209                        *         FIFTH            100MS CALLS
210                        *         SIXTH            100MS TIME OUT REQUESTS

212  05 000C0 2151FD  A        LXI   H,ADR(DATA,SB:RQST)     SET MEM PNTR TO SB BYTE
213                             REPEAT                        LOOP-3 FROM HLT ON
                                                              ALL INTER'S
214                                   REPEAT                  LOOP-2 BACK AFTER
                                                              EACH 100MS
215                                         REPEAT            LOOP-1 BACK AFTER
                                                              EACH 20MS
216  05 000C3 7E      A                     MOV        AM     A=SYNC BKGND REQUESTS
                                                              FROM RTC
217                                         ID:READ    SB:RQST
218  05 000C4 07      A                     RLC                TEST FOR 10MS
219  05 000C5 D2F700  N                     IF:        CC,CS          SB REQUEST
220                        *
221                        *                            TIMER SERVICE REQUESTS
222                        *                            CALLS TIMED OUT TIMER SUBRS
223                        *                            USING WRAP AROUND TABLE AND
224                        *                            IN/OUT PNTRS-RTCI SETS
225                        *                            INPTR: & ENTERS CALL ADDR
226                        *
227  05 000C8 3A5FFD  N              WHILE: XBYT,INPTR:,NE,OUTPTR:  ARE
                                          PNTRS AT SAME TABL
     05 000CB 2161FD  N
     05 000CE BE      A
     05 000CF CAE500  N
228  05 000D2 6E      A                     MOV   L,M      SET L-REG TO ADDR(L) IN TABLE
229  05 000D3 26FE    A                     MVI   H,HADR(DATA,TIME:OUT)
                                                          MEM PNTR NOW SET TO
230  05 000D5 5E      A                     MOV   E,M      MOVE CALL ADDR(L) TO E
231  05 000D6 23      A                     INX   H        STEP TO NEXT TABLE BYTE
232  05 000D7 56      A                     MOV   D,M      MOVE CALL ADDR(H) TO D
233  05 000D8 23      A                     INX   H        STEP TO NEXT TABLE BYTE
234  05 000D9 7D      A                     MOV   A,L      PREPARE TO UPDATE PNTR
235                                        ID:READ   TIME: OUT
                                                          DYNAMIC TABLE CONTAINING ADDRS
236                                        MODBYT    A,AND,;
                                                          ADJUST FOR END OF TABLE
237  05 000DA E62F    A                          TIME:MSK
238  05 000DC 3261FD  A                     STA   ADR(DATA,OUTPTR:)
                                                          PNTR TO ADDR OF LAST SE
239  05 000DF CD0000  N                     CALL  DE:IND          DO TIMEOUT CALL
240  05 000E2 C3C800  N              ENDWHILE                     YES, ALL TIME BUTS SERVICED
241                        *                                     END TIMER SECTION
242  05 000E5 2A55FD  N              LHLD   10:CALLS              GET PROPER 10MS CALL TABLE
243  05 000E8 CD0000  N              CALL   HL:IND                DO 10MS CALLS
244  05 000EB 215!FD  A              LXI    H,ADR(DATA,SB:RQST)SET MEM PNTR TO SB BYTE
245  05 000EE F3      A              DI
246  05 000EF 7E      A             MODBYT M,AND, 10:RQST REMOVE 10MS REQUEST
     05 000F0 E67F    A
     05 000F2 77      A
247                                 ID:ALTR    SB:RQST
248  05 000F3 FB      A               EI                 (WATCH OUT FOR UNPRINTABLE NOT)
249  05 000F4 C31501  N               ELSE:              DO ANY SPOOLED ROUTINES
250  05 000F7 3A6AFD  N                   IF:    XBYT,SPL:IN,NE,SPL:OUT
     05 000FA 216CFD  N
     05 000FD BE
     05 000FE CA1101  N
251  05 00101 6E      A                     MOV    LM,
252  05 00102 26FE    A                     MVI    H,HADR(DATA,SPL:TBL)
253  05 00104 5E      A                     MOV    E,M
254  05 00105 23      A                     INX    H
255  05 00106 56      A                     MOV    D,H
256  05 00107 23      A                     INX    H
```

```
05 00108 7D      A                MOV    A,L
05 00109 E64F    A              MODBYT  A,AND,SPL:MSK
05 0010B 326CFD  A                STA    ADR(DATA,SPL:OUT)
05 0010E CD0000  N                CALL   DE:INK
                               ENDIF
05 00111 2151FD  A             LXI    H,ADR(DATA,SB:RQST)
05 00114 7E      A             MOV    A,M
                          END IF
                          ID:READ   SB:RQST
05 00115 07      A        RLC
05 00116 07      A        RLC                    TEST FOR 20MS
05 00117 D24201  N        IF:      CC,C,S                    SB REQUEST
05 0011A 2A59FD  N             LHLD   20PNTR    SET MEM PTR TO CALL IN 20MS TAB
05 0011D 5E      A             MOV    E,M       MOVE CALL ADDR(L) TO E
05 0011E 23      A             INX    H         STEP MEM PTR TO ADDR(H)
05 0011F 7E      A             IF:    XBYT,M,EQ,X'FF' IS POINTER AT END OF TABLE
05 00120 FEFF    A
05 00122 C23701  N
05 00125 2A57FD  N              LHLD    20:PNTR YES, SET MOVING POINTER
05 00128 2259FD  N              SHLD    20PNTR BACK TO BEGINNING OF TABLE
05 0012B 2151FD  A              LXI     H,ADR(DATA,SB:RQST)     SET MEM PNTR TO
05 0012E F3      A              DI
05 0012F 7E      A              MODBYT M,AND,20:RQST REMOVE 20MS REQUEST
05 00130 E6BF    A
05 00132 77      A
                                ID:ALTR  SB:RQST
05 00133 FB      A              EI
05 00134 C34201  N              ELSE:
05 00137 56      A              MOV     D,M     NO, MOVE CALL ADDR(H) TO D
05 00138 23      A              INX     H       STEP TO NEXT CALL IN TABLE
05 00139 2259FD  N              SHLD    20PNTR SAVE FOR NEXT LOOP-1
05 0013C CD0000  N              CALL    DE:IND
05 0013F 2151FD  A              LXI     H,ADR(DATA,SB:RQST) SET MEM PNTR TO SB BY
                               ENDIF
                          ENDIF
05 00142 7E      A        UNTIL: XBYT,M,AND,20:RQST,Z  MORE 20MS CALLS TO DO (LOOP-1)
05 00143 E640    A
05 00145 C2C300  N
                          ID:READ   SB:RQST
05 00148 7E      A        IF:      XBYT,M,AND,100:RQST,NZ TEST FOR 100MS SB REQUEST
05 00149 E620    A
05 0014B CA9E01  N
                           ID:READ  SB:RQST
05 0014E 2A5DFD  N         LHLD     100PNTR      SET MEM PNTR TO CALL IN 100 TAB
05 00151 5E      A         MOV      E,M          MOVE CALL ADDR(L) TO E
05 00152 23      A         INX      H            STEP MEM PNTR TO ADDR(H)
05 00153 7E      A         IF:      XBYT,M,EQ,X'FF'
                                                  IS PNTR AT END OF TABLE
05 00154 FEFF    A
05 00156 C29301  N
05 00159 2A5BFD  N             LHLD     100:PNTR YES, SET MOVING PNTR BACK
05 0015C 225DFD  N             SHLD     100PNTR TO BEGINNING OF TABLE
                      *
                      *                           100MS TIMER SERVICE
                      *                           DECREMENTS TIMERS AND CALLS
                      *                           SUBROUTINE REQUESTED WHEN
                      *                           TIMER TIMES OUT
                      *                           USES 3 TABLES ON 3 CONSECUTIVE
                      *                           RAM PAGES-100:CNT W/TIMER
                      *                                     -100:LS W/ADDR(L)
                      *                                     -100:LS W/ADDR(H)
                      *                           ADDR IS FOR REQSTED SUBR
                      *
05 0015F 2130FA  N             LXI    H,100:CNT  STARTING ADDR OF 100MS TIMERS
05 00162 1614    A             MVI    D,100:TMAX D-REG SET TO QTY OF 100MS TMRS

                      *                           CONDITIONAL HOLD OF 100MS TMRS

05 00164 3A45FD  A             IF:      FBIT,STDBC PN@,T
                                                  IS STAND BY RELAY OPEN
05 00167 E640    A
05 00169 CA6E0.  N
                                MVI  D,100:TMAX,   YES, HOLD SPECIFIED NUMBER
05 0016C 1611    A                  -HOLDTMRS            OF TIMERS
                               ENDIF
                      *
                               REPEAT                LOOP TO DECR & SERVICE TIMEOUTS
05 0016E 7E      A                IF:   VBYT,M,NZ IS TIMER ACTIVE
05 16F   A7      A
05 00170 CA820   N
05 00173 35      A                  DCR   M    DECR TIMER
05 00174 C28201  N                  IF:    CC,Z,S        HAS TIMER TIMED OUT
05 00177 D5      A                    PUSH    D          SAVE # TIMERS TO SERVICE
05 00178 E5      A                    PUSH    H          SAVE ADDR OF CURRENT TIMER
05 00179 24      A                    INR     H          STEP TO NEXT RAM PAGE
05 0017A 5E      A                    MOV     E,M        MOVE CALL ADDR(L) TO E
05 0017B 24      A                    INR     H          STEP TO NEXT RAM PAGE
05 0017C 56      A                    MOV     D,M        MOVE CALL ADDR(H) TO D
05 0017D CD0000  N                    CALL    DE:IND
```

```
05 00180 E1      A                POP    H          RECALL ADDR OF
                                                    CURRENT TMR
05 00181 D1      A                POP    D          RECALL NUMBER OF TIMERS
                *                                   YET TO BE SERVICED
                                ENDIF
                               ENDIF
05 00182 23      A               INX    H     STEP TO NEXT TIMER ADDR
05 00183 15      A               DCR    D     DECR NUMBER OF 100MS TIMERS
04 00184 C26E01  N             UNTIL:  CC,Z,S HAVE ALL TIMERS BEEN SERVICED
                *                                   END 100MS TIMER SECTION
05 00187 2151FD  A             LXI     H,ADR(DATA,SB:RQST)
                                                    SET MEM PNTR TO SB BYTE
05 0018A F3      A             DI
05 0018B 7E      A             MODBYT  M,AND 100:RQST   REMOVE 100MS REQUEST
05 0018C E6DF    A
05 0018E 77      A
                                ID:ALTR  SB:RQST
05 0018F FB      A             FI
05 C0190 C39E01  N           ELSE:
05 00193 56      A             MOV     D,M        NO, MOVE CALL ADDR(H) TO D
05 00194 23      A             INX     H          STEP PNTR TO NEXT CALL
05 00195 225DFD  N             SHLD    100PNTR    SAVE FOR NEXT LOOP-2
05 00198 CD0000  N               CALL     DE:INK
05 0019B 2151FD  A               LXI      H,ADR(DATA,SB:RQST)
                                                    SET MEM PNTR TO SB BYTE
                                ENDIF
                               ENDIF
05 0019E 7E      A           UNTIL:   VBYT,M,Z      MORE SB CALLS TO DO (LOOP-2)
05 0019F A7      A
05 001A0 C2C300  N
                             ID:READ   SB:RQST
05 001A3 76      A           HLT                    COOL IT UNTIL INTERRUPT
                                                    RESTART
05 001A4 CAC3000 N       UNTIL:   CC,Z,C            WAS INTERRUPT RTC (LOOP-3)
05 001A7 F3      A       DI                         ONLY KIDDING BEFORE,
                                                    BUT THIS
05 001A8 76      A       HLT                        TIME REALLY STOP (ABORT)
                *
                *       SUBR TO SET CALL TABLE POINTERS
                *       CALLED BY EACH STATE PROLOG
                *
                *       POSITION SB:TABLE POINTER
                *
05 001A9 3A53FD  N  SB:PNTRS     LDA  STATE:        WHAT STATE IS WANTED
05 001AC 110600  A               LXI  D,X'06'       LOAD D&E WITH SKIP NUMBER
05 001AF 21D501  N               LXI  H,SB:TABLE-X'06'
                                                    H&L=6<' TABLE ADDR
                                 REPEAT
05 001B2 19      A                DAD     D         SKIP THREE WORDS
05 001B3 3D      A                DCR     A         DECR STATE LOOP COUNTER
05 001B4 F2B201  N               UNTIL:  CC,S,S     'S POINTER AT CORRECT STATE
                *
                *                TRANSFER ADDRS TO VARIABLE SB POINTERS
                *
05 001B7 1155FD  N               LXI     D,10:CALLS SET D&E TO FIRST OF SB POINTERS
05 001BA 0602    A               MVI     B,2        LOAD 10:CALLS
05 001BC CDCE01  N               CALL    MV:WORDS   & 20:PNTR
05 001BF 2B      A               DCX     H          ADJUST 'FROM' PNTR
05 001C0 2B      A               DCX     H          BACK 1 WORD
05 001C1 0602    A               MVI     B,2        LOAD 20PNTR
05 001C3 CDCE01  N               CALL    MV:WORDS   & 100:PNTR
05 001C6 2B      A               DCX     H          ADJUST 'FROM' PNTR
05 001C7 2B      A               DCX     H
05 001C8 CDCC01  N               CALL    MV:WORD  LOAD 100PNTR
                                 ID:ALTR 10:CALLS,20:PNTR,20PNTR,:
                                                    DATA WORD MODIFIED
                                         100:PNTR,100PNTR   BY THIS SUBR
05 001CB C9      A               RET
                *NAR
                *
                *       MV:WORD/MV:WORDS SUBROUTINES
                *
                *       SUBR TO TRANSFER WORDS (2BYTES) FROM MEMORY POINTED
                        TO BY <H&L>
                *       TO MEMORY POINTED TO BY<D&E>CALL MV:WORD FOR 1 TRANSFER
                *       AND CALL MV:WORDS (WITH B-REG # WORDS TO TRANSFER) FOR
                *       MULTIPLE TRANSFERS, USES ALL BUT C-REG.
                *
05 001CC0601     A  MV:WORD   MVI        B,1        B = # WORDS TO BE MOVED
                    MV:WORDS REPEAT
05 001CE 7E      A               MOV     A,M        A = 1ST 'FROM' BYTE
05 001CF 12      A               STAX    D          STORE IN 1ST 'TO' LOCATION
05 001D0 23      A               INX     H          ADVANCE 'FROM'
05 001D1 13      A               INX     D          AND 'TO' PNTRS
05 001D2 7E      A               MOV     A,M        A = 2ND 'FROM' BYTE
05 001D3 12      A               STAX    D          STORE IN 2ND 'TO' LOCATION
05 001D4 23      A               INX     H          ADVANCE 'FROM'
05 001D5 13      A       INX     D                  AND 'TO' PNTRS
05 001D6 05      A               DCR     B          DECRM # OF WORDS CNTR
```

```
05 001D7 C2CE01 N          UNTIL  CC,Z,S          LOOP UNTIL ALL WORDS
                                                  TRANSFERRED
05 002DAC9      A          RET
                     *
                     *     TABLE OF SB CALL POINTERS
                     *     FOR EACH STATE
                     *
05 001DB 0906   N  SB:TABLE DW      COMP10
05 001DD 0A06   N           DW      COMP20
05 001DF 1206   N           DW      COMP100
05 001E1 B105   N           DW      TREP10
05 001E3 B505   N           DW      TREP20
05 001E5 C305   N           DW      TREP100
05 001E7 4202   N           DW      NRDY10
05 001E9 4602   N           DW      NRDY20
05 001EB 5202   N           DW      NRDY100
05 001ED AE02   N           DW      RDY10
05 001EF B302   N           DW      RDY20
05 001F1 BF02   N           DW      RDY100
05 001F3 AB03   N           DW      PRNT10
05 001F5 B203   N           DW      PRNT20
05 001F7 C803   N           DW      PRNT100
05 001F9 1905   N           DW      RUNN10
05 001FB 1D05   N           DW      RUNN20
05 001FD 2F05   N           DW      RUNN100
                     *
                     *     SUBR TO DO EPILOGS & PROLOGS LAST CALL IN EVERY 100MS
                           TABLE
                     *
05 001FF 2153FD A  STAT:CHG   LXI    H,ADR(DATA,STATE:)
                                                  A=PRESENT STATE # IF UNCHANGED
05 00202 7E     A             MOV    A,M          OR NEXT STATE IF CHANGED
05 00203 23     A             INX    H            H&L=ADDR 'FORMER STATE'GLOBAL
05 00204 BE     A             IF:    XBYT,A,NE,M
                                                  HAS THERE BEEN A STATE CHANGE
   05 00205 CA3602 N
                                ID:READ   STATE:,:STATE:
05 00208 46     A               MOV      B,M   YES, B+FORMER STATE
05 00209 77     A               MOV       M,A  UPDATE 'FORMER' TO 'PRESENT'
                                ID:ALTR  :STATE:
05 0020A 78     A               CASE:    VBYT,B
                                                  DO EPILOG FOR FORMER STATE
   05 0020B 111F02 N
   05 0020E FE06   A
   05 00210 CD0000 N
05 00213 1806   N                 C,O  COMP:EPL     COMPONENT CONTROL STATE
05 00215 DB05   N                 C,1  TREP:EPL     TECH REP STATE
05 00217 7A02   N                 C,2  NRDY:EPL     NOT READY STATE
05 00219 E302   N                 C,3  RDY:EPL      READY STATE
05 0021B E603   N                 C,4  PRNT:EPL     PRINT STATE
05 0021D 4105   N                 C,5  RUNN:EPL     SYSTEM RUNNING,
                                                    NOT PRINT STATE
                               ENDCASE
05 0021F 3A53FD N              CASE:  VBYT,STATE:   DO PROLOG FOR
                                                    PRESENT STATE
   05 00222 113602 N
   05 00225 FE06   A
   05 00227 CD0000 N
05 0022A FF05   N                 C,0  COMP:PRL     COMPONENT CONTROL STATE
05 0022C A505   N                 C,1  TREP:PRL     TECH REP STATE
05 0022E 3702   N                 C,2  NRDY:PRL     NOT READY STATE
05 00230 A602   N                 C,3  RDY:PRL      READY STATE
05 00232 1603   N                 C,4  PRNT:PRL     PRINT STATE
05 00234 0B05   N                 C,5  RUNN:PRL     SYSTEM RUNNING, NOT PRINT
                                                    STATE
                             ENDCASE
                           ENDIF
05 00236 C9     A          RET                      RETURN TO 100 MSEC
                                                    SYNC BKGD
                     *NAR
                     *
                     *     NOT READY STATE
                     *
                     *     NOT READY STATE-EXECUTES AFTER INITIALIZE UNTIL
                           ALL READY CONDITIONS
                     *     ARE MET.  THIS STATE CAN ALSO BE ENTERED FROM
                           'RUN NOT PRINT', 'READY'
                     *     AND 'TECH REP'.  CONTROL EXITS TO EITHER 'READY' OR
                           'TECH REP' STATES.

                     *     PROLOG

05 00237 CDA901 N  NRDY:PRL
                           CALL   SB:PNTRS          SYNC BKG PNTRS TO NEW STATE
05 0023A CD0000 N          STIMR  INST@TRM,100),NEXT@FLT
                                                    UPDATES INST FLT CODE IN STBY
   05 0023D 49     A
   05 0023E 64     A
   05 0023F 0000   N
```

```
475  05 00241 C9       A        RET

477                       *     CALLS FOR NOT READY 10 MS SYN BACKGROUND

479  05 00242 CD0000   N  NRDY10  CALL  ADH@CTRL
480  05 00245 C9       A        RET

482                       *     CALLS FOR NOT READY 20 MS SYN BACKGROUND

484  05 00246 0000     N  NRDY20
                               DW        NRDY@SWS
485  05 00248 0000     N        DW        MN@ELV@S
486  05 0024A 0000     N        DW        DSPL@CTL
487  05 0024C 0000     N        DW        LMP@CTL
488  05 0024E 0000     N        DW        INSTRU
489  05 00250 FFFF     A        DW        X'FFFF'        END OF TABLE

491                       *     CALLS FOR NOT READY 100 MS SYN BACKGROUND

493  05 00252 0000     N  NRDY100
                               DW        NRILK@CK
494  05 00254 0000     N        DW        RED@BGND
495  05 00256 0000     N        DW        DVL@DUMP
496  05 00258 0000     N        DW        RECAPER
497  05 0025A 0000     N        DW        BIN@CHK        1
498  05 0025C 0000     N        DW        MINIPHSI       2
499  05 0025E 0000     N        DW        BIL@JMPO
500  05 00260 0000     N        DW        FUS@RDUT
501  05 00262 0000     N        DW        FLT@100        1
502  05 00264 0000     N        DW        FLT@CTRL       2
503  05 00266 0000     N        DW        FLT@CLRN       3
504  05 00268 0000     N        DW        PROG2SJM
505  05 0026A 0000     N        DW        2SD@STBY
506  05 0026C 0000     N        DW        XMM@STBY
507  05 0026E 0000     N        DW        JAM@RST
508  05 00270 0000     N        DW        KEY@CNTR
509  05 00272 0000     N        DW        TST@LP4
510  05 00274 8402     N        DW        NRDY:CHG       TEST IF OK TO
511  05 00276 FF01     N        DW        STAT:CHG             LEAVE NOT READY
512  05 00278 FFFF     A        DW        X'FFFF'        END OF TABLE

514                       *     EIILOG

516  05 0027A CD0000   N  NRDY:EPL
                               COBIT,S   WAIT$          INSURE WAIT OFF AT NRDY EXIT
     05 0027D E9FE     A
517  05 0027F AF       A        CFLG      STRT:PRT       DISABLE TRANSFER TO 'PRINT'
     05 00280 325BF4   A
518  05 00283 C9       A        RET
520                       *
521                       *     SUBR FOR 'NOT READY' 100MS SYNC BKGND
522                       *     TESTS FOR CHANGE TO 'READY' OR 'TREP REP'
523                       *
524  04 00284 CDDF05   N  NRDY:CHG
                               CALL      TREP:CHG       TEST FOR STATE CHANGE TO :TREP
525  05 00287 7E       A        IF:       XBYT,M,NE,:TREP  DID IT CHANGE TO :TREP STATE
     05 00288 FE01     A
     05 0028A CA9302   N
526                                ID:READ   STATE:
527  05 0028D CD9402   N           CALL      RDYTEST:     TEST ALL 'READY' FLAGS
528  05 00290 CD0B03   N           CALL      NRDY:RDY     MOVE TO EITHER :NRDY OR :RDY
529                               ENDIF
530  05 00293 C9       A        RET

532                       *
533                       *     SUBR TO TEST ALL 'READY' FLAGS IN A LOOP
534                       *
535  05 00294 2184F7   A  RDYTEST:
                               LXI     H,RDYFLGS:       H&L=START ADDR OF READY FLAGS
536  05 00294 2184F7   A        MVI     B,RDYFNUM:       B=# OF READY FLAGS TO CHK
537                               REPEAT
538  05 00299 7E       A           MOV       A,M          A=<PRESENT READY FLAG>
539  05 0029A 07       A           RLC                    SET C IF FLAG SET (READY)
540  05 0029B DAA002   N           IF:       CC,C,C       IS PRESENT FLAG INDICATING RDY
541  05 0029E 0601     A                MVI    B,1        NO, DONT TEST ANY FURTHER
542                                ENDIF
543  05 002A0 23       A           INX       H            MOVE TO NEXT FLAG LOCATION
544  05 002A1 05       A           DCR       B            DECRM LOOP CNTR (# READY FLAGS)
545  05 002A2 C29902   N        UNTIL:  CC,Z,S             LOOP UNTIL ALL FLAGS CHKED
546                               ID:READ LENS@RDY,ELV@RDY,FUS@RDY,;
                                                          FLAGS READ
547                                      PROG@RDY,ILCK@RDY, XMM@RDY,;
548                                      FLT@RDY, ADH@NMOV, SRT@RDY
549  05 002A5 C9       A        RET                        RETURN

551                       *NAR
552                       *
553                       *     READY STATE
554                       *
```

```
555                     *     READY STATE-EXECUTES WHEN MACHINE IS READY TO
                              GO INTO PRINT STATE.
556                     *     CONTROL CAN GO BACK TO 'NOT READY' OR GO TO
                              'TECH REP' IF REQUIRED.

558                     *     PROLOG

560  05 002A6 CD0000 N  RDY:PRL
                              SOBIT,S       READY$
     05 002A9 E701     A
561  05 002AB CDA901 N        CALL          SB:PNTRS      SYNC BKG PNTRS TO NEW STATE
562  05 002AE C9       A      RET

564                     *     CALLS FOR READY 10MS SYN BACKGROUND

566  05 002AF CD0000 N  RDY10 CALL          ADH@CTRL
567  05 002B2 C9A             RET

569                     *     CALLS FOR READY 20MS SYN BACKGROUND

571  05 002B3 0000     N  RDY20DW           RDY@SWS
572  05 002B5 0000     N        DW          MN@ELV@S
573  05 002B7 0000     N        DW          DISPL@CTL
574  05 002B9 0000     N        DW          LMP@CTRL
575  05 002BB 0000     N        DW          INSTRU
576  05 002BD FFFF     A        DW          X'FFFF'       END OF TABLE

578                     *     CALLS FOR READY 100MS SYN BACKGROUND

580  05 002BF 0000     N  RDY100
                              DW          BIN@CHK       1
581  05 002C1 0000     N        DW          MINIPH51      2
582  05 002C3 0000     N        DW          BIL@JMFO
583  05 002C5 0000     N        DW          DVL@DUMP
584  05 002C7 0000     N        DW          RECAPER
585  05 002C9 0000     N        DW          FUS@RDUT
586  05 002CB 0000     N        DW          FLT@100   1
587  05 002CD 0000     N        DW          FLT@CTRL  2
588  05 002CF 0000     N        DW          NRILK@CK
589  05 002D1 0000     N        DW          RED@BGND
590  05 002D3 0000     N        DW          2SD@STBY
591  05 002D5 0000     N        DW          XMM@STBY
592  05 002D7 0000     N        DW          JAM@RST
593  05 002D9 0000     N        DW          KEY@CNTR
594  05 002DB 0000     N        DW          TST@LP4
595  05 002DD E902     N        DW          RDY:CHG       TEST IF OK TO
596  05 002DF FF01     N        DW          STAT:CHG              LEAVE READY
597  05 002E1 FFFF     A        DW          X'FFFF'       END OF TABLE

599                     *     EPILOG

601  05 002E3 CD0000 N  RDY:EPL
                              COBIT,S       READY$
     05 002E6 E7FE     A
602  05 002E8 C9       A      RET

604                     *     CHANGE OF STATE ROUTINES

606                     *

607                     *     SUBR FOR 'READY' 100MS SYNC BKGND
608                     *     TESTS FOR CHANGE TO "NOT READY' OR 'TECH REP'
609                     *
610  05 002E9 CDDF0: N  RDY:CHG
                              CALL        TREP:CHG      TEST FOR STATE CHANGE TO :TREP
611  05 002EC 7E       A      IF:         XBYT,M,NE,:TREP
                                                        DID IT CHANGE TO :TREP STATE
     05 002ED FE01     A
     05 002EF CA0A03 N
612                                ID:READ   STATE:
613  05 002F2 CD9402 N             CALL      RDYTEST:
                                                        TEST ALL 'READY' FLAGS
614  05 002F5 CD0B03 N             CALL      NRDY:RDY
                                                        MOVE TO EITHER :NRDY OR :RDY
615  05 002F8 3A5BF4 A             IF:       FLG,STRT:PRT,T
                                                        IS START PRINT REQUESTED
     05 002FB 07       A
     05 002FC D20A03 N
616  05 002FF 2153FD   A             LXI     H,ADR(DATA,STATE:)
                                                        SET MEMPNTR
617  05 00302 7E       A             IF:     XBYT,M,EQ,:RDY
                                                        OK TO GO TO PRINT
     05 00302 FE03     A
     05 00305 C20A03 N
618                                   ID:READ  STATE:
619  05 00308 3604     A              MVI     M:PRNT    CHANGE TO PRT STATE
620                                   ID:ALTR  STATE:
612                               ENDIF
622                            ENDIF
```

```
623                                ENDIF
624  05 0030A C9        A         RET

626                        *
627                        *     SUBR TO USE INFO FROM 'RDYTEST' AND EXECUTE
                                 THE PROPER CHANGE OF STATE
628                        *
629  05 0030B 2153FD    A  NRDY:RDY
                                 LXI        H,ADR(DATA,STATE:)
                                                    SET MEM PNTR
630  05 0030E 3603      A         MVI        M,:RDY     ASSUME GOING TO 'READY' STATE
631                               ID:ALTR    STATE:
632  05 00310 DA1503    N         IF:        CC,C,C     ARE ALL 'READY' FLAGS SET
633  05 00313 3602      A                MVI    M,:NRDY  NO, MOVE TO 'NOT READY' STATE
634                                        ID:ALTR  STATE:
635                               ENDIF
636  05 00315 C9        A         RET

638                        *NAR
639                        *
640                        *     PRINT STATE
641                        *
642                        *     PRINT STATE-EXECUTES WHILE MACHINE IS PRODUCING COPIES,
643                        *     ENTERED FROM 'READY' AND EXITS TO 'RUN NOT PRINT'.

645                        *     PROLOG

647  05 00316 2160FE    N  PRNT:PRL
                                 CLR:MEM    16,SHIFTREG        CLEAR SHIFT REGISTER
     05 00319 0610      A
     05 0031B CD0000    N
648  05 0031E 3E60      A         MVI        A,LADR(DATA,SHIFTREG)
                                                    FORCE SHIFT REG TO START AT
649  05 00320 3263FD    A         STA        ADR(DATA,SR@PRT:) BEGINNING OF SHIFTREG TABLE
650                               CLR:MEM    SD1@DLY-TIME@DN:+1,)
                                                    CLEAR THE FOLLOWING FLAGS
651  05 00323 21A7F4    A                    ADR(FLG,TIME@DN:)
     05 00326 0609      A
     05 00328 CD0000    N
652                               ID:CLR     TIME@DN:,IME)@DN:,'
653                                          CYCL@DN:, NORM@DN:,QWIK:OUT,:
654                                          IMGMADE:,SD1@TIMO,SLD1@DLY
655  05 0032B 3E80      A         SFLG       910@DONE           ALLOW FIRST PITCH RESET
     05 0032D 326FF4    A
656  05 00330 AF        A         XRA        A
657  05 00331 3266FD    N         STA        CYCUPCT:   INIT CYCLE-UP CNTR TO 0
658  05 00334 3269FD    N         STA        SR@VALU:   INIT 'NEW SR VALUE' TO 0
659  05 00337 325DFA    N         STA        PLL@INFO   INIT PLLSHUTDOWN CONTROL TO 0
660  05 0033A 3268FD    D         STA        SMPL@CT:   INIT SAMPLE COPY CNTR TO 0
661  05 0033D 3E03      A         MVI        A,3
662  05 0033F 3267FD    N         STA        NOIMGCT:   INIT 'NO IMAGE CNTR' TO 3
663  05 00342 CD0000    N         CALL       SRSK       SHIFT REG SCHEDULER (INIT SR#0)
664  05 00345 CD0000    N         CALL       TIM@MOD    CALC SHIFTED IMAGE VALUES (1)
665  05 00348 CD0000    N         STIMR      935:TMR,810,RETURN:
                                                    SET 'OVER-RUN EVENT' TIMER (2)
     05 0034B 22        A
     05 0034C 51        A
     05 0034D 0000      N
666  06 0034F CD0000    N         CALL       TBLD@PRT   BUILD NEW PITCH TABLE (3)
667  05 00352 CD0000    N         SOBIT,S    PRNT$RLY,PR$COOL
                                                    PRINT RELAY & COOLING FAN ON
     05 00355 02        A
     05 00356 EA08      A
     05 00358 F608      A
668  05 0035A AF        A         CTIMR      PRO@COOL   CLEAR COOLING FAN TIMER
     05 0035B 3232FA    N
669  05 0035E CD0000    N         COBIT,S    NPFO$ON    TURN OFF PFO(INVERTED DRIVER)
     05 00361 E47F      A
670  05 00363 3AB0F4    A         IF:        FLG,ADH@SELC,T
     05 00366 07        A
     05 00367 D27003    N
671  05 0036A CD0000N              CALL       ADH@MOTN
672  05 0036D C37503    N         ELSE:
673  05 00370 3E80      A          SFLG      ADH@WTEN
     05 00372 320CF4    A
674                               ENDIF
675  05 00375 CD0000    N         CALL       TRN@BOD
676  05 00378 CD0000    N         CALL       PAP@SIZE   CHK PAPER WIDTH FOR FUSER (1)
677  05 0037B CD0000    N         CALL       EDGE@FO    CHK WHICH EDGE FADE OUT (2)
678  05 0037E CD0000    N         CALL       PAP@PRL3
679  05 00381 CD0000    N         CALL       PROG@UP    PROG INITIALIZATION SUBR
680  05 00384 CD0000    N         CALL       PROG@UP1
681  05 00387 CD0000    N         CALL       FDR@PRT    CHECK FEEDER SELECTION
682  05 0038A CD0000    N         CALL       BLG@BKPT   READ BILLING BREAK POINTS
683  05 0038D CD0000    N         CALL       DO@ELV     CAUSE ELV TO EXECUTE
684  05 00390 3A54F4    A         IF:        FLG,SRT@SEL,1
                                                    IS SORTER BEING USED
     05 00393 07        A
     05 00394 D29F03    N
```

```
685  05 00397 CD0000 N        CALL      SRT@INIT   INITIALIZE SORTER JAM DETECT
686                           MVI       A,MSK(NVBIT,NVBFJAM,:
                                                   SETS ALL 4 JAM CONDITIONS
687  05 0039A 3E0F   A                   NV@IMED,NV@LOW@J,NV@UP@J)
688  05 0039C C3A403 N        ELSE:
689  05 0039F 3AC9E2 A         RNVNIB    NV@JAM@N READ SAVED PREVIOUS SRT JAMS
690                            MODBYT     A,OR,MSK(NVBIT,;
                                                   & SET IMED DN & FDR JAM
691  05 003A2 F603   A                   NV@FJAM,NV@IMED)
692                           ENDIF
693  05 003A4 32C9E2 A        WNVNIB    NV@JAM@N  STORE IN CASE OF PWR DN
694                           ID:ALTR   NV@FJAM,NV@IMED,NV@LOW@J,;
                                                   SEE ABOVE IF:/ELSE:
695                                     NV@UP@J
696  05 003A7 CDA901 N        CALL      SB:PNTRS   SYNC BKG PNTRS TO NEW STATE
697  05 003AAC9      A        RET

699                      *    CALLS FOR PRINT 10MS SYN BACKGROUND

701  05 003AB CD0000 N  PRNT10 CALL     ADH@CTRL
702  05 003AE CDC004 N        CALL      PRT:IMD
703  05 003B1 C9     A        RET

705                      *    CALLS FOR PRINT 20MS SYN BACKGROUND

707  05 003B2 0000   N  PRNT20 DW       PRT@SWS
708  05 003B4 0000   N        DW        TON@DIS
709  05 003B6 0000   N        DW        PAP@TGL3
710  05 003B8 0000   N        DW        LMP@CTRL
711  05 003BA 0000   N        DW        FDR@BKFD
712  05 003BC 0000   N        DW        SORTER@
713  05 003BE 0000   N        DW        ELV@PRNT
714  05 003C0 0000   N        DW        SOS@JMDT
715  05 003C2 0000   N        DW        DSPL@CTL
716  05 003C4 0000   N        DW        INSTRU
717  05 003C6 FFFF   A        DW        X'FFFF'            END OF TABLE

719                      *    CALLS FOR PRINT 100MS SYN BACKGROUND

721  05 003C8 0000   N  PRNT100
                              DW        RILK@CK
722  05 003CA 0000   N        DW        2SD@RUN
723  05 003CC 0000   N        DW        LITE@OFF
724  05 003CE 0000   N        DW        XMM@PRNT
725  05 003D0 0000   N        DW        FUS@RDUT
726  05 003D2 0000   N        DW        READY@CK
727  05 003D4 0000   N        DW        JAM@RST
728  05 003D6 0000   N        DW        MINIPHS8
729  05 003D8 4F06   N        DW        SMPL@CPY
730  05 003DA 0000   N        DW        RXCYCLDN   STUB IN US IMG
731  05 003DC 0000   N        DW        KEY@CNTR
732  05 003DE 0000   N        DW        TST@LP4
733  05 003E0 2C04   N        DW        PRT:CHG    TEST IF OK TO
734  05 003E2 FF01   N        DW        STAT:CHG           LEAVE PRINT
735  05 003E4 FFFF   A        DW        X'FFFF'            END OF TABLE

737                      *    EPILOG

739  05 003E6 CD0000 N  PRNT:EPL
                              CALL      AX@EPTY            (1)
740  05 003E9 CD0000 N        CALL      FDM@EPL3   (2)
741  05 003EC CD0000 N        CALL      FDA@EPL3           (3)
742  05 003EF CD0000 N        CALL      TRN@EPL3
743  05 003F2 CD0000 N        CALL      DVL@NRDY
744                           COBIT,S   FUS$COOL,FUS$LOAD,ILLM$SPL,;
745  05 003E5 CD0000 N                   EFO$11,EFO$12$5,SMPL$CPY,READY$
     05 003F8 07     A
     05 003F9 E6F7   A
     05 003FB EDFD   A
     05 003FD F2F7   A
     05 003FF ECF7   A
     05 00401 EBF7   A
     05 00403 E2FE   A
     05 00405 E7FE   A
746  05 00407 CD0000 N        SOBIT,S   NPFO$OB    TURN OFF PFO (INVERTED DRIVER)
     05 0040A E480   A
747  05 0040C AF     A        CFLG      ELV@AUTO   DISABLE AUTO TRAY SWITCHING
     05 0040D 3222F4 A
748  05 00410 CD0000 N        CALL      PAP@EPL3
749  05 00413 CD1704 N        CALL      ABORT
750  05 00416 C9     A        RET

752                      *
753                      *    SUBROUTINE
754                      *

756  05 00417 F3     A  ABORT DI                      TURN OFF INTERRUPT SYSTEM
757  05 00418 AF     A        CFLG      TBLD@FIN   SIGNAL NEW PITCH TABLE REQ'D
     05 00419 325DF4 A
758  05 0041C 211907 N        LXI       H,EV@STBY: ADDR OF STBY EVENT TABLE
759  05 0041F 2264FD N        SHLD      EV@PTR:    SAVE FOR MACH CLK ROUTINE
```

```
760  05 00422 CD0000 N        COBIT,S     BTR$LOAD,PRNT$RLY
                                                UNLOAD BTR & DROP PRINT RELAY
     05 00425 02       A
     05 00426 E17F     A
     05 00428 EAF7     A
761  05 0042A FB       A        EI
762  05 0042B C9       A        RET

764  05 0042C 3A66FD N  PRT:CHG
                        IF:         XBYT,CYCUPCT:,EQ,2
                                                CHECK FOR PROLOG 2 OR CYCLE OUT
     05 0042F FE02     A
     05 00431 C23C04 N
765  05 00434 3E80     A              SFLG  PRT@PRO2    YES, SET 'PRINT PROLOG 2' FLAG
     05 00436 3271F4   A
766  05 00439 C37004 N        ORIF:       XBYT,A,EQ,3  NO, IS CYCLE UP CNTR=3
     05 0043C FE03     A
     05 0043E C27004 N
767  05 00441 3A71F4   A      ANDIF:      FLG,PRT@PRO2,T
                                                YES, AND IS PROLOG 2 FLAG SET
     05 00444 07       A
     05 00445 D27004 N
768  05 00448 AF       A              CFLG  PRT@PRO2
                                                YES, DO PROLOG 2 AND CLR FLAG
     05 00449 3271F4   A
769                         *
770                         *    PRINT STATE BACKGROUND=PROLOG 2
771                         *
772  05 0044C CD0000 N              CALL PAP@PRL2  RETN XPORT OFF IF NOT SIDE 1
773  05 0044F CD0000 N              CALL PROG@UP2
774  05 00452 3AADF4 A              IF:    FLG,IMGMADE:,T
                                                HAS 1ST IMAGE BEEN MADE
     05 00455 07       A
     05 00456 D25C04 N
775  05 00459 CD0000 N               CALL  PROG@UP YES, CALL PROG INITIALIZATION
776                                ENDIF
777  05 0045C 3A57FA N              IF:    VBYT,MINIBYTE,NZ
                                                'S MINI PHYSICAL ACTIVE
     05 0045F A7       A
     05 00460 CA7004 N
778  05 00463 AF       A               CFLG   DSPL@1ST YES, ENABLE DISPLAY UPDATE
     05 00464 329AF4   A
779  05 0046B 3C       A               INR    A          DISPLAY QUANTITY
780  05 00468 3250FA N                STA    DISPL@ST
                                                COMPLETE
781  05 00468 3E06     A               MVI    A,6        SET DOCUMENT TOTAL TO
782  05 0046D 326FFA N                STA    DOC@TOTL
                                                6 FOR ADH DOCUMENT CHECK
783                                ENDIF
784                         ENDIF
786                         *    END PROLOG2

788                         *

789                         *    BUILD FLAG BYTE
790                         *
791  05 00470 0608     A    MVI        B,8          NUMBER OF FLAGS REQ'D
792  05 00472 AF       A    XRA        A            CLEAR A REG
793  05 00473 57       A    MOV        D,A          CLEAR D REG
794  05 00474 21A9F4   A    LXI        H,ADR(FLG,IMED@DN:)
                                                    STARTING ADDR OF PRT:CHG FLAGS
795                         REPEAT
796  06 00477 7E       A         MOV    A,M          LOAD A W/CONTENTS OF FLAG ADDR
797  05 00478 07       A         RLC                 ROTATE FLAG(D7) INTO CARRY
798  05 00479 7A       A         MOV    A,D          LOAD A W/FLAGS BILT INTO BYTE
799  05 0047A 17       A         RAL                 PUT FLAG IN DO & SHIFT LEFT
800  05 0047B 57       A         MOV    D,A          SAVE RESULT IN D REG
801  05 0047C 23       A         INX    H            STEP TO NEXT FLAG
802  05 0047D 05       A         DCR    B            DECR NUMBER OF FLAGS REQ'D
803  05 0047E C27704 N    UNTIL:      CC,Z,S          LOOP UNTIL ALL FLAGS IN BYTE
804                         ID:READ     IMED@DN:,CYCL@DN:,NORM@DN:,:
                                                    FLAGS READ
805                                     QWIK:OUT,IMGMADE:,SD1@TIMO,;
806                                     SD1DLY,ADH@SELC
807                         *
808                         *    TEST FOR STATE CHANGE TO :RUNN
809                         *
810  05 00481 3A67FD N    LDA    NOIMGCT:            MOV CURRENT NO IMAGE COUNTER
811  05 00484 605F     A  MOV    E,A                 TO THE E-REG
812  05 00485 060E     A  MVI    B,14                LOOP CNTR FOR STATE CHG TESTS
813  05 00487 21E104 N    LXI    H,CYC:OUT           TABLE ADDR OF PRT:CHG TESTS
814                         REPEAT
815  05 0048A 7A       A     MOV    A,D              MOV FLAG BYTE TO THE A-REG
816  05 0048B A6       A     MODBYT A,AND,M          MASK FOR DESIRED FLAGS
817  05 0048C 23       A     INX    H                STEP TO STATUS TEST
818  05 0048D AE       A     MODBYT A,XOR,M          TEST FLAG STATUS
819  05 0048E C29F04 N      IF:    CC,Z,S           DID TEST PASS
820  05 00491 23       A       INX      H             YES, STEP TO NOIMGCT: TEST
```

```
821  05 00492 7B      A          IF:          XBYT,E,GE,M
                                                IS NOIMGCT: AT CORRECT VALUE
     05 00493 BE      A
     05 00494 DA9E04  N
822  05 00497 3E05    A              MVI    A,:RUNN  YES, CHANGE STATE
823  05 00499 3253FE  N              STA    STATE:   TO RUN NOT PRINT
824  05 0049C 0601    A              MVI    B,1      FORCE END OF TESTS (EARLY OUT)
825                                ENDIF
826  05 0049E 2B      A           DCX    H           ADJ PNTR BACK TO NO IMG TEST
827                              ENDIF
828  05 0049F 23      A           INX    H           STEP OVER NO IMG TEST
829  05 004A0 23      A           INX    H           STEP TO MASK FOR NEXT TEST
830  05 004A1 05      A           DCR B              DECR LOOP COUNTER
831  05 004A2 C28A04  N         UNTIL: CC,Z,S        ALL TESTS COMPLETE OR STATE CHG
832                        *
833  05 004A5 7A      A         MOV    A,D           MOV FLAG BYTE TO A-REG
834  05 004A6 E662    A         MODBYT A,AND,D6/D5/D1 MASK AND TEST FOR FLAGS TRUE
835                             ID:READ  NORM@DN:,CYCL@DN:,SD1@DLY
                                                     FROM ABOVE BYTE BUILD
836  05 004A8 CABF04  N         IF:        CC,Z,C    ARE ANY FLAGS TRUE
837  05 004AB 2166FD  A          LXI       H,ADR(DATA,CYCUPCT:)
                                                     PREPARE TO TEST OR MODIFY
838  05 004AE 7E      A          IF:       XBYT,M,GE,3 HAS PROG PUSHED IT TO 0
     05 004AF FE03    A
     05 004B1 DAB604  N
839                               ID:READ  CYCUPCT:
840  05 004B4 3602    A           MVI      M,2       NO, FORCE CYCLE-UP MODE AGAIN
841                               ID:ALTR  CYCUPCT:
842                              ENDIF
843  05 004B6 CD0000  N          COBIT,S   ILLM$SPL   ILLM SPL OFF DURING DEAD CYCLE
     05 004B9 F2F7    A
844  05 004BB AF      A          CFLG      SMPL@FLG   CANCEL SAMPLE COPY SEQUENCE
     05 004BC 324CF4  A
845                             ENDIF
846  05 004BF C9      A         RET

848                        PRT:IMD
                             IF:        FLGS,IMED@DN:,AND,:
                                                     IS IMEDIATE DOWN REQUESTED
849  05 004C0 3AA9F4  A                  TBLD@FIN,T  AND HAS PROB BEEN DETECTED
     05 004C3 215DF4  A
     05 004C6 A6      A
     05 004C7 F2D004  N
850  05 004CACD1704   N          CALL      ABORT
851  05 004CDC3E004   N         ORIF:      FLG,TIME@DN:,T
                                                     IF TIMED DWN REQ'D DROP OUT
     05 004D0 3AA7F4  A
     05 004D3 07      A
     05 004D4 D2E004  N
852  05 004D7 21E1FF  A          COBIT     BTR$LOAD   BIAS TRANS ROLL (ASAP)
     05 004DA 3E7F    A
     05 004DCF3       A
     05 004DD A6      A
     05 004DE 77      A
     05 004DF FB      A
853                             ENDIF
854  05 004E0 C9      A         RET

856                        *
857                        *                          D76543210        (X=DON'T CARE)
858                        *
859                        *    TABLE OF FLAG STATUS TESTS ICNQISSA    NC
860                        *    AND NO IMAGE COUNTER VALUES
                                                     MYOWMDDD         OO
*61                        *    USED TO DETERMINE IF STATE
                                                     ERIG11H          U     TN
862                        *    SHOULD CHANGE FROM PRINT TO
                                                     DMKM@@@          IN    EU
863                        *    RUN NOT PRINT        @@@:ATDS         MT    SM
864                        *                         DDDODILE         AE    TB
865                        *                         NNNUEMYL         GR     E
866                        *                         : : :T:OC        E      R
867                        *
868  05 004E1 48      A  CYC:OUT
                             DB     D6/D3             X1XXOXXX         00    1
869  05 004E2 40      A       DB     D6
870  05 004E3 00      A       DB     0
871  05 004E4 5C      A       DB     D6/D4/D3/D2       X1XO11XX         16    2
872  05 004E5 4C      A       DB     D6/D3/D2
873  05 004E6 10      A       DB     16
874  05 004E7 5C      A       DB     D6/D4/D3/D2       X1XO10XX         11    3
875  05 004E8 48      A       DB     D6/D3
876  05 004E9 OB      A       DB     11
877  05 004EA 68      A       DB     D6/D5/D3          XO1XOXXX         00    4
878  05 004EB 20      A       DB     D5
879  05 004EC 00      A       DB     0
880  05 004ED 75      A       DB     D6/D5/D4/D2/D0    XOOOX1XO         36    5
881  05 004EE 04      A       DB     D2
882  05 004EF 24      A       DB     36
883  05 004F0 75      A       DB     D6/D5/D4/D2/D0    XOOOX1X1         20    6
```

```
884  05 004F1 05      A        DB     D2/D0
885  05 004F2 14      A        DB     20
886  05 004F3 7D      A        DB     D6/D5/D4/D3/D2/D0
                                                  XO1O11XO      36     7
887  05 004F4 2C      A        DB     D5/D3/D2
888  05 004F5 24      A        DB     36
889  05 004F6 7D      A        DB     D6/D5/D4/D3/D2/D0
                                                  XO1O11X1      20     8
890  05 004F7 2D      A        DB     D5/D3/D2/D0
891  05 004F8 14      A        DB     20
892  05 004F9 75      A        DB     D6/D5/D4/D2/D0  XOOOXOXO      21     9
893  05 004FA 00      A        DB     0
894  05 004FB 15      A        DB     21
895  05 004FC 7D      A        DB     D6/D5/D4/D3/D2/D0
                                                  XO1O1OXO      21     10
896  05 004FD 28      A        DB     D5/D3
897  05 004FE 15      A        DB     21
898  05 004FF 75      A        DB     D6/D5/D4/D2/D0  XOOOXOX1      13     11
899  05 00500 01      A        DB     D0
900  05 00501 0D      A        DB     13
901  05 00502 7D      A        DB     D6/D5/D4/D3/D2/D0
                                                  XO1O1OX1      13     12
902  05 00503 29      A        DB     D5/D3/D0
903  05 00504 0D      A        DB     13
904  05 00505 10      A        DB     D4              XXX1XXXX      11     13
905  05 00506 10      A        DB     D4
906  05 00507 0B      A        DB     11
907  05 00508 80      A        DB     D7              1XXXXXXX      00     14
908  06 00509 80      A        DB     D7
909  05 0050A 00      A        DB     0


912                          *NAR
913                          *
914                          *      RUN NOT PRINT STATE
915                          *
916                          *      RUN NOT PRINT-EXECUTES WHILE MACHINE IS COMPLETING
                                    A COPY RUN
917                          *      ENTERED FROM 'PRINT' AND EXITS TO 'NOT READY'.

919                          *      PROLOG

921  05 0050B CD0000  N      RUNN:PRL
                                    CALL       DO@ELV       CAUSE ELV TO EXECUTE
922  05 0050E CD0000  N              STIMR      RUNN:TMR,2500,RUNN@CHG
                                                            STAY IN RUNN 2.5 SEC
     05 00511 2F      A
     05 00512 FA      A
     05 00513 7505    N
923  05 00515 CDA901  N              CALL       SB:PNTRS     SYNC BKG PNTRS TO NEW STATE
924  05 00518 C9      A              RET

926                          *      CALLS FOR RUN NOT PRINT 10MS SYN BACKGROUND

928  05 00519 CD0000  N      RUN10CALL         ADH@CTRL
929  05 0051C C9      A              RET

931                          *      CALLS FOR RUN NOT PRINT 20MS SYN BACKGROUND

933  05 0051D 0000    N      RUNN20
                                    DW         RUNN@SWS
934  05 0051F 0000    N              DW         SORTER@
935  05 00521 0000    N              DW         SOS@JMDT
936  05 00523 0000    N              DW         ELV@PRNT
937  05 00525 0000    N              DW         LMP@CTRL
938  05 00527 0000    N              DW         PAP@TGL4
939  05 00529 0000    N              DW         DSPL@CTL
940  05 0052B 0000    N              DW         INSTRU
941  05 0052D FFFF    A              DW         X'FFFF'

943                          *      CALLS FOR RUN NOT PRINT 100MS SYN BACKGROUND

945  05 0052F 0000    N      RUNN100
                                    DW         JAM@RST
946  05 00531 0000    N              DW         RILK@CK
947  05 00533 0000    N              DW         FUS@RDUT
948  05 00535 0000    N              DW         2SD@RUN
949  05 00537 0000    N              DW         XMM@PRNT
950  05 00539 0000    N              DW         LITE@OFF
951  05 0053B 0000    N              DW         TST@LP4
952  05 0053D FF01    N              DW         STAT:CHG     TEST IF OK TO LEAVE RUN NOT PRT
953  05 0053F FFFF    A              DW         X'FFFF'      END OF TABLE

955  05 00541 CD0000  N      RUN:EPL
                                    CALL       DEL@CK       CALC COPIES DELIVERED
956  05 00544 CD0000  N              CALL       PAP@EPL4     'RUNNPRT' PAPER PATH MOP UP SUB
957  05 00547 CD0000  N              CALL       MOT@OFF      TURN OFF SORTER MOTORS
958  05 0054A CD0000  N              CALL       DO@ELV       CAUSE ELV TO EXECUTE
959  05 0054D AF      A              CFLG       AXFD@FLT     RESET FOR USE DURING NEXT RUN
     05 0054E 323FF4  A
```

```
960  05 00551 2123FC A        CFBIT,P     TF@XMMO     STOP BLINKING OF XMM 'OTHER'
     05 00554 3EFE   A
     05 00556 A6
     05 00557 77
961  05 00558 CD0000 N        COBIT,S     SOS$SMPL
     05 0055B ECFD   A
962  05 0055D CD7B05 N        CALL        NV@JAM
963  05 00560 CD0000 N        CALL        RCP@STRE    STORE RECAP DATA IN RAM
964  05 00563 CD0000 N        CALL        ADH@MOTF
965  06 00566 3E08   A        MVI         A,8
966  05 00568 3285FA N        STA         COOLCNT     SET COUNTER FOR 7 TIMEOUTS
967  05 0056B CD0000 N        CALL        PR@FAN
968  05 0056E CD0000 N        CALL        FLT@EPL5    ()
969  05 00571 CD0000 N        CALL        HIST@FLE    (:) LOG HISTORY DATA FOR RUN
970  05 00574 C9     A        RET                     (:)

972  05 00575 2153FD N  RUNN@CHG
                              LXI         H,STATE:    SET H&L TO ADDR OF STATE:
973  05 00578 3602   A        MVI         M,:NRDY     CHANGE STATE: TO NOT READY
974                           ID:ALTR     STATE:
975  05 0057A C9     A        RET
977  05 0057B 3A66F4 A  NV@JAM
                              RFLG        UP@JAM      LOAD A WITH SRT UPPER JAM FLAG
     05 0057E 07     A
978                        *                           & SAVE IT IN THE CARRY BIT
979  05 0057F 3A36F4 A        LDAFLG      LOW@JAM     LOAD A WITH SRT UPPER JAM FLAG
980  05 00582 17     A        RAL                     & MOVE CARRY &
981  05 00583 17     A        RAL                     LOW@JAM INTO THEIR POSITIONS
982  05 00584 07     A        RLC
983  05 00585 07     A        RLC
984                           MODBYT      A,AND,MSK(NVBIT,;
                                                      MASK FOR DESIRED BITS
985  05 00586 E60C   A                    NV@LOW@JMNV@UP@J)
986  05 00588 47     A        MOV         B,A         & SAVE IT IN THE B-REG
987  05 00589 3AA9F4 A        IF:         FLG,IMED@DN:,T
                                                      WAS THERE AN IMED DN CONDITION
     05 0058C 07     A
     05 0058D D29605 N
988  05 00590 78     A         MOV        A,B         YES, RESTORE A-REG
989                            MODBYT     A,OR,MSK(NVBIT,NV@FJAM,:
                                                      & SET NV JAM BITS
990  05 00591 F603   A                    NV@IMED)
991  05 00593 C3A105 N        ELSE:
992  05 00596 3A3CFD A         IF:        FBITS,FDR@AJAM,OR,FDR@MJAM,T
                                                      IS EITHER JAM CONDITION TRUE
     05 00599 E60C   A
     05 0059B CA9F05 N
993  05 0059E 37     A              STC               YES, SET CARRY
994                            ENDIF
995  05 0059F 17     A         RAL                    ROTATE INTO DO
996  05 005A0B0      A         MODBYT     A,OR,B      'OR' IN SRT JAM BITS
997                           ENDIF
998  05 005A1 32C9E2 A        WNVNIB      NV@JAM@N
999                           ID:ALTR     NV@FJAM,NV@IMED,NV@LOW@JMNV@UP@J
1000 05 005A4 C9     A        RET                     RETURN TO STATE CHECKER

1002                       *NAR
1003                       *
1004                       *     TECH REP STATE
1005                       *
1006                       *     THE TECH REP STATE IS ENTERED WHEN THE SERVICE
                                 KEY IS ON IN
1007                       *     'NOT READY' & 'READY' STATES. THIS ALLOWS THE TECH REP
                                 TO PERFORM SUCH
1008                       *     TASKS AS ACCESS NON-VOLATILE MEMORY & COMPONENT
                                 CONTROL.

1010                       *     RPOLOG
1011                       *
1012                       *
1013 05 005A5 CD0000 N  TREP:PRL
                              COBIT,S     WAIT$       INSURE WAIT OFF AT TREP ENTRANC
     05 005A8 E9FE   A
1014 05 005AACD0000 N        CALL        DGN@PRL     DIAGNOSTIC PROLOG
1015 05 005ADCDA90  N        CALL   SB:PNTRS         SYNC BKG PNTRS TO NEW STATE
1016 05 005B0 C9     A        RET

1019                       *     CALLS FOR TECH REP 10M S SYN BACKGROUND

1021 05 005B1 CD0000 N  TREP10 CALL      ADH@CTRL
1022 05 005B4 C9     A        RET

1024                       *     CALLS FOR TECH REP 20M S SYN BACKGROUND

1026 05 005B5 0000   N  TREP20 DW        TREP@SWS
1027 05 005B7 0000   N        DW         MN@ELV@S
1028 05 005B9 0000   N        DW         LMP@CTRL
1029 05 005BB 0000   N        DW         DSPL@CTL
```

```
1030 05 005BD 0000    N        DW        DGN@BKG
1031 05 005BF 0000    N        DW        INSTRU
1032 05 005C1 FFFF    A        DW        X'FFFF'        END OF TABLE

1034                     *     CALLS FOR TECH REP 100MS SYN BACKGROUND

1036 05 005C3 0000    N  TREP100 DW      NRILK@CK
1037 05 005C5 0000    N        DW        2SD@STBY
1038 05 005C7 0000    N        DW        XMM@STBY
1039 05 005C9 0000    N        DW        RED@BGND
1040 05 005CB 0000    N        DW        BIN@CHK
1041 05 005CD 0000    N        DW        JAM@RST
1042 05 005CF 0000    N        DW        DVL@DUMP
1043 05 005D1 0000    N        DW        FUS@RDUT
1044 05 005D3 0000    N        DW        TST@LP4
1045 05 005D5 DF05    N        DW        TREP:CHG       TEST IF OK TO
1046 05 005D7 FF01    N        DW        STAT:CHG                      LEAVE TREP REP
1047 05 005D9 FFFF    A        DW        X'FFFF'        END OF TABLE

1049                     *
1050                     *     EPILOG (TECH REP STATE)
1051                     *
1052 05 005DB CD0000  N  TREP:EPL
                              CALL      DGN@EPL        DIAGNOSTIC EPILOG
1053 05 005DE C9      A       RET

1055                     *     CHANGE OF STATE CHECK

1057 05 005DF 2153FD  A  TREP:CHG
                              LXI       H,ADR(DATA,STATE:)
                                                       PREPARE FOR POSSIBLE STATE CHG
1058 05 005E2 7E      A       IF:       XBYT,M,NE,:COMP
                                                       DO NOT CHG STATE IF IN COMP
     05 005E3 FE000   A
     05 005E5 CAFE0 i N
1059 05 005E8 3A49F4  A        IF        FLG,SER@ACT,T
                                                       IF SERVICE KEY IS ON AND IF
     05 005EB 07      A
     05 0055C D2FC0.i N
1060 05 005EF 3A20FC  A        ANDIF:    FBIT,DGN@PRT@,F
                                                       IN DIAG PRINT PROGRAM
     05 005F2 E602    A
     05 005F4 C2FC0 i N
1061 05 005F7 3601    A         MVI   M,:TREP           CHG TO TREP STATE
1062 05 005F9 C3FE0.i N        ELSE:                    IF KEY IS TURNED OFF
1063 05 005EC 3602    A         MVI   M,:NRDY           CHG TO NOT READY STATE
1064                           ENDIF
1065                           ID:ALTR   STATE:
1066                           ENDIF
1067 05 005FE C9      A        RET
```

TABLE II

```
96                       *     FIXED PITCH EVENT TABLE
97                       *
98                       *     EVENTS MUST BE IN SEQUENTIAL ORDER STARTING
99                       *     WITH THE EVENT CLOSES TO PITCH RESET FIRST
100                      *
101                      *     THERE CAN BE NO MORE THAN 256 COUNTS BETWEEN EVENTS
102                      *
103                      *     FORMAT OF EVENTS FOR EVENT TABLE
104                      *
105                      *     EVENT      X,Y,X
106                      *     WHERE:
107                      *     X = ABSOLUTE COUNTS FROM RESET
108                      *     Y = SHIFT REGISTER NEEDED IN VENT
109                      *     Z = EVENT NAME
110                      *
111                      *
112                      *     PITCH EVENTS
113                      *
114                            TABLE
115  05 001E  0200       A     EVENT      2,3,TRN2CURR
     05 00020 03         A
     05 00021 0000       N
116  05 00023 0300       A     EVENT      3,2,ADC@ACT
     05 00025 02         A
     05 00026 0000       N
117  05 00028 0400       A     EVENT      4,3,FDR5AFLT
     05 0002A 03         A
     05 0002B 0000       N
118  05 0002D 0700       A     EVENT      7,0,SPLYS@ON
     05 0002F 00         A
     05 00030 0000       N
```

```
119  05 00032 0800   A    EVENT   8,2,FDR1AXFD
     05 00034 02     A
     05 00035 0000   N
120  05 00037 0A00   A    EVENT   10,3,FUS@LOAD
     05 00039 03     A
     05 0003A 0000   N
121  05 0003C 3000   A    EVENT   48,8,DECG@INV
                                     DECISION GATE FOR INVTD COPIES
     05 0003F 0000   N
122  05 00041 3600   A    EVENT   54,5,FUS@NTLD
                                     FUSER LOADED TEST
     05 00043 05     A
     05 00044 0000   N
123  05 00046 5500   A    EVENT   85,3,FDR6MFLT
     05 00048 03     A
     05 00049 0000   N
124  05 0004B 5900   A    EVENT   89,2,FDR2MNFD
     05 0004D 02     A
     05 0004E 0000   N
125  05 00050 5D00   A    EVENT   93,8,JAM6@NOIN PAPER PATH JAM SW PITCH EVENT
     05 00052 08     A
     05 00053 0000   N
126  05 00055 7600   A    EVENT   118,9,JAM5@INV
                                     PAPER PATH JAM SW PITCH EVENT
     05 00057 09     A
     05 00058 0000   N
127  05 0005A 7800   A    EVENT   120,0,FSH@OFF
     05 0005C 00     A
     05 0005D 0000   N
128  05 0005F 8700   A    EVENT   135,0,PROG@HST
                                     PROG HISTORY FILE UPDATE
     05 00061 00     A
     05 00062 0000   N
129  05 00064 8F00   A    EVENT   143,6,JAM4ACHK
                                     PAPER PATH JAM SW PITCH EVENT
     05 00066 06     A
     05 00067 0000   N
130  05 00069 AA00   A    EVENT   170,10,RET2@CHK
                                     PAPER PATH JAM SW PITCH EVENT
     05 0006B 0A     A
     05 0006C 0000   N
131  05 0006E CF00   A    EVENT   207,3,SOS@CLN
     05 00070 03     A
     05 00071 0000   N
132  05 00073 D100   A    EVENT   209,2,TRAN5CURR
     05 00075 02     A
     05 00076 0000   N
133  05 00078 E300   A    EVENT   227,5,JAM3@CHK
                                     PAPER PATH JAM SW PITCH EVENT
     05 0007A 05     A
     05 0007B 0000   N
134  05 0007D 0901   A    EVENT   265,2,FDR3AEDG
                                     ENABLE AUX FDR WT SENSOR
     05 0007F 02     A
     05 00080 0000   N
135  05 00082 0B01   A    EVENT   267,4,JAM2@CHK
                                     PAPER PATH JAM SW PITCH EVENT
     05 00084 04     A
     05 00085 0000   N
136  05 00087 0E01   A    EVENT   270,8,RET1@CHK
                                     PAPER PATH JAM SW PITCH EVENT
     05 00089 08     A
     05 0008A 0000   N
137  05 0008C 6901   A    EVENT   361,3,TRN3DTCK
     05 0008E 03     A
     05 0008F 0000   N
138  05 00091 6C01   A    EVENT   364,2,FDR4MEDG
                                     ENABLE MAIN WT SENSOR
     05 00093 02     A
     05 00094 0000   N
139  05 00096 B901   A    EVENT   441,9,JAM6@INV
                                     PAPER PATH JAM SW PITCH EVENT
     05 00098 09     A
     05 00099 0000   N
140  05 0009B C201   A    EVENT   450,4,FUS@UNLD
     05 0009D 04     A
     05 0009E 0000   N
141  05 000A0 C301   A    EVENT   451,2,TRN1ROLL
     05 000A2 02     A
     05 000A3 0000   N
142  05 000A5 F401   A    EVENT   500,0,DPM@SMPL
     05 000A7 00     A
     05 000A8 0000   N
143  05 000AA 0E02   A    EVENT   526,3,TRN4DTCK
     05 000AC 03     A
     05 000AD 0000   N
144  05 000AF 1B02   A    EVENT   539,0,DVLV@OFF
                                     TURN OFF VAR DENS DEVELOPERS
     05 000B1 00     A
     05 000B2 0000   N
```

```
145  05 000B4 5802   A     EVENT     600,0,BIL@PLOP TEST FOR PLATEN OPEN (BLG)
     05 000B6 00     A
     05 000B7 0000   N
146  05 000B9 7602   A     EVENT     630,5,INVTRCTL
                                                INVTR GATE & RETURN CONTROL
     05 000BB 05     A
     05 000BC 0000   N
147  05 000BE 8A02   A     EVENT     650,6,DECG@NON
                                                DECISION DATE FOR NON-INVTD
     05 000C0 06     A
     05 000C1 0000   N
148  05 000C3 9A02   A     EVENT     660,0,JAM@DLY
     05 000C5 00     A
     05 000C6 0000   N
149  05 000C8 BC02   A     EVENT     700,7,JAM5@NON
                                                PAPER PATH JAM SW PITCH EVENT
     05 000CA 07     A
     05 000CB 0000   N
150  05 000CD 2003   A     EVENT     800,0,PROGMODE
     05 000CF 00     A
     05 000D0 0000   N
151  05 000D2 2203   A     EVENT     802,0,FSH@ENB
     05 000D4 00     A
     05 000D5 0000   N
152  05 000D7 5003   A     EVENT     848,0,DVB@VAR
                                                TURN ON VARIABLE BIAS DEVELOPER
     05 000D9 00     A
     05 000DA 0000   N
153  05 000DC 5203   A     EVENT     850,4,SRSK@EV INIT SRSK & SRT MOTOR
     05 000DE 04     A
     05 000DF 0000   N
154  05 000E1 5403   A     EVENT     852,0,PECOFFEV
                                                TURN OFF POST EXP. COROTRON
     05 000E3 00     A
     05 000E4 0000   N
155  05 000E6 8C03   A     EVENT     908,0,PECONEV TURN ON POST EXP. COROTRON
     05 000E8 00     A
     05 000E9 0000   N
156  05 000EB 8E03   A     EVENT     910,0,910@EV
     05 000ED 00     A
     05 000EE 0000   N
157  05 000F0 9003   A     EVENT     912,0,DGN@HCNT
     05 000F2 00     A
     05 000F3 0000   N
158  05 000F5 A703   A     EVENT     935,0,OVER@FUN
     05 000F7 00     A
     05 000F8 0000   N
159                        ENDTABLE
```

TABLE III

```
71                         *
72                         *      VARIABLE PITCH EVENT TABLE
73                         *
74              00000001   FLSH@BSE EQU     1
75              00000019   F0@ONBSE EQU     25
76              00000064   F0@OFFBS EQU     100
77   05 00000 0100    A   ROM@FSH    DW    FLSH@BSE
78   05 00002 00      A                DB    0
79   05 00003 0000    N                DW    FSH@ON
80   05 00005 6400    A   ROM@OFF    DW    F0@OFFBS
81   05 00007 00      A                DB    0
82   05 00008 0000    N                DW    FO@OFF
83   05 0000A 1900    A   ROM@ON     DW    FO@ONBSE
84   05 0000C 00      A                DB    0
85   05 0000D 0000    N                DW    FO@ON
86   05 0000F 0100    A   ROM@FSHS   DW    FLSH@BSE
87   05 00011 00      A                DB    0
88   05 00012 0000    N                DW    FSH@ON@S
89   05 00014 6400    A   ROM@OFFS   DW    F0@OFFBS
90   05 00016 00      A                DB    0
91   05 0017  0000    N                DW    FO@OFF@S
92   05 00019 1900    A   ROM@ONS    DW    FO@ONBSE
93   05 0001B 00      A                DB    0
94   05 0001C 0000    N                DW    FO@ON@S
95                         *
```

TABLE IV

```
161      00000396          BASE@CNT SET   918          #CHK CNTS/PITCH
162      0000038E          SAFE@CNT SET   910          MIN # CHK CNTS/PITCH
163                        *
164                        *     PITCH TABLE BUILDER
165                        *
166                        *     BUILD VARIABLE PITCH EVENT TABLE INTO RAM
167                        *     FROM ROM DATA + REDUCTION ADJUST & FO TRIM
168                        *
169  05 000FA 2A0000  N    TBLD@PRT
                                LHLD  ROM@FSH        H&L = BASE CNT OF FLASH
170  05 000FD EB      A          XCHG                 D&E = BASE CNT OF FLASH
171  05 000FE 2A9AFC  N          LHLD  1FLSH@ON       H&L = RED ADJ
172  05 00101 19      A          DAD   D              H&L = BASE + ADJ
173  05 00102 2244FC  N          SHLD  RAM@FSH        RAM@FSH = BASE + ADJ
174                        *
175  05 00105 2A0500  N          LHLD  ROM@OFF        H&L = BASE CNT OF FO OFF
176  05 00108 EB      A          XCHG                 D&E = BASE CNT OF FO OFF
177  05 00109 2A9CFC  N          LHLD  1F0@OFF        H&L = RED ADJ + TRIM ADJ
178  05 0010C 19      A          DAD   D              H&L = BASE + ADJ
179  05 0010D 2249FC  N          SHLD  RAM@OFF        RAM@OFF = BASE + ADJ
180                        *
181  05 00110 2A0A00  N          LHLD  ROM@ON         H&L = BASE CNT OF FO ON
182  05 00113 EB      A          XCHG                 D&E - BASE CNT OF FO ON
183  05 00114 2A9EFC  N          LHLD  1F0@ON         H&L = RED ADJ + TRIN ADJ
184  05 00117 19      A          DAD   D              H&L = BASE + ADJ
185  05 00118 CDEA02  A          CALL  ON@MOD         CALL MOD ROUTINE TO MOD IF<0
186  05 0011B 224EFC  N          SHLD  RAM@ON         RAN@ON = RESULTS OF ABOVE
187                        *
188  05 0011E 3A31F4  A          IF:   FLG,IMG@SFT,T  IS THERE IMAGE SHIFT
     05 00121 07      A
     05 00122 D25601  N
189  05 00125 3E06    A            MVI     A,6        YES,# OF VAR EVENTS TO USE = 6
190  05 00127 47      A            MOV     B,A        SET UP B-REG FOR LOOP CONTROL
191  05 00128 3262FA  N            STA     TBLD@NUM   STORE # OF VAR EVENTS
192  05 0012B 3D      A            DCR     A          SET UP # OF TIMES TO GO
193  05 0012C 3263FA  N            STA     TBLD@TMP   THRU SORT
194                        *
195  05 0012F 2A0F00  N            LHLD    ROM@FSHS   UPDATE ROM@FSHS TO
196  05 00132 EB      A            XCHG               INCLUDE RED MODE ADJ + SHIFT
197  05 00133 2AA0FC  N            LHLD    2FLSH@ON   ADJ AND SAVE FOR THE
198  05 00146 19      A            DAD     D          IMAGE SHIFT
199  05 00137 2253FC  N            SHLD    RAM@FSHS   FLASH EVENT
200                        *
201  05 0013A 2A1400  N            LHLD    ROM@OFFS   UPDATE ROM@OFFS TO INCLUDE
202  05 0013D EB      A            XCHG               RED MODE ADJ + TRIM ADJ +
203  05 0013E 2AA2FC  N            LHLD    2FO@OFF    SHIFT ADJ AND SAVE
204  05 00141 19      A            DAD     D          FOR THE IMAGE SHIFT
205  05 00142 2258FC  N            SHLD    RAM@OFFS   FADE OUT EVENT
206                        *
207  05 00145 2A1900  N            LHLD    ROM@ONS    UPDATE ROM@ONS TO INCLUDE
208  05 00148 EB      A            XCHG               RED MODE ADJ + TRIM ADJ +
209  05 00149 2AA4FC  N            LHLD    2FO@ON     SHIFT ADJ
210  05 0014C 19      A            DAD     D
211  05 0014D CDEA02  N            CALL    ON@MOD     CALL MOD ROUTINE TO MOD IF<0
212  05 00150 225DFC  N            SHLD    RAM@ONS    SAVE THE RESULTS
213                        *
214  05 00153 C36001  N          ELSE:
215  05 00156 3E03    A            MVI     A,3        IF IMAGE SHIFT NOT SET
216  05 00158 47      A            MOV     B,A        #OF VAR EVENTS TO USE =3
217  05 00159 3262FA  N            STA     TBLD@NUM   SET UP B-REG FOR LOOP CONTROL
218  05 0015C 3D      A            DCR     A          STORE # OF VAR EVENTS & SETUP
219  05 0015D 3263FA  N            STA     TBLD@TMP   #OF TIMES TO GO THRU SORT
220                             ENDIF
221                        *
```

TABLE V

```
252                        *
253                        *     SORTS VARIABLE RAM EVENT TABLE BY
254                        *     ABS CLK COUNT & LOWEST ENDS IN EV@RAM
255                        *
256                        *     SORTS ONLY 1ST 3 IF NO IMAGE SHIFT, OTHERWISE SORTS ALL 6
257                        *
258  05 0017E 2144FC  N    LXI   H,EV@RAM             H&L=ADDR OF TOP OF VAR RAM TBL
259  05 00181 3A63FA  N    WHILE: XBYT,TBLD@TMP,NE,O
                                                      TIMES TO GO THRU OUTER LOOP
     05 00184 FE00    A
     05 00186 CAFD01  N
260  05 00189 3253FA  N      STA   IN@LP@CT           INTERLOOP CNT=OUTER LOOP CNT
261  05 0018C 3E80    A      SFLG  TBLD@1ST           SET 1ST FLAG FOR THIS POSITION
     05 0018E 325EF4  A
262  05 00191 2252FB  N      SHLD  FIX@ADDR           ADDR OF POSITION TO FULL
263  05 00194 B7      A      ORA   A                  CLEAR Z CONDITION BIT
```

```
264  05 00195 CAEF01 N        WHILE: CC,Z,C
265  05 00198  5E       A          MOV    E,M        E=LS PART OF ABS CLK COUNT
266  05 00199 23        A          INX    H
267  05 0019A 56        A          MOV    D,M        D=MS PART OF ABS CLK COUNT
268  06 0019B D5        A          PUSH   D          STORE ABS CLK CNT OF FILL POS
269  05 0019C 3A5EF4    A          IF:    FLG,TBLD@1ST,T
                                                     IS IT 1ST TIME FOR THIS POS

     05 0019F 07        A
     05 001A0 D2AE01    N
270  05 001A3 AF        A           CFLG   TBLD@ ST
                                                     YES, CLEAR ITS FLAG

     05 001A4 325EF4    A
271  05 001A7 23        A           INX    H          AND INCREMENT
272  05 001A8 23        A           INX    H          POINTER TO LS PART OF
273  05 001A9 23        A           INX    H          ABS CLK COUNT OF NEXT
274  05 001AA 23        A           INX    H          EVENT
275  05 001AB C3B601    N          ELSE:
276  05 001AE 2A5CFI    N           LHLD   VAR@A DR
                                                     H&L=ADDR
277  05 001B1 23        A           INX    H          OF LS PART OF
278  05 001B2 23        A           INX    H          ABS CLK COUNT TO
279  05 001B3 23        A           INX    H          COMPARE TO FILL
280  05 001B4 23        A           INX    H          POSITION
281  05 001B5 23        A           INX    H
282                               ENDIF
283  05 001B6 225CFE    N          SHLD   VAR@ADDR
                                                     STORE POINTER TO COMPARE EVENT
284  05 001B9 5E        A          MOV    E,M        E=LS PART OF COMPARE ABS CLK
285  05 001BA 23        A          INX    H
286  05 001BB 56        A          MOV    D,M        D=MS PART OF COMPARE ABS CLK
287  05 001BC E1        A          POP    H          H&L=ABS CLK COUNT OF FILL POS
288  05 001BD EB        A          IF:    XWRD,D,L T,H
                                                     IS CLK OF COMPARE<FILL

     05 001BE CD000(    N
     05 001C1 D2E501    N
289  05 001C4 2A5CFI    N           LHLD   VAR@A DR
                                                     YES, SWITCH THE 2 EVENTS
290  05 001C7 EB        A           XCHG               D&E=ADDR LOWER CLK VALUE
291  05 001C8 2A52FE    N           LHLD   FIX@AI DR
                                                     H&L=ADDR LARGER CLK VALUE
292  05 001CB 3EFB      A           MVI    A,-5       INITIALIZE LOOP COUNTER TO 5
293  05 001CD 3265FA    N           STA    TSW@NUM
                                                     WHICH = 3 OF ITEMS TO MOVE
294  05 001D0 B7        A           ORA    A          CLEAR Z CONDITION BIT
295  05 001D1 CAE501    N           WHILE: CC,Z,C
296  05 001D4 1A        A            LDAX   D          A=CONTAINS OF COMPARE EVENT
297  05 001D5 46        A            MOV    B,M        B=CONTAINS OF FILL EVENT
298  05 001D6 77        A            MOV    M,A        UPDATE FILL POS
299  05 001D7 78        A            MOV    A,B        UPDATE COMPARE POS
300  05 001D8 12        A            STAX   D          WITH NEW VALUE
301  05 001D9 13        A            INX    D          MOVE POINTERS TO
302  05 001DA 23        A            INX    H          NEXT ITEM
303  05 001DB 3A65FA    N            LDA    TWS@NUM
                                                     INC MOVE
304  05 001DE 3C        A            INR    A          LOOP CONTROL
305  05 001DF 3265FA    N            STA    TSW@NUM
                                                     COUNTER
306  05 001E2 C3D101    N          ENDWHILE
307                               ENDIF
308  05 001E5 2153FA    N          DECBYT   IN@LP@CT    DECRM INNER LOOP CNTR
     05 001E8 35        A
309  05 001E9 2A52FB    N          LHLD     FIX@ADDR    H&L=ADDR OF FILL POSITION
310  05 001EC C39501    N         ENDWHILE
311  05 001EF 110500    A         LXI    D,5           MOVE H&L TO LOOK AT NEXT EVENT
312  05 001F2 19        A         DAD    D             POSITION TO FILL
313  05 001F3 3A63FA    N         LDA    TBLD@TMP      DECREMENT # OF EVENTS
314  05 001F6 3D        A         DCR    A             TO SORT
315  05 001F7 3263F     A         STA    TBLD@TMP
316  05 001FA C38101    N         ENDWHILE
```

TABLE VI

```
223                        *
224                        *   MOVE THE SR# & EVENT ADDR FROM ROM TABLE
225                        *   TO RAM TABLE.  MOVES ONLY THE FIRST 3 IF
226                        *   NO IMAGE SHIFT, OTHERWISE MOVES ALL 6
227                        *
228  05 00160 1144FC    N     LXI    D,RAM@FSH     D&E=ADDR OF RAM TABLE
229  05 00163 210000    N     LXI    H,ROM@FSH     H&L=ADDR OF ROM TABLE
230  05 00166 B0        A     ORA    B             CLEAR Z CONDITION BIT
231  05 00167 CA7E01    N     WHILE: CC,Z,C
232  05 0016A 23        A      INX    H            INCREMENT H&L AND D&E
233  05 0016B 23        A      INX    H            POINTERS OVER THE
234  05 0016C 13        A      INX    D            ABS CLK COUNT
235  05 0016D 13        A      INX    D
```

```
05 0016E 7E      A      MOV     A,M        LOAD A WITH SR#
05 0016F 12      A      STAX    D          STORE SR# IN RAM TABLE
05 00170 23      A      INX     H          MOVE POINTERS TO LS
05 00171 13      A      INX     D          ADDR OF EVENT
05 00172 7E      A      MOV     A,M        LOAD A WITH LS ADDR OF EVENT
05 00173 12      A      STAX    D          & STORE IT IN RAM TABLE
05 00174 23      A      INX     H          MOVE POINTERS TO MS
05 00175 13      A      INX     D          ADDR OF EVENT
05 00176 7E      A      MOV     A,M        MOVE MS ADDR OF EVENT
05 00177 12      A      STAX    D          TO RAM
05 00178 23      A      INX     H          MOVES POINTERS TO
05 00179 13      A      INX     D          LS PART OF ABS CLK COUNT
05 0017A 05      A      DCR     B          DECREMENT LOOP COUNTER
05 0017B C36701  N     ENDWHILE
                     *
```

TABLE VII

```
                     *
                     *     MERGE VARIABLE PITCH EVENT TABLE & FIXED EVENT
                     *     TABLE CALCULATING OF THE REL DIFFERENCE WITH THE
                     *     RESULTS GOING INTO THE RUN EVENT TABLE
                     *
05 001FD 2A44FC  N     LHLD  EV@RAM          INITIALIZE VAR@CLK TO ABS CLK
05 00200 225EFB  N     SHLD  VAR@CLK         COUNT OF 1ST VAR PITCH EVENT
05 00203 2144FC  N     LXI   H,EV@RAM        INITIALIZE VAR@ADDR TO ADDR OF
05 00206 225CFB  N     SHLD  VAR@ADDR        1ST VAR PITCH EVENT
05 00209 211E00  N     LXI   H,EV@ROM        INITIALIZE FIX@ADDR TO ADDR OF
05 0020C 2252FB  N     SHLD  FIX@ADDR        1ST FIXED PITCH EVENT
05 0020F 3E80    A     SFLG  TBLD@1ST        NOTES 1ST EVENT TO RUN TABLE
05 00211 325EF4  A
05 00214 3E2C    A     MVI   A,TABLENUM      INITIALIZE TSW@NUM TO # OF
05 00216 3265FA  N     STA   TSW@NUM         EVENTS IN FIXED PITCH TABLE
05 00219 2A1E00  N     LHLD  EV@ROM          INITIALIZE D&E WITH ABS CLOCK
05 0021C EB      A     XCHG                  COUNT OF 1ST FIXED EVENT
05 0021D AF      A     CFLG  VAR@DONE        FLAG DENOTES VAR EVENTS
05 0021E 3259F4  A
05 00221 3A59F4  A     WHILE: FLG,VAR@DONE,F WHILE THERE ARE MORE VAR EVENTS
05 00224 07      A
05 00225 DA6F02  N
05 00228 2A5EFB  N      IF:      XWRD,VAR@CLK,LE,D
                                              IS VAR CLK CNT  = FIXED CLK CNT
05 0022B CD0000  N
05 0022E DA3402  N
05 00231 C25902  N
05 00234 2A5CFB  N       LHLD     VAR@ADDR   YES, H&L = VAR EVENT ADDR
05 00237 CD9302  N       CALL     TBLD@UPD   PLACE VAR EVENT AT END RUN TBL
05 0023A 3A62FA  N       LDA      TBLD@NUM   DECREMENT # OF
05 0023D 3D      A       DCR      A          VARIABLE EVENTS LEFT
05 0023E 3262FA  N       STA      TBLD@NUM   TO MERGE
05 00241 C24C02  N       IF:      CC,Z,S     DID TBLD@NUM GO TO O
05 00244 3E80    A           SFLG      VAR@DONE
                                              YES, DENOTE NO MORE VAR EVENTS
05 00246 3259F4  A
05 00249 C35602  N       ELSE:
05 0024C 225CFB  N           SHLD      VAR@ADDR
                                              STORE ADDR OF NEXT VAR EVENT
05 0024F 5E      A           MOV       E,M    UPDATE VAR@CLK TO
05 00250 23      A           INX       H      VALUE OF ABS CLK COUNT
05 00251 56      A           MOV       D,M    OF PRESENT VARIABLE
05 00252 EB      A           XCHG             EVENT
05 00253 225EFB  N           SHLD      VAR@CLK
                         ENDIF
05 00256 C36602  N      ELSE:                 IF FIXED TABLE CLK COUNT IS
05 00259 2A52FB  N       LHLD     FIX@ADDR   LESS THEN VAR TABLE UPDATE THE
05 0025C CD9302  N       CALL     TBLD@UPD   RUN TABLE WITH THAT EVENT
05 0025F 2252FB  N       SHLD     FIX@ADDR   UPDATE TO NEXT FIXED EVENTS
05 00262 2165FA  N       LXI      H,TSW@NUM  DECREMENT # OF FIXED EVENTS
05 00265 35      A       DCR      M          LEFT
                         ENDIF
05 00266 2A52FB  N       LHLD     FIX@ADDR
05 00269 5E      A       MOV      E,M        UPDATE D&L TO =
05 0026A 23      A       INX      H          ABS CLK CNT VALUE
05 0026B 56      A       MOV      D,M        OF PRESENT FIXED TABLE
05 0026C C32102  N     ENDWHILE
05 0026F 3EFF    A     MVI   A,X'FF'         CLEAR Z CONDITION
05 00271 B7      A     ORA   A               BIT FOR LOOP
05 00272 2A52FB  N     LHLD  FIX@ADDR        NO MORE VAR EVENTS,USE FIXED
05 00275 CA8402  N     WHILE: CC,Z,C         DONE WITH FIXED TABLE
05 00278 CD9302  N      CALL TBLD@UPD        NO, UPDATE RUN TABLE
05 0027B EB      A      XCHG                 SAVE H&L IN D&E
05 0027C 2165FA  N      LXI  H,TSW@NUM       DECREMENT # OF FIXED
05 0027F 35      A      DCR  M               EVENTS LEFT
05 00280 EB      A      XCHG                 RESTORE H&L
05 00281 C37502  N     ENDWHILE
```

```
374  05 00284 2A58FB N        LHLD  P@TBL@A        H&L=ADDR OF LAST MS ADDR IN RUN
375  05 00287 2B      A        DCX   H             MOVE H&L POINTER BACK TO POINT
376  05 00288 2B      A        DCX   H             AT THE BEGINNING OF THE LAST
377  05 00289 2B      A        DCX   H             EVENT(OVER@RUN) & STORE IT
378  05 0028A 2264FD  N        SHLD  EV@PTR:       FOR MACH CLK INTERRUPT HANDLER
379  05 0028D 3E80    A        SFLG  TBLD@FIN      DENOTES PITCH TABLE IS COMPLETE
     05 0028F 325DF4  A
380  05 00292 C9      A        RET

382                       *
383                       *    SUBROUTINE TO CALCULATE REL DIFFERENCE BETWEEN
384                       *    2 EVENTS & MOVE REST OF TABLE TO RUN TABLE
385                       *
386  05 00293 3A5EF4  A  TBLD@UPD
                              IF:   FLG,TBLD@1ST,T      THIS IS THE FIRST EVENT
     05 00296 07      A
     05 00297 D2AF0:  N
387  05 0029A AF      A         CFGL TBLD@1ST           YES, CLR FLAG TO KEEP OUT
     05 0029B 325EF4  A
388  05 0029E 7E      A         MOV  A,M                A=LS OF 1ST EVENT ABS CLK CNT
389  05 0029F 3251FA  N         STA  EV@1@TIM           USED AT PITCH RESET
390  05 002A2 5F      A         MOV  E,A                E=LS OF 1ST E VENT ABS CLK CNT
391  05 002A3 23      A         INX  H                  H&L=ADDR OF MS ABS CLK CNT
392  05 002A4 56      A         MOV  D,M                D=MS OF 1ST EVENT ABS CLK CNT
393  05 002A5 EB      A         XCHG                    D&E = ADDR OF MS ABS CLK CNT
394  05 002A6 2256FB  N         SHLD LCLK@CNT           STORE ABS CLK OF 1ST EVENT
395  05 002A9 21E8FE  N         LXI  H,EV@BASE:         H&L=ADDR OF RUN TABLE
396  05 002AC C3D80:  N        ELSE:
397  05 002AF 5E      A         MOV  E,M                E=LS CLK CNT OF NEW EVENT
398  05 002B0 23      A         INX  H                  H&L=ADDR OF MS ABS CLK CNT
399  05 002B1 56      A         MOV  D,M                D=MS CLK CNT OF NEW EVENT
400  05 002B2 E5      A         PUSH H                  SAVE ADDR OF MS ABS CLK CNT
401  05 002B3 2A56FE  N         IF:   XWRD,LCLK@CNT,GE,D
                                                        IS LAST CLK CNT GE NEW CLK CNT
     05 002B6 CD000C  N
     05 002B9 DAC50:  N
402  05 002BC 23      A              INX  H             H&L=LAST CLK CNT + 1
403  05 002BD 2256FB  N              SHLDLCLK@CNT       STORE IT FOR NEXT TIME
404  05 002C0 3E01    A              MVI  A,1           PUT THIS EVENT AT THE NEXT CLK
405  05 002C2 C3CC0:  N         ELSE:
406  05 002C5 45      A              MOV B,L            B=LS CLK CNT OF LAST EVENT
407  05 002C6 EB      A              XCHG               H&L=ABS CLK CNT OF NEW EVENT
408  05 002C7 2256FB  N              SHLD  LCLK@CNT     STORE IT FOR THE NEXT TIME
409  05 002CA 7D      A              MOV A,L            A=LS CLK CNT OF NEW EVENT
410  05 002CB 90      A              SUB  B             FIND DIFF (ONLY NEED LS IF CLK
411                                ENDIF                CNTS BETWEEN EVENTS<256)
412  05 002CC D1      A         POP  D                  D&E=ADDR OF MS OF CLK OF NEW EV
413  05 002CD 2A58FB  N         LHLD P@TBL@A            H&L=ADDR OF END OF LAST RUN EV
414  05 002D0 2B      A         DCX  H                  MOVE H&L POINTER
415  05 002D1 2B      A         DCX  H                  TO REL DIFF OF LAST
416  05 002D2 2B      A         DCX  H                  EVENT IN RUN TABLE
417  05 002D3 77      A         MOV  M,A                MOVE REL DIFF TO RUN TABLE
418  05 002D4 23      A         INX  H                  INCREMENT RUN TABLE
419  05 002D5 23      A         INX  H                  POINTER OVER LAST
420  05 002D6 23      A         INX  H                  EVENT
421  05 002D7 23      A         INX  H
422                           ENDIF
423  05 002D8 23      A        INX   H                  H&L=ADDR OF SR# IN RUN TABLE
424  05 002D9 13      A        INX   D                  D&E=ADDR OF SR#
425  05 002DA 1A      A        LDAX  D                  MOVE SR# FROM TABLE TO
426  05 002DB 77      A        MOV   M,A                RUN TABLE
427  05 002DC 23      A        INX   H                  MOVE POINTERS TO LS 8 BITS
428  05 002DD 13      A        INX   D                  OF EVENT ADDR
429  05 002DE 1A      A        LDAX  D                  MOVE LS 8 BITS OF ADDR
430  05 002DF 77      A        MOVE  M,A
431  05 002E0 23      A        INX   H                  MOVES POINTER TO MS 8 BITS
432  05 002E1 13      A        INX   D                  OF EVENT ADDR
433  05 002E2 1A      A        LDAX  D                  MOVES MS 8 BITS OF ADDR
434  05 002E3 77      A        MOV   M,A
435  04 002E4 22258FB N        SHLD  P@TBL@A            STORE ADDR OF RUN TABLE
436  05 002E7 13      A        INX   D                  POINTER TO LS 8 BITS OF CLK CNT
437  05 002E8 EB      A        XCHG                     H&L=ADDR OF LS 8 BITS OF CLK
438  05 002E9 C9      A        RET

440                       *
441                       *    SUBROUTINE TO DETERMINE IF MODIFIED FO ON EVENT
442                       *    CLK COUNT IF CLK COUNT RESULTS ARE NEGATIVE OR )
443                       *
444  05 002EA 7C      A  ON@MOD
                              MOV   A,H                A=MS PART OF ABS CLK COUNT
445  05 002EB 07      A        RLC                      CARRY=SIGN OF ABS CLK COUNT
446  05 002EC D20203  N        IF:   CC,C,S             IS THE ABS CLK CNT NEG
447  05 002EF 119603  A         LXI      D,BASE@CNT      YES, ADD # CLK COUNTS PER PITCH
448  05 002F2 19      A         DAD      D               TO NEG #
449  05 002F3 118E03  A         IF:      XWRD,H,GE,SAFE@CNT
                                                         IS RESULTS GE SAFE # CLK/PITCH
     05 002F6 CD0000  N
     05 002F9 DAF502  N
450  05 002FC 210100  A              LXI      H,1        YES, MOVE TO TURN ON LATER
451                                ENDIF
```

```
452  05 002FF C30E03  N        ORIF:  XWRD,H,EQ,O      IF RESULTS = 0, MOVE LATER IN
     05 00302 110000  N
     05 00305 CD0000  N
     05 00308 C20E03  N
453  05 0030B 210100  A         LXI   H,1              PITCH BECUASE EVENT MUST BE(1)
454                            ENDIF
455  05 0030E C9      A        RET
456                            END

CONTROL SECTION SUMMARY: 01 00000  PT0  0200000  PT0  03 00000  PT 0  04 OFFD8 PT 2
                         05 0030F  PT1
*NO UNDEFINED SYMBOLS
*    ERROR SEVERITY LEVEL: 0
*NO ERROR LINES
```

TABLE VIII

```
219                        *
220                        *      PITCH RESET INTERRUPT HANDLER
221                        *

223  06 000F9 FB      A  RSET: EI                        RE-ENABLE INTERRUPTS
224  06 000FA F5      A        PUSH  PSW                 SAVE A-REG & CONDITION BITS
225  06 000FB 3A5DF4  A        IF:   FLG,TBLD@FIN,T      IS PITCH TABLE BUILD FINISHED
     06 000FE 07      A
     06 000FF D26201  N
226  06 00102 E5      A         PUSH H                   SAVE H&L
227                             IF:   FLGS,SR@DONE,;     YES, IS THERE A NEW SR VALUE
228  06 00103 3A4DF4  A              AND,910@DONE,T      YES, DID 910 EVENT GET DONE
     06 00106 216FF4  A
     06 00109 A6      A
     06 0010A F25501  N
229  06 0010D AF      A          CFLG      910@DONE      YES, RESET & MACH CLK TIMING OK
     06 0010E 326FF4  A
230  06 00111 324DF4  A          MODFLG  SR@DONE         CLR FLAG UNTIL NEXT SR EVENT
231  06 00114 2163FD  A          LXI  H,ADR(DATA,SR@PTR:)
                                                         LOAD RELATIVE
232  06 00117 7E      A          MOV A,M                 PNTR TO SR #0
233  06 00118 C60F    A          MODBYT  A,ADD,15        MOVE PNTR BACK
234  06 011A  E66F    A          MODBYT  A,AND,SR@ADJ:      BY 1 (CIRCULAR)
235  06 0011C 77      A          MOV      M,A            SAVE NEW REL SR PNTR IN SR@PTR:
236  06 0011D 26FE    A          MVI  H,HADR(DATA,SHIFTREG)
                                                         H&L=ABS ADDR
237  06 0011F 6F      A          MOV L,A                    OF SR #0
238  06 00120 3A69FD  A          LDA ADDR(DATA,SR@VALU:)
                                                         A=NEW SR VALUE FROM SRSK
239  06 00123 77      A          MOV M,A                 UPDATE CONTENTS OF SR#0
240  06 00124 3A51FA  A          LDA ADR(DATA,EV@1@T M)
                                                         INIT MCLK:CNT
241  06 00127 326EFD  A          STA  ADDR(DATA,MCLK:CNT)  TO 1ST EVENT TIME
242  06 0012A 21E8FE  A           LXIH,ADR(DATA,EV@B/.SE:)
                                                         INIT EV@PTR:
243  06 0012D 2264FD  A          SHLD ADDR(DATA,EV@PTR:)
                                                            TO 1ST EVENT ADDR
244                              IF:  FLGS,NORM@DN:,;  IS NORMAL SHUTDOWN REQUESTED
245                                   AND,CYCL@DN:,;   NO, IS CYCLE-DOWN REQUESTED
246  06 00130 3AABF4  A              AND,SD1@DLY,F     NO, IS PROC DEAD CYCLING
     06 00133 21AAF4  A
     06 00136 B6      A
     06 00137 21AFF4  A
     06 0013A B6      A
     06 0013B FA5201  N
247  06 0013E 2166FD  A              LXI  H,ADR(DATA,CYCUPCT:)
                                                         NO, LOAD CYCLE_UP CNTR
248  06 00141 7E      A              IF:   XBYT,M,NE,5 IS PROC IN CYCLE-UP MODE
     06 00142 FE05    A
     06 00144 CA5201  N
249  06 00147 FE04    A               IF:  XBYT,A,EQ,4 YES, IS IT RDY TO MAKE 1ST IMG
     06 00149 C25101  N
250  06 0014C 3E80    A                 SFLG   IMGMADE
                                                         YES, SIGNAL 1ST IMAGE MADE
     06 0014E 32ADF4  A
251                                     ENDIF
252  06 00151 34      A                 INR     M        INCRM CYCLE-UP CNTR(UNTIL=5)
253                                    ENDIF
254                              ENDIF
255  06 00152 C36101  N         ELSE:                    NEW SR VALUE NOT AVAILABLE
256  06 00155 3E80    A          SFLG      IMED@DN:      REQUEST AN IMED SHUTDOWN
     06 00157 32A9F4  A
257  06 0015A 2132FD  A          SFBIT,P   E@PR@FLT      SIGNAL EARLY PITCH RESET FAULT
     05 0015D 3E40    A
     06 0015F B6      A
     06 00160 77      A
258                             ENDIF
259  06 00161 E1      A         POP  H                   RESTORE H&L
260                            ENDIF
```

```
261  06 00162 3EFE    A        MVI   A,RSETFF:          RESET PITCH RESET
262  05 00164 3200E6  A        STA   ADDR(EQU,RSINTFF:)      INT FLIP-FLOP
263  06 00167 F1      A        POP   PSW                RESTORE-A=REG & CONDITION BITS
264  06 00168 C9      A        RET                      RETURN TO INTERRUPTED ROUTINE
```

TABLE IX

```
57                        *
58                        *     MACHINE CLOCK INTERRUPT HANDLER
59                        *

61        06   0002B            ORIGIN X'38'             INTERRUPT TRAPCELL LOCATION

64   06 00038 F5      A  MCLK:
                               PUSH  PSW                SAVE A=REG&CONDITION CODES
65   06 00039 3A6EFD  a        LDA   ADR(DATA,MCLK:CNT)
                                                        IS THERE
66   06 0003C 3D      A        DCR   A                        A PITCH
67   06 0003D C26600  N        IF:   CC,Z,S                              EVENT TO DO
68   06 00040 E5      A         PUSH      H              YES SAVE
69   06 00041 D5      A         PUSH      D                      ALL REMAINING
70   06 00042 C5      A         PUSH      B                              REGS
71   06 00043 2A64FD  A         LHLD      ADR(DATA,EV@PTR:)
                                                        H&L=1ST LOC OF NEXT PE TO DO
72   06 00046 7E      A         MOV       A,M            SAVE RELATIVE DIFFERENTIAL TO
73   06 00047 326EFD  A         STA       ADR(DATA,MCLK:CNT)
                                                        NEXT EVENT (# CLOCK COUNTS)
74   06 0004A 23                INX       H              MOVE PNTR TO REL SR IN TABLE
75   06 0004B 3A63FD  A         LDA       ADR(DATA,SR@PTR:)
                                                        LOAD REL POSITION OF SR #0
76   06 0004E 86      A         MODBYT    A,ADD,M        C=LS PORTION OF ADDR OF THE
77   06 0004F E66F    A         MODBYT    A,AND,SR@ADJ:
                                                        REQUESTED SHIFT REGISTER
78   06 00051 4F      A         MOV       C,A            POSITION (FOR USE WITHIN PE)
79   06 00052 06FE    A         MVI       B,HADR(SHIFTREG)
                                                        B&C=ADDR REQUESTED SR POSITION
80   06 00054 0A      A         LDAX      B              A=(REQUESTED SR)POSITION
81   06 00055 23      A         INX       H              E=LS PORTION OF ADDR OF THE
82   06 00056 5E      A         MOV       E,M            REQUESTED PITCH EVENT
83   06 00057 23      A         INX       H              D=MS PORTION OF ADDR OF THE
84   06 00058 56      A         MOV       D,M            REQUESTED PITCH EVENT
85   06 00059 23      A         INX       H              SAVE PNTR TO
86   06 0005A 2264FD  A         SHLD      ADR(DATA,EV@PTR:)
                                                                NEXT PITCH EVENT
87   06 0005D CD0000  N         CALL      DE:IND         VECTOR TO REQUESTED PITCH EVENT
88   06 00060 C1      A         POP       B              RESTORE
89   06 00061 D1      A         POP       D                      SAVED
90   06 00062 E1      A         POP       H                            REGISTERS
91   06 00063 C37000  N        ELSE:
92   06 00066 326EFD  A         STA   ADR(DATA,MCLK:CNT)
                                                        NO PE; SAVE DECRM'D 'MCLK:CNT'
93   06 00069 0F      A         RRC                      IS IT TIME FOR
94   06 0006A D27000  N         IF:       CC,C,S                 A REFRESH
95   06 0006D 3202E6  A           REFRESH                YES, REFRESH REMOTES (1 MSEC)
96                               ENDIF
97                             ENDIF
98   06 00070 FB      A        EI                       RE-ENABLE INTERRUPT SYSTEM
99   06 00071 3EFD    A        MVI   A,MCLKFF:          RESET MCLK
100  06 00073 3200E6  A        STA   ADR(EQU,RSINTFF:)
                                                                INTERRUPT FLIP-FLOP
101  06 00076 F1      A        POP   PSW                RESTORE A-REG & CONDITION CODES
102  06 00077 C9      A        RET                      RETURN TO INTERRUPTED ROUTINE
```

TABLE X

```
139                       *
140                       *     REAL TIME CLOCK INTERRUPT HANDLER
141                       *

143  06 00081 FB      A  RTC:  EI                       RE-ENABLE  INTERRUPTS
144  06 00082 F5      A        PUSH  PSW                SAVE A-REG&CONDITION BITS
145  06 00083 3EF7    A        MVI   A,RTCFF:           RESET RTC
146  06 00085 3200E6  A        STA   ADR(EQU,RSINTFF:)
                                                                INTERRUPT FLIP-FLOP
147  06 00088 D5      A        PUSH  D                  SAVE D&E REGS
148  06 00089 E5      A        PUSH  H                  SAVE H&L REGS
149  06 0008A C5      A        PUSH      B              SAVE 'B' REGISTER
150                       *
151  06 0008B 2150FD  N        DECBYT    GLB:TIMR       DECREMENT THE CLOCK CELL
     06 0008E 35      A
152  06 0008F 7F      A        MOV       A,M            A=(GLB:TIMR)(0 TO 255)
```

```
153  06 00090 23       A        INX        H,                MEM.PTR. TO SB:RQST BYTE
154  06 00091 E601     A        IF:        XBYT,A,AND,X'01',NZ
                                                              IS IT 20 MSEC TIME YET
     06 00093 CA9D00   N
155  06 00096 7E       A         MODBYT     M,OR,10:RQST/20:RQST
                                                              YES-BOTH 10 AND 20 BKGD
     06 00097 F6C0     A
     06 00099 77       A
156  06 0009A C3A100   N        ELSE:
157  06 0009D 7E       A         MODBYT     M,OR,10:RQST
                                                              NO-10 BKGD ONLY
     06 0009E F680     A
     06 000A0 77       A
158                             ENDIF
159  06 000A1 23       A        INX        H                 MEM.PTR. TO DIVD:10 CNTR
160  06 000A2 35       A        DCR        M                 DECREMENT 10 TO 0 COUNTERS
161  06 000A3 C2AD0C   N        IF:        CC,Z,S            HAS 100 MSEC PASSED
162  06 000A6 360A     A         MVI        M,10              YES-RESET THE 10 TO 0 COUNTER
163  06 000A8 2B       A         DCX        H                 MEM.PTR. BACK TO SB:RQST
164  06 000A9 7E       A         MODBYT     M,OR,100:RQST
                                                              ADD 100 BKGD TO REQUEST BYTE
     06 000AAF620      A
     06 000AC77        A
165                             ENDIF
166                             REPEAT                       NOW CHECK FOR TIME OUTS
167  06 00AD 2150FD    N         LXI        H,GLB:TIMR        LOAD 'B' WITH QUANTITY TO LOOK
168  06 000B0 46       A         MOV        B,M               FOR (CLOCK CELL VALUE)
169  06 000B1 15FB     A         MVI        D,COUNT:          SET 'D' FOR TABLE TO SEARCH
170  06 000B3 CD0000   N         CALL       FIND:LOC          GO LOOK IN ACTIVE LIST
171  06 000B6 CAF000   N         IF:        CC,Z,C            HAS A MATCH BEEN FOUND
172  06 000B9 E5       A          PUSH       H                YES-SAVE LOCATION ON STACK
173  06 000BA 26FC     A          MVI       H,ID:             SEGWAY MEM PTR TO ID: TABLE
174  06 000BC 5E       A          MOV       E,M               NOW ASSEMBLE
175  06 000BD 1600     A          MVI       D,O               ADDRESS OF TIMER
176  06 000BF 21C8F4   A          LXI       H,TMR:FLGS        FLAG INTO THE
177  06 000C2 19       A          DAD       D                 MEMORY POINTER
178  06 000C3 0600     A          MVI       B,0               GET SET TO CLEAR THE FLAG
179  06 000C5 F3       A          DI                          NO INTERRUPTIONS NOW, PLEASE
180  06 000C6 7E       A          MOV       A,M               GET FLAG
181  06 000C7 07       A          RLC                         INTO THE CARRY BIT
182  06 000C8 D2EC00   N          IF:       CC,C,S            IS FLAG SET
183  06 000CB 70       A                MOV      M,B          YES-RESET AND NOW
184  06 000CCFB        A                EI                    EVERYBODY CAN INTERRUPT AGAIN
185  06 000CDE1        A                POP      H            LOCATION FROM STACK TO MEM PTR
186  06 000CE 26FD     A                MVI      H,LS:ADDR    SEGWAY MEM PTR TO LS: TABLE
187  06 000D0 5E       A                MOV      E,M          GET LS TIME-OUT ADDRESS
188  06 000D1 24       A                INR      H            SEGWAY MEM PTR TO MS: TABLE
189  06 000D2 56       A                MOV      D,M          GET MS TIME-OUT ADDRESS
190  06 000D3 45       A                MOV      B,L          LOCATION TO 'B' TEMPORARILY
191  06 000D4 2A5FFD   N                LHLD     INPTR:       STUFF TIME-OUT ADDRESS INTO
192  06 000D7 73       A                MOV      M,E          INTO TABLE OF TIME-OUT
193  06 000D8 23       A                INX      H            ADDRESSES THAT IS CHECKED
194  06 000D9 72       A                MOV      M,D          FOR ENTRIES EVERY 10 MSECONDS
195  06 000DA23        A                INX      H            BY THE STATE CHECKER
196  06 00DB 7D        A                MODBYT L,AND,TIME:MSK
                                                             FORCE A CIRCULAR TABLE
     06 000DCE62F      A
     06 000DE6F        A
197  06 000DF 225FFD   N                SHLD     INPTR:       SAVE NEW ADDRESS LOCATION
198  06 000E2 58       A                MOV      E,B          LOCATION BACK TO 'E'
199  06 000E3 CD0000   N                CALL     DEACTIV:     TAKE OUT OF ACTIVE TIMER LIST
200  06 000E6 CD0000   N                CALL     PUT:         AND MAKE LOCATION AVAILABLE
201  06 000E9 C3EE00   N           ELSE:                      ***FLAG IS NOT SET SO
202  06 000EC FB       A                EI                    LET INTERRUPTIONS OCCUR
203  06 000ED E1       A                POP      H            MAKE THE STACK RIGHT AND
204                                  ENDIF                   FORCE NON-ZERO CONDITION TO
205  06 000EE F601     A           MODBYT     A,OR,1         STAY IN UNTIL LOOP
206                                ENDIF                     ***NO MATCH-RTC COMPLETE
207  06 000F0 C2AD00   N        UNTIL:     CC,Z,S            WILL FALL THROUGH THIS CRACK
208                        *
209  06 000F3 E1       A        POP        H                 RESTORE THE
210  06 000F4 44       A        MOV        B,H               'B' REGISTER
211  06 000F5 E1       A        POP        H                 RESTORE H&L REGS
212  06 000F6 D1       A        POP        D                 RESTORE D&E REGS
213  06 000F7 F1       A        POP        PSW               RESTORE A-REG & CONDITION CODES
214  06 000F8 C9       A        RET                          RETURN TO 'FLOAT' BACKGROUND
215                        *
```

TABLE XI

```
854  05 00546 3AB0F4   A  ADH@CTRL
                             IF:        FLG,ADH@SELC,T    ADH SELECTED
     05 00549 07       A
     05 0054A D2E805   N
855  05 0054D CDA004   N        CALL       SEN@READ          CHECK ADH INPUT SENSORS
856  05 00550 CAE505   N        IF:        CC,Z,C            CHANGE STATE IF SENSOR CHANGE
857  05 00553 57       A         MOV      D,A                 SAVE CHANGE MASK IN D REG
```

```
05 00554 A0       A        ANA    B                FIND LEAD EDGES
05 00556 5F       A        MOV    E,A              SAVE LEAD EDGES IN E REG
05 00556 2F       A        CMA
05 00557 A2       A        ANA    D                FIND TRAIL EDGES
05 00558 21B9FC   AN       LXI    H,TEDGINH        SET PNTR TO TEDG INHIBIT MASK
05 0055B A6       A        ANA    M                MASK OUT INHIBITED SENSORS
05 0055C CA9E05   N        IF:    CC,Z,C           ANY TRAIL EDGES THIS READ
05 0055F 57       A            MOV    D,A          SAVE TRAIL EDGES IN D REG
05 00560 23       A            INX    H            MOV PNTR TO TEDG BYPASS MASK
05 00561 A6       A            ANA    M            MASK OUT INDETERMINENT TRAIL ED
05 00562 47       A            MOV    B,A          SAVE VALID TRAIL EDGES
05 00563 23       A            INX    H            MOV PNTR TO TRAIL EDGE EXPECTED
05 00564 7E       A            MOV    A,M          FETCH EXPECTED TRAIL EDGES
05 00565 2F       A            CMA
05 00566 A0       A            ANA    B            COMPARE ACTUAL AND
                                                   EXPECTED TRA
05 00567 C29605   N            IF:    CC,Z,S       NO UNEXPECTED TRAIL EDGES
05 0056A B2       A              ORA    D          RESTORE TRAIL EDG BYE/SET CC FC
05 0056B 1600     A              MVI    D,0        CLR CASE BRANCH TABLE POINTER
                                 REPEAT
05 0056D 17       A                RAL
05 0056E D28E05   N                IF:  CC,C,S
05 00571 D5       A                  PUSH    D
05 00572 F5       A                  PUSH    PSW
05 00573 7A       A                  CASE:   VBYT,D
05 00574 118C05   N
05 00577 FE08     A
05 00579 CD0000   N
05 0057C 0108     N                    C,O      TEDGFDOF FEED-OFF TRAIL EDGE ROUT
05 0057E C408     N                    C,1      TEDGWAIT WAIT TRAIL EDGE ROUTINE
05 00580 F308     N                    C,2      TEDGRET RETURN TRAIL EDGE ROUTINE
05 00582 EE05     N                    C,3      SPARE SPARE POSITIOIN IN SCREWED U
05 00584 0208     N                    C,4      TEDGEXIT EXIT TRAIL EDGE ROUTINE
05 00586 3A09     N                    C,5      TEDGKICK KICK TRAIL EDGE ROUTINE
05 00588 EE05     N                    C,6      SPARE SPARE POSITION IN SCREWED U
05 0058A 5409     N                    C,7      TEDGIEMP INPUT EMPTY TRAIL EDGE R
                                     ENDCASE
05 0058C F1       A                    POP    PSW
05 0058D D1       A                    POP    D
                                   ENDIF
05 0058E 14       A                  INR  D        INCREMENT CASE TABLE POINTER
05 0058F B7       A                  ORA A         CHECK FOR ADDITIONAL TRAIL EDGE
05 00590 C26D05   N                UNTIL:   CC,Z,S LOOP UNTIL NO MORE TRAIL EDGES
05 00593 C39E05   N              ELSE:
05 00596 2134FD   A                LXIFBYT  H,ADH:1
                                                   SET PNTR TO PRIMARY FAULT BYTE
05 00599 B6       A                ORA      M       SAVE INVALID TRAIL EDGES IN FAU
05 0059A 77       A                MOV      M,A
05 0059B CDA309   N                CALL     ADH@ABRT
                                                   ABORT ADH
                                 ENDIF
                           ENDIF
05 0059E 7B       A        MOV        A,E
05 0059F 21BCFC   N        LXI        H,LEDGINH    SET PNTR TO LEAD EDGE INHIBIT M
05 005A2A6        A        ANA        M            MASK OUT INHIBITED SENSORS
05 005A3 CAE505   N    IF: CC,Z,C LEAD EDGES THIS READ
05 005A6 5F       A            MOV      E,A        SAVE VALID LEAD EDGES
05 005A7 23       A            INX      H          MOV PNTR TO LEAD EDGE BYPASS MA-
05 005A8 A6       A            ANA      M          MASK OUT INDETERMINENT LEAD EDG
05 005A9 47       A            MOV      B,A        SAVE VALID LEAD EDGES IN B-REG
05 005AA 23       A            INX      H          MOV PNTR TO LEAD EDGE EXPECTED
05 005AB 7E       A            MOV      A,M        FETCH EXPECTED LEAD EDGES
05 005AC 2F       A            CMA
05 005AD A0       A            ANA      B          COMPARE ACTUAL WITH EXPECTED LE
05 005AE CABC05   N            IF:      CC,Z,C
05 005B1 2134FD   A              LXIFBYT  H,ADH:1  SET PNTR TO PRIMARY FAULT BYTE
05 005B4 B6       A              ORA      M        SAVE INVALID LEAD EDGES
05 005B5 77       A              MOV      M,A
05 005B6 CDA309   N              CALL     ADH@ABRT
                                                   ABORT ADH
05 005B9 C3E505   N            ELSE:
05 005BC B3       A              ORA      E        FETCH LEAD EDGES (IF ANY)
05 005BD 1600     A              MVI      D,)      SET POINTER TO ZERO
                                 REPEAT
05 005BF 17       A                RAL
05 005C0 D2E005   N                IF:      CC,C,S
05 005C3 5F       A                  MOV  E,A      SAVE LEAD EDGE BYTE
05 005C4 D5       A                  PUSH D
05 005C5 7A       A                  CASE: VBYT,D
05 005C6 11DE05   N
05 005C9 FE08     A
05 005CB CD0000   N
05 005CE 00008    N                    C,O      LEDGFDOF FEED-OFF LEAD EDGE ROUTI
05 005D0 5D07     N                    C,1      LEDGWAIT WAIT LEAD EDGE ROUTINE
05 005D2 AF07     N                    C,2      LEDGRET RETURN LEAD EDGE ROUTINE
05 005D4 EE05     N                    C,3      SPARE SPARE POSITION IN SCREWED U
05 005D6 B206     N                    C,4      LEDGEXIT EXIT LEAD EDGE ROUTINE
05 005D8 9207     N                    C,5      LEDGKICK KICK LEAD EDGE ROUTINE
05 005DA EE05     N                    C,6      SPARE SPARE POSITION IN SCREWED U
```

```
937  05 005DCCB07   N                C,7      LEDGIEMP INPUT EMPTY LEAD EDGE RO
938                                ENDCASE
939  05 005DE D1    A              POP    D
940  05 005DF 7B    A              MOV    A,E   RESTORE LEAD EDGE BYTE
941                              ENDIF
942  05 005E0 14    A            INR      D
943  05 005E1 B7    A            ORA      A
944  05 005E2 C2BF05 N         UNTIL   CC,Z,S   LOOP UNTIL NO MORE LEAD EDGES
945                         ENDIF
946                       ENDIF
947                     ENDIF
948  05 005E5 C3ED05 N    ELSE:                 ADH NOT SELECTED
949  05 005E8 3E80   A      SFLG     ADH@NMOV  INDICATE NO ADH PROBLEMS
     05 00EA  328BF7 A
950                     ENDIF
951  05 005ED C9     A  RET

953  05 005EE C9     A SPARE
                        RET                    DUMMY ROUTINE FOR CASE TABLES
```

TABLE XII

```
1012                  *
1013                  *
1014                  *    REVERSE:ROUTINE TO ENGAGE THE REVERS
1015                  *    CLUTCH AND START A SLOW-OFF SEQ.
1016                  *
1017                  *

1019 05 00667 CD0000 N REVERSE
                        STIMR      ADH@4,300,PLT@EXIT
                                                  ALLOW 300MS FOR DOC TO GET TO E
     05 0066A 04     A
     05 0066B 1E     A
     05 0066C A50A   N
1020 05 0066E 3A50FD N  DIAG@CT    ADH@CPDC  STORE START OF CLEAR PLATEN SEQ
     05 00671 32BFFC N
1021 05 00674 3E08   A  MVI        A,ADH@LP
1022 05 00676 32BEFC N  STA        LEDGEXPT  LOOK FOR LEAD EDGE AT EXIT
1023 05 00679 21BAFC N  LXI        H,TEDGMASK
1024 05 0067C 3E20   A  MVI        A,RETURN@4
1025 05 0067E B6     A  ORA        M         START CHECKING RETURN SENSOR
1026 05 0067F 77     A  MOV        M,A
1027 05 00680 CD340C N  CALL       REVR@ON   TURN ON REVERSE CLUTCH
1028 05 00683 3A1AF4 A  IF:        FLG,ADH@SPRC,F
                                                  NOT DOING RECOVERY ON LAST ORIG
     05 00686 07     A
     05 00687 DA8D06 N
1029 05 0068A CD0000 N    CALL      INC@ORFH  INCREMENT DOCUEMENT COUNTER
1030                    ENDIF
1031 05 0068D C9     A  RET
```

TABLE XIII

```
601                   *
602                   *    INCREMENT ORIGINALS FLASHED AND DOCUMENT NUMBER
                           ROUTINE
603                   *

605  05 0054A 2174FC N INC@ORFH
                        INCBYT     ORIG@FLH  INCREMENT THE ORIGINAL FLASHED
     05 0054D 34     A
606                   *                       COUNTER
607  05 0054E 3A38F4 A  IF:        FLG,LST@ORG,F
                                                  DON'T INCREMENT IF LAST ROIG
     05 00551 07     A
     05 00552 DA6805 N
608  05 00555 2A50FB N    LHLD DOC@NUMB
609  05 00558 CD0000 N    CALL BCD@INC          INCREMENT DOCUMENT COUNTER
610  05 0055B 2250FB N    SHLD DOC@NUMB
611  05 0055E CD0B07 N    CALL DIG@FIX          GET DISPLAY DIGIT DRIVE BITS
612  05 00561 3267FA N    STA  DC@DIGIT
613  05 00564 AF     A  CFLG  DSPL@1ST         UPDATE DISPLAY
     05 00565 329AF4 A
614                     ENDIF
615  05 00568 C9     A  RET
```

TABLE XIV

```
1220                        *
1221                        *
1222                        *     LEDGIEMP:ROUTINE CALLED BY ADH@CTRL
1223                        *     WHENEVER THE INPUT GETS EMPTY THE
1224                        *     ROUTINE SETS THE ODD LAST FLAGS IF
1225                        *     NECESSARY, CHECKS OR UPDATES THE
1226                        *     TOTAL NUMBER OF DOCUMENTS AND SETS
1227                        *     THE DOCUMENT FAULT FLAG IF VALID
1228                        *
1229                        *

1231 05 007CB 3A04F4  A  LEDGIEMP
                               LDAFLG     ADH@FORW  FETCH ADH DIRECTION FLAG
1232 05 007CE B7      A        ORA        A         CHECK DOC MOVING (SWITCH DEBOUNC
1233 05 007CF F2FF07  N        IF:        CC,S,S    VALID INDICATION OF INPUT EMPTY
1234 05 007D2 2138F4  A         MODFLG     LST@ORG  SET LAST ORIGINAL FLAG
1235 05 007D5 3A4AF4  A         LDAFLG     SIDES@1  SIDE 1'S ABOUT TO BE MADE
1236 05 007D8 47      A         MOV        B,A
1237 05 007D9 3AAFF4  A         LDAFLG     SL1@DLY
1238 05 007DC 2F      A         CMA
1239 05 007DD A0      A         ANA        B        AND NOT JUST STILL BEING DELIVE
1240 05 007DE F2E707  N         IF:        CC,S,S   IF SO THEN
1241 05 007E1 3223F4  A           MODFLG     ODD@LAST
                                                    INDICATE ODDLAST
1242 05 007E4 3253F4  A           MODFLG     SRT@ODD AND MADE SURE SORTER REMEMBERS
1243                            ENDIF
1244 05 007E7 216FFA  N         LXI        H,DOC@TOTL
1245 05 007EA 3A74FC  N         LDA        ORIG@FLH  FETCH CURRENT DOCUEMENT TOTAL
1246 05 007ED 3C      A         INR        A         ADD 1 FOR ONE GOING TO PLATEN
1247 05 007EE 47      A         MOV        B,A       SAVE UPDATED DOCUEMENT TOTAL
1248 05 007EF 7E      A         IF:        VBYT,M,Z  FIRST PASS
     05 007F0 A7      A
     05 007F1 C2F807  N
1249 05 007F4 70      A           MOV        M,B      STORE DOCUEMENT TOTAL
1250 05 007F5 C3FF07  N         ORIF:      XBYT,A,NE,B COUNT ERROR
     05 007F8 B8      A
     05 007F9 CAFF07  N
1251 05 007FC CD9609  N           CALL       DBFD@FLT
                                                    DOUBLE FEED FAULT
1252                            ENDIF
1253                           ENDIF
1254 05 007FF C9      A        RET
```

TABLE XV

```
1694                        *
1695                        *
1696                        *     ADH@REG2:FINAL PART OF REG SEQUENCE,
1697                        *     TURNS OFF REVERSE CLUTCH, CHECKS
1698                        *     FOR JUMPED EDGE AND DECLARES FAULT
1699                        *     OR READY FOR PRINT ACCORDINGLY.
1700                        *
1701                        *

1703 05 00B38 CD3E0C N  ADH@REG2
                               CALL       REVR@OFF  TURN OFF REVERSE CLUTCH
1704 05 00B3B AF      A        CFLG       DSPL@1ST  UPDATE DISPLAY(FOR DOCUEMENT NU
     05 00B3C 329AF4  A
1705 05 00B3F 2F      A        CMA
1706 05 00B40 3219F4  A        MODFLG     DOC@PLAT  INDICATE DOCUEMENT ON THE PLATE
1707 05 00B43 CD8A0E  N        CALL       ADH@RETN  CHECK DOC HAS CLEARED RETURN SE
1708 05 00B46 3A6AFA  N        IF:        XBYT,ADH@LSTR,AND,EXIT@3,NZ
                                                    JUMPED EDGE
     05 00B49 E608    A
     05 00B4B CA620B  N
1709 05 00B4E CD0000  N         STIMR      ADH@11,250,ADH@MOTF
                                                    DELAY FOR FEED&TURN OFF MOTOR
     05 00B51 0B      A
     05 00B52 19      A
     05 00B53 AA0C    N
1710 05 00B55 2139FD  A         SFBIT,P    ADH@JEDG  SET A JUMP REG EDGE FAULT
     05 00B58 3E08    A
     05 00B5A B6      A
     05 00B5B 77      A
1711 05 00B5C CD1E0A  N         CALL       JAM@CLMP  DO COMMON JAM CLEAN UP
1712 05 00B5F C3220C  N        ORIF:       FLG,ADH@JAM,F
                                                    NO ADH JAM
     05 00B62 3A09F4  A
     05 00B65 07
     05 00B66 DA220C  N
1713 05 00B69 21BCFC  N         LXI        H,LEDGINH SET PNTR TO LEAD EDGE INHIBIT M
1714 05 00B7C 3E28    A         MVI        A,ADH@RG2M
1715 05 00B6E B6      A         ORA        M         RESET INHIBIT OF EXIT AND RETUR
```

```
1716 05 00B6F 77        A        MOV        M,A
1717 05 00B70 3A07F4    A        IF:        FLG,ADH@JOBR,T
     05 00B73 07
     05 00B74 D2F10B    N
1718 05 00B77 3A20FB    A        IF:        FBIT,TS@ADHJR,F
                                                JOB RECOVERY STARTED
     05 00B7A E640      A
     05 00B7C C2E70B    N
1719 05 00B7F 3AB4F4    A        ANDIF:  FLG,ADH@29@4,F
                                                JO HALT PENDING
     05 00B82 07        A
     05 00B83 DAE70B    N
1720 05 00B86 3A74FC    N            IF  XBYT,ORIG@FLH,EQ,ORIG@DLV
                                                RECOVERY COMPLETE
     05 00B89 2173FC    N
     05 00B8C BE        A
     05 00B8D C2CC0B    N
1721 05 00B90 AF        A              CFLG      ADH@JOBR
     05 00B91 3207F4    A
1722 05 00B94 2F        A              CMA
1723 05 00B95 328BF7    A              MODFLG  ADH@NMOV
                                                SET ADH READY (RECOVERY COMPLETE
1724 05 00B98 2121FB    A              CFBIT,F   ADH@JRLP
                                                TURN OFF JOB RECOVERY LAMP
     05 00B9B 3EBF      A
     05 00B9D A6        A
     05 00B9E 77        A
1725 05 00B9F 214AFD    A              CFBIT     ADH@BLKW
                                                CANCELL WAIT LAMP BLINK REQUEST
     05 00BA2 3EFD      A
     05 00BA4 F3        A
     05 00BA5 A6        A
     05 00BA6 77        A
     05 00BA7 FB
1726 05 00BA8 3A1AF4    A              IF:       FLG,ADH@SPRC,T
                                                RECOVERING LAST ORIGINAL
     05 00BAB 07        A
     05 00BACD2C60B     N
1727 05 00BAF 3A38F4    A                IF: FLG,LST@ORG,T
                                                RECOVERY DONE PROPERLY
     05 00BB2 07        A
     05 00BB3 D2C00B    N
1728 05 00BB6 CD0000    N                STIMR   ADH@15,70,ADH@CPLT
                                                DELAY AND CLEAR OF
     05 00BB9 0F        A
     05 00BBA 07        A
     05 00BBB A006      N
1729 05 00BBD C3C308    N                ELSE:         INPROPER RECOVERY (TO MANY ORIG
1730 05 00BC0 CD9609    N                 CALL  DBFD@FLT
                                                INDICATE COUNT ERROR (DOC TOT
1731                                     ENDIF
1732 05 00BC3 C3C90B    N              ELSE:          RECOVERY COMPLETE
1733 05 00BC6 CDAA0C    N                CALL    ADH@MOTF
1734                                   ENDIF
1735 05 00BC9 C3E40B    N             ORIF:       FLG,LST@ORG,T
     05 00BCC 3A38F4    A
     05 00BCF 07        A
     05 00BD0 D2DD0B    N
1736 05 00BD3 CD0000    N               STIMR   ADH@15,70,ADHRCYCL
                                                CLEAR PLATEN, FLIP BAIL, AND
     05 00BD6 0F        A
     05 00BD7 07        A
     05 00BD8 A906      N
1737                        *                   CONTINUE JOB RECOVERY
1738 05 00BDA C3E40B    N              ELSE:
1739 05 00BDD CD0000    N               STIMR   ADH@15,70,ADH@CYCL
     05 00BE0 0F        A
     05 00BE1 07        A
     05 00BE2 4906      N
1740                                   ENDIF
1741 05 00BE4 C3EE0B    N             ELSE                STILL WAITING FOR OPERATOR(ED)
1742 05 00BE7 AF        A              CFLG      ADH@29@4
                                                CLEAN UP
     05 00BE8 32B4F4    A
1743 05 00BEB CDAA0C    N              CALL      ADH@MOTF
                                                TURN OFF ADH MOTOR(JAM REC COMP
1744                                   ENDIF
1745 05 00BEE C3220C    N         ORIF:     FLG,UP@MOD,T
                                                PROGRAMER UPDATE COMPLETE
     05 00BF1 3A98F4    A
     05 00BF4 07        A
     05 00BF5 DA1DOC    N
1746 05 00BF8 3A6FFA    N         ANDIF:    VBYT,DOC@TOTL,NZ
                                                1ST PASS COMPLETE
     05 00BFB A7        A
     05 00BFC CA1DOC    N
1747 05 00BFF 3D        A             DCR         A       DECREMENT DOC TOTAL FOR LAST OR
     05 00C00 47        A             IF:         XBYT,ORIG@FLH,GE,A
                                                NO MORE ORIGINALS ANTICIPATED
```

```
     05 00C01 3A74FC  N
     05 00C04 B8      A
     05 00C05 DA150C  N
1749 05 00C08 3A38F4  A          ANDIF:     FLG,LST@ORG,F
                                                AND NOT WORKING ON THE LAST ONE
     05 00C0B 07      A
     05 00C0C DA150C  N
1750 05 00C0F CD9609  N           CALL     DBFD@FLT
                                                SET DOUBLE FEED FAULT
1751 05 00C12 C31A0C  N          ELSE                NO MORE DOCUEMENTS THAN 1ST PAS
1752 05 00C15 3E80    A                 SFLG   ADH@NMOV
                                                INDICATE ADH REDY FOR FLASH
     05 00C17 328BF7  A
1753                              ENDIF
1754 05 00C1A C3220C  N          ELSE:               1ST PASS THROUGH ORIGINALS
1755 05 00C1D 3E80    A           SFLG     ADH@NMOV
                                                INDICATE ADH READY FOR FLASH
     05 00C1F 327BF7  A
1756                         ENDIF
1757                       ENDIF
1758 05 00C22 C9      A    RET
```

TABLE XVI

```
1467                 *
1468                 *
1469                 *    DBFD@FLT:CLEAN UP ROUTINE FOR DOUBLE
1470                 *    FEED (DIFFERENT # OF ORIGINALS
1471                 *    SINCE FIRST PASS), SETS FAULT AND
1472                 *    ABORTS ADH.
1473                 *
1474                 *

1476 05 00996 2134FD  A DBFD@FLT
                           SFBIT  ADH@DBFD        SET DOUBLE FEED FAULT
     05 009993E02     A
     05 0099B F3      A
     05 0099C B6      A
     05 0099D 77      A
     05 0099E FB      A
1477 05 0099F CDA309  N    CALL   ADH@ABRT        ABORT ADH
1478 05 009A2 C9      A    RET
```

TABLE XVII

```
1481                 *
1482                 *
1483                 *    ADH@ABRT:CLEAN UP ROUTINE CALLED IF
1484                 *    A DOCUMENT IS AT AN UNEXPECTED
1485                 *    LOCATION(I.E. DOCUMENT ARRIVING
1486                 *    OR DEPARTING A SENSOR AT AN UNEX-
1487                 *    PECTED TIME, INPUT NOT EMPTY AT
1488                 *    A FLIP REQUEST, DOUBLE FEED, ETC.)
1489                 *    ROUTINE SHUTS DOWN THE ADH(JOB
1490                 *    INTEGRATY PROBLEM:NON RECOVERABLE)
1491                 *
1492                 *

1494 05 009A3 AF      A ADH@ABRT
                           CFLG   ADH@JOBR        CANCELL ADH JOB RECOVERY
     05 009A4 3207F4  A
1495 05 009A7 3239FD  A    STA    ADR(FBYT,ADH:2) CLEAR 2NRDY ADH FAULTS
1496 05 009AA 323AFD  A    STA    ADR(FBYT,ADH:3)
1497 05 009AD 2F      A    CMA
1498 05 009AE 3202F4  A    MODFLG     ADH@ABOR    INDICATE ADH ABORTED
1499 05 009B1 3209F4  A    MODFLG     ADH@JAM     SET ADH JAM FLAG FOR CLEARANCE
1500 05 009B4 CD0000  N    CTIMR      ADH@0,ADH@16
                                                  CLEAN UP ALL ADH TIMERS
     05 009B7 0011    A
1501 05 009B9 21E9FF  A    COBIT      ADH$FLIP
     05 009BC 3EFB    A
     05 009BE F3      A
     05 009BF A6      A
     05 009C9 77      A
     05 009C1 FB      A
1502 05 009C2 2121FB  A    CFBIT      ADH@JRLP    TURN OFF JOB RECOVERY LAMP
     05 009C5 3EBF    A
     05 009C7 F3      A
     05 009C8 A6      A
     05 009C0 77      A
     05 009CAFB       A
```

```
1503 05 009CB 214AFD A     CFBIT     ADH@BLKW  CANCEL ADH WAIT LAMP BLINK REG
     05 009CE 3EFD   A
     05 009D0 F3     A
     05 009D1 A6     A
     05 009D2 77     A
     05 009D3 FB     A
1504 05 009D4 CD520C N     CALL      FEED@OFF  T JRN OFF FEEDER
1505 05 009D7 CDF609 N     CALL      FOR@EXIT  ALL JAM CLEAN UPS ARE NECESSARY
1506 06 009DACDBF0A N      CALL      ADH@R@E   CAN NOT BE PREDICTED WHEN
1507 05 009DDCD7B0C N      CALL      KICKOFF   DOCUMENT FOUND OUT OF SEQUENCE
1508 05 009E0 C9     A     RET
```

Figure 40A:
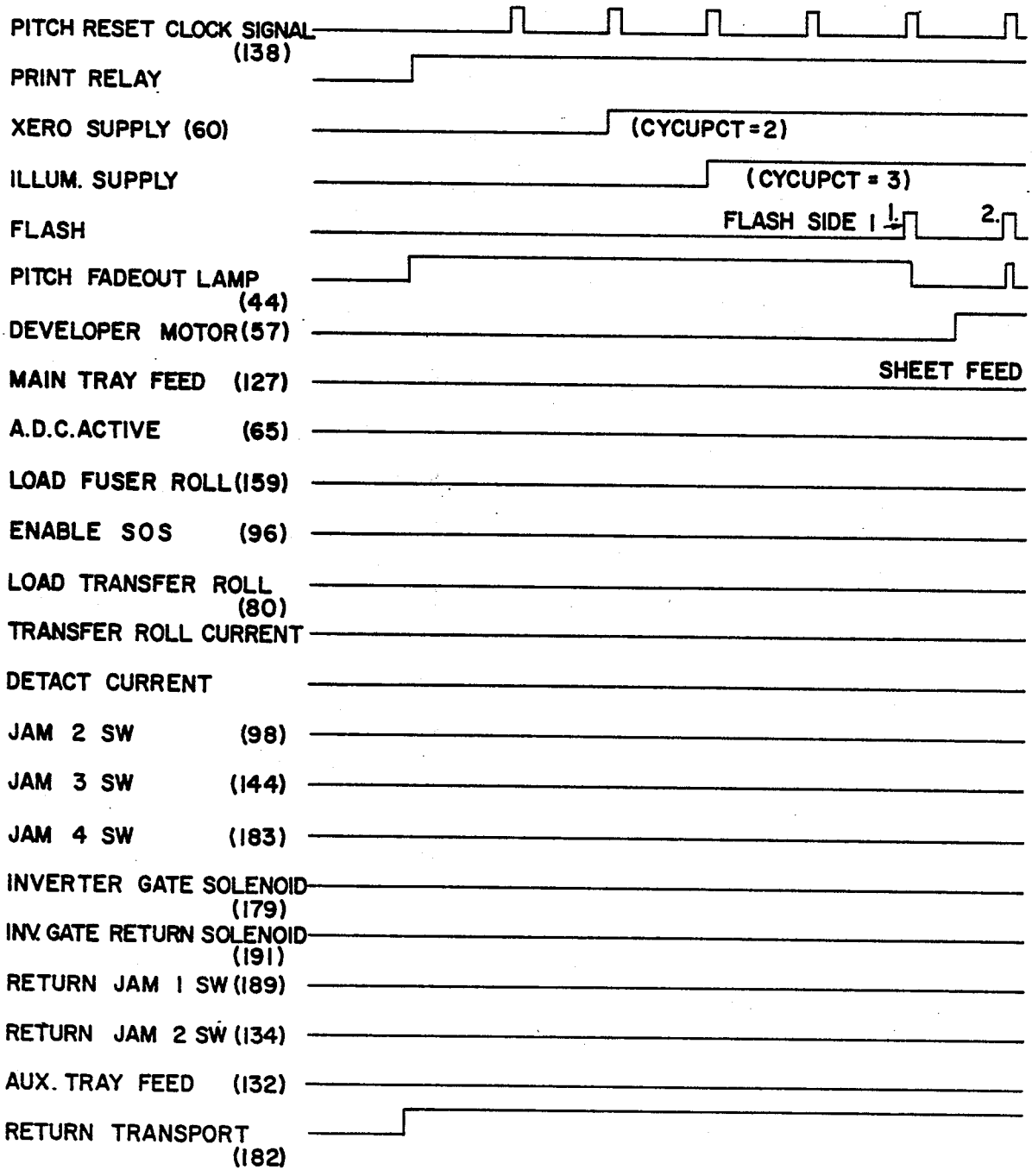
FIGS. 40*a*, 40*b*, 40*c* are a timing chart of the principal operating components of the host machine in an exemplary copy run.
Figure 40B:
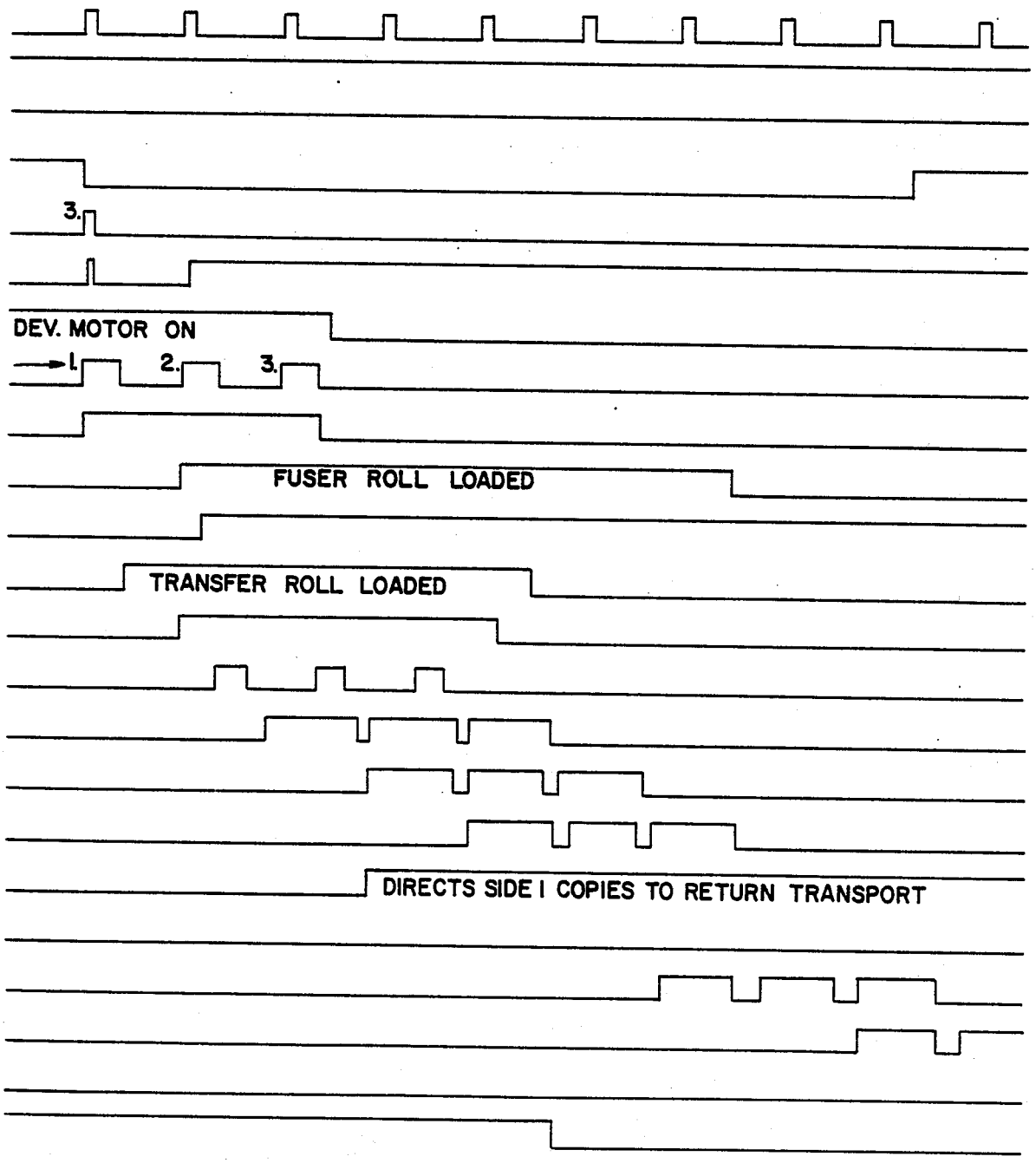
Figure 40C:
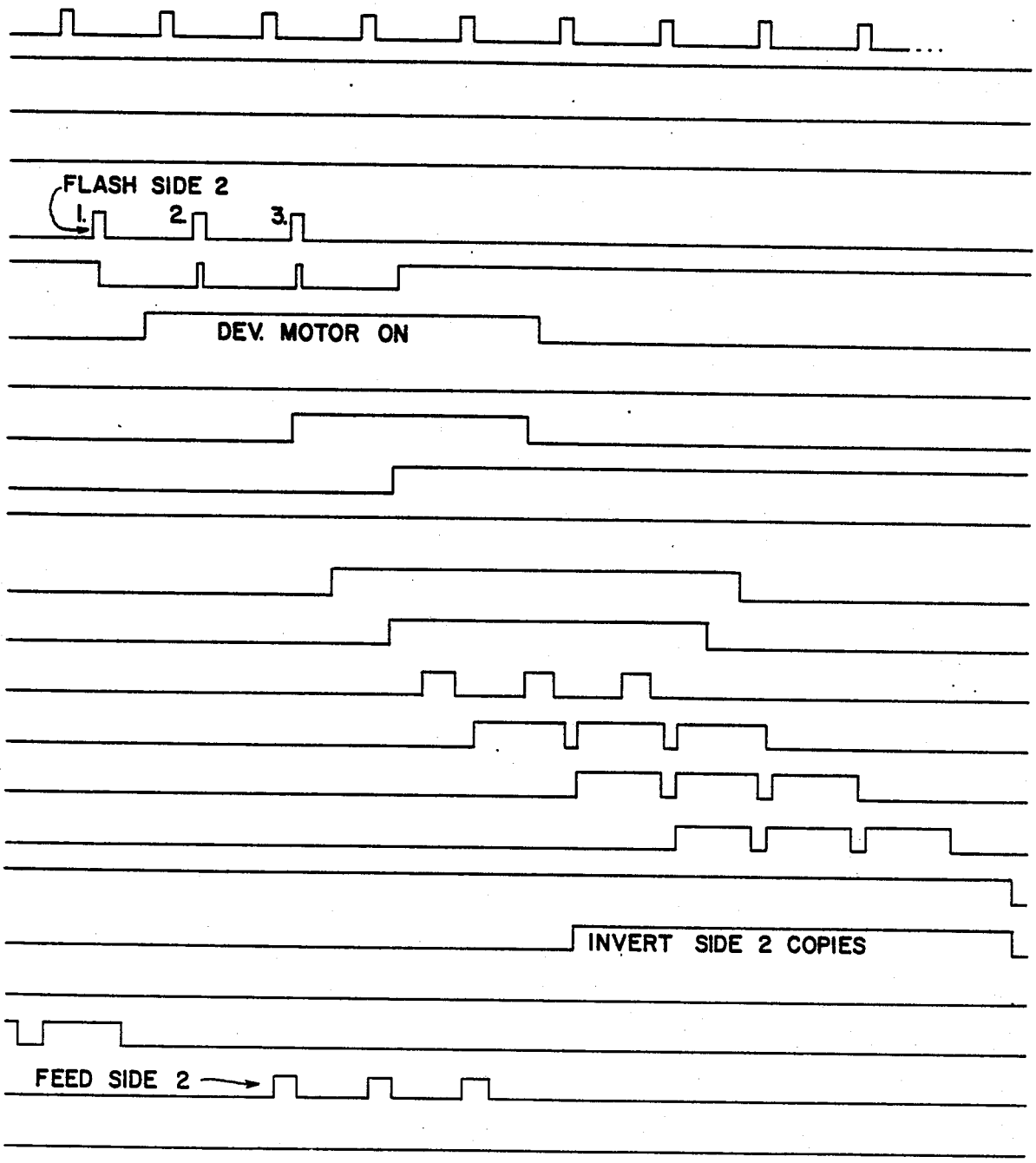

Referring particularly to the timing chart shown in FIG. 40, an exemplary copy run wherein three copies of each of two simplex or one-sided originals in duplex mode is made. Referring to FIG. 32, the appropriate button of copy selector 808 is set for the number of copies desired, i.e. 3 and document handler button 822, sorter select button 825 and two sided (duplex) button 811 depressed. The set of originals, in this case, two simplex or one-sided originals are loaded into tray 233 of document handler 16 (FIG. 14) and the Print button 805 depressed. On depression of button 805, the host machine 10 enters the PRINT state and the Run Event Table for the exemplary copy run programmed is built by controller 18 and stored in RAM section 546. As described, the Run Event Table together with Background routines serve, via the multiple interrupt system and output refresh (through D.M.A.) to operate the various components of host machine 10 in integrated timed relationship to produce the copies programmed.

Figure 41:
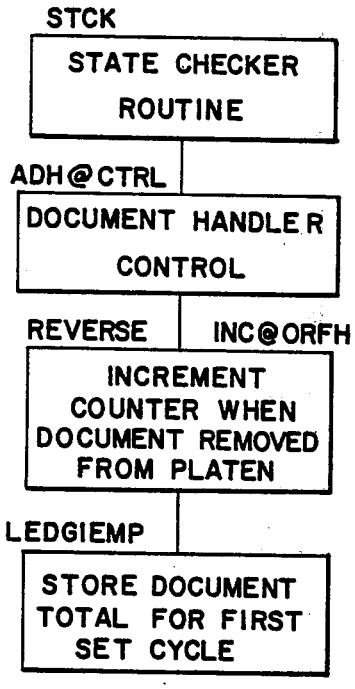
FIG. 41 is a flow chart of the routines for counting the number of documents placed on the exposure platen.

During the run, the first original is advanced onto platen 35 by document handler 16 where, as seen in FIG. 41, three exposures (1ST FLASH SIDE 1) are made producing three latent electrostatic images on belt 20 in succession. As described earlier, the images are developed at developing station 28 and transferred to individual copy sheets fed forward (1ST FEED SIDE 1) from main paper tray 100. The sheets bearing the images are carried from the transfer roll/belt nip by vacuum transport 155 to fuser 150 where the images are fixed. Following fusing, the copy sheets are routed by deflector 184 (referred to as an inverter gate in the tables) to return transport 182 and carried to auxiliary tray 102. The image bearing sheets entering tray 102 are aligned by edge patter 187 in preparation for refeeding thereof.

Following delivery of the last copy sheet to auxiliary tray 102, the document handler 16 is activated to remove the first original from platen 35 and bring the second original into registered position on platen 35. The second original is exposed three times (FLASH SIDE 2), the resulting images being developed on belt 20 at developing station 28 and transferred to the opposite or second side of the previously processed copy sheets which are now advanced (FEED SIDE 2) in timed relationship from auxiliary tray 102. Following transfer, the side two images are fused by fuser 150 and routed, by gate 184 toward stop 190, the latter being raised for this purpose. Abutment of the leading edge of the copy sheet with stop 190 causes the sheet trailing edge to be guided into discharge chute 186, effectively inverting the sheet, now bearing images on both sides. The inverted sheet is fed onto transport 181 and into an output receptacle such as sorter 14 where, in this example, the sheets are placed in successive ones of the first three trays 212 of either the upper of lower arrays 210, 211 respectively depending on the disposition of deflector 220.

DOCUMENT HANDLER DOUBLE FEED DETECTION

In some cases it is necessary for document handler 16 to recycle a set of original documents 2 to make more copies from them. For example, the number of copies desired may exceed the capacity of sorter 14. On the other hand, if document handler 16 is of the recirculating type which provides precollated copies (i.e. where only one copy at a time is made from successive originals), the set of originals must be recycled for every book desired. For purposes of this invention, a set means a group of original documents 2; a set cycle means the transportation of a set from tray 233 to platen 35, and back to tray 233; and a book is a group of copies of a set. It can be readily envisioned that the number of copies (pages) in the books will not be uniform if the total number of originals placed on the platen 35 is different for successive set cycles. For example, if the number of originals in the set is twenty-five and two of the documents stick together (double feed) during one cycle, the one book will only contain twenty-four pages while the remaining books will contain twenty-five pages (assuming no double feeds) since there were only twenty-four originals 2 placed on the platen 35 during the one cycle. Technically, of course, there were twenty-five documents 2 actually placed on the platen 35 during the misfeed cycle, but the machine sensors have no way of detecting the two documents stuck together and considers them as one document for purposes of machine control. Consequently, for ease in describing this invention, recitation relating to the number of documents means the number of documents as sensed by the machine.

Figure 42:
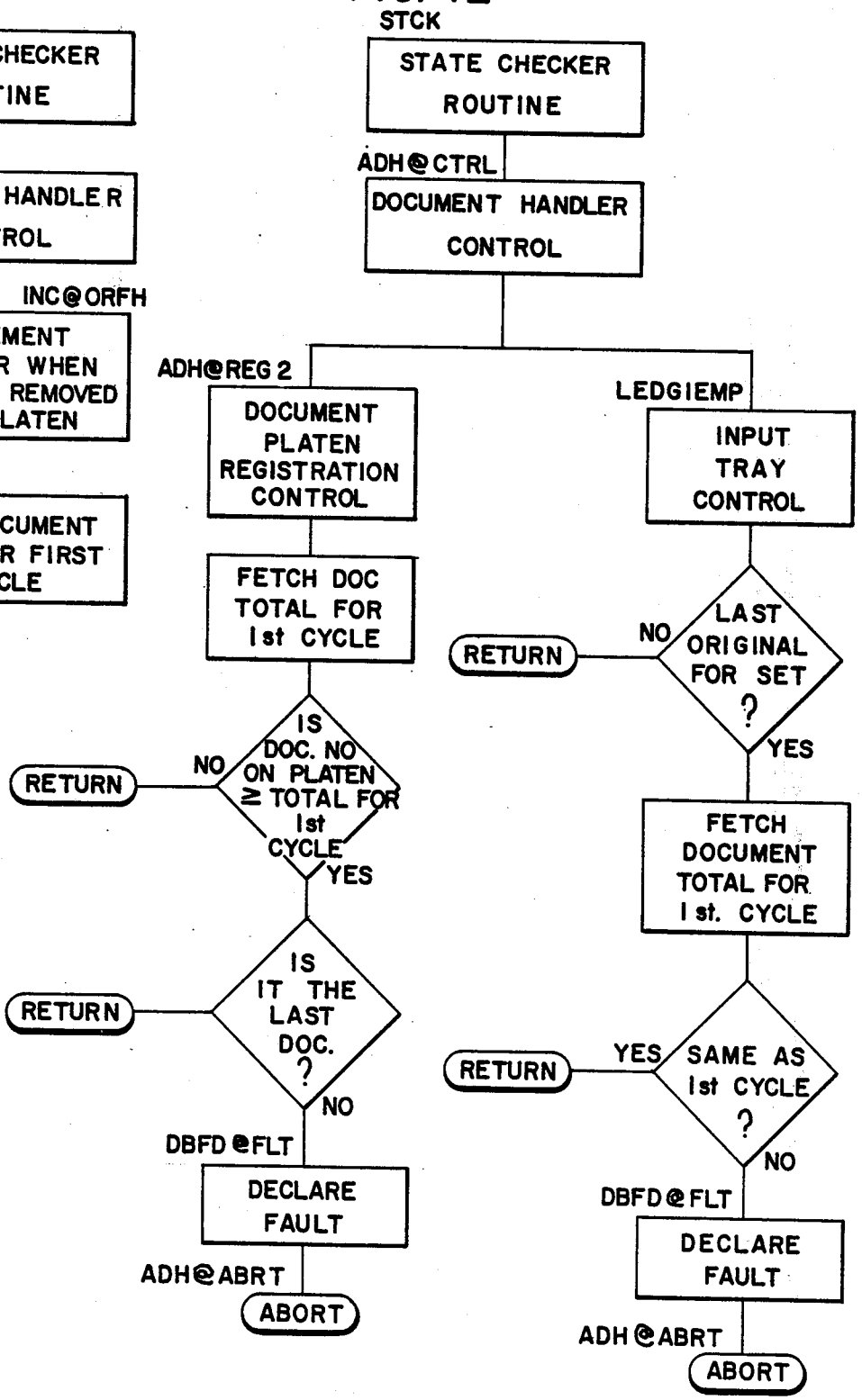
FIG. 42 is a flow chart for the routines which compare the total number of documents placed on the platen for each set cycle and for indicating a fault if the totals are not the same.

Referring now to FIGS. 41 and 42, as well as FIG. 14 showing document handler 16, the control system of the present invention will be described. As described earlier herein, the machine is under the control of controller 18 which is normally instructed by the Background or State Checker (STCK) routine reproduced in Table I. The State Checker routine periodically calls an ADH Control routine (ADH@CTRL reproduced in Table XI) which controls the operation of document handler 16. If the document handler console button 822 has been pushed, a flag is set which causes controller 18 to execute the instructions of this routine as is well-known in the art. The ADH Control routine controls the timing of the actuation of the various document handler components. A set of documents is typically placed in input tray 233 with separator or bail bar 235 placed on top of the last page of the set. The documents are then fed in seriatim onto platen 35, registered against guide 273 and then returned to tray 233 via chute 276, with the first document 2 of the set resting on top of bail bar 235. When the last document of the set leaves tray 233, bail bar 235 actuates switch 259 thereby signalling that the last document of the set has left tray 233. If it is necessary to recycle the set of documents through the document handler 16, the same procedure is followed until the desired number of books are made.

In accordance with the present invention, controller 18 provides counting means for counting the number of documents placed on platen 35 and for storing the total for each set in a temporary storage location, for example, RAM memory 546. A variety of devices can be utilized to perform this function. In the preferred embodiment, this is performed by software counters, i.e. registers or temporary storage devices, which are incremented every time a document is removed from platen 35. A routine (REVERSE reproduced in Table XII) activates the reverse clutches of document handler 16 to remove each document from platen 35 after copies are made therefrom. This routine in turn calls a Document Counter routine (INC@ORFH reproduced in Table XIII) which increments a counter, referred to as the document counter, every time a document is removed from platen 35. When the last document of the set leaves tray 235, a flag, LST@ORG, is set by the activation of switch 259 by bail bar 235 as indicated above by the Input Tray Control routine (LEDGIEMP reproduced in Table XIV). Consequently, when the last original of the set is removed from platen 35, the contents of the document counter is caused to be stored in a memory location by the Document Counter routine (INC ORFH). In such manner, the total number of documents for each set is counted and stored temporarily for further use. For purposes of illustration, assume that twenty-five documents 2 for the first set were counted and stored.

Now referring particularly to FIG. 42, assume that another set of documents is to be recycled to through document handler 16 as previously described. As noted above, the purpose of the present invention is to insure that the total number of documents for each set cycle are the same, otherwise a nonuniform number of pages for each book produced would result. Again, for purposes of illustration, assume that only two set cycles are required for this copy run.

As each document for the second set cycle is registered against guide 273, a Document Platen Registration Control routine (ADH@REG2 reproduced in Table XV) is entered. It should be noted that this routine is also utilized during the first set cycle to control the actuation of the document handler 16 components to register the documents 2. However, for subsequent set cycles, this routine fetches the document total for previous cycles and compares it with the contents of the document counter for the current set cycle, here the second cycle. If the document number on the platen 35 is greater than or equal to the total for the first cycle, it will check if the last original flag, LST@ORG, has been set as previously described by the Input Tray Control routine. If it is not the last original which is on the platen 35, controller 18 realizes that there are more documents in this set cycle than in the previous cycle. For example, if the contents of the document counter indicate that document number twenty-five is on platen 35 for the second set cycle, and there are more originals to be placed thereon, controller 18 realizes that there has been a double document misfeed during the first set cycle. As a result, the Document Platen Registration Control routine calls another routine (DBFD@FLT reproduced in Table XVI) which indicates that there has been a fault or misfeed by lighting an appropriate console light 830. Moreover, this routine, in turn, calls another routine (ADH@ABRT) which automatically brings the document handler 16 to a stop.

As just described, controller 18 is provided with the means to determine if the number of documents in the second set cycle is greater than that of the first set cycle. The Input Tray Control routine of Table XIV instructs controller 18 in such manner to determine whether the number of documents in the second set cycle is less than the number of documents placed on platen 35 in the first set cycle. As previously described, when the last document for the set leaves tray 233, a last original flag, LST@ORG, is set. When this flag is set, this routine instructs controller 18 to fetch the document total for the first cycle and compare it with the contents of the document counter after adding one to the contents thereof to account for the last document which has not yet been registered by the document counter. Accordingly, this number represents the total number of documents to be placed on the platen for the second set cycle. If they are not the same, a fault is declared and the document handler 16 brought to a stop by the DBFD@FLT and ADH@ABRT routines, respectively, as previously described. Accordingly, a fewer number of originals in the second set cycle than in the first set cycle is detected.

In view of the foregoing description, it can now be realized that the present invention provides a control system for a reproduction machine which insures that the number of pages in books copied from a set of documents will be uniform when it is necessary to recycle the set through a document handler. The invention has been described by illustrating how a digital computer can be instructed by software programs to perform this function. However, it should be understood that the spirit of this invention can also be performed by hardwired circuitry if it is desired to do so, for example, by integrated circuit devices which contain the same basic elements which are only temporarily utilized by the computer when instructed by the software programs. Therefore, the scope of this invention is intended to be determined by the following claims and not by the particular embodiment described herein.

What is claimed is:

1. In a reproduction machine for making copies from original documents, said machine including document handler means for transporting successive sets of documents between an input tray and an exposure platen so that copies therefrom can be produced, the improvement comprising a method of insuring that the total number of documents transported to the platen is the same for each set cycle, said method comprising:

feeding each document to the platen;

incrementing a document counter every time a document is removed from the platen;

storing the total number of documents placed on the platen for the first set cycle;

detecting when the last original has left the input tray for subsequent sets;

adding to the contents of the document counter for said subsequent sets a sufficient number to account for those documents not yet registered by the document counter;

comparing this number with the stored document total before the last original is removed from the platen; and displaying a fault if the comparison is not equal.

2. The method of claim 1 which further includes the steps of comparing the contents of the document counter for every document in subsequent cycles with the stored document total of the first set cycle; and displaying a fault if the contents of the document counter is greater than the stored document total.

* * * * *